US010561894B2

(12) United States Patent
Dalebout et al.

(10) Patent No.: US 10,561,894 B2
(45) Date of Patent: Feb. 18, 2020

(54) TREADMILL WITH REMOVABLE SUPPORTS

(71) Applicant: ICON Health & Fitness, Inc., Logan, UT (US)

(72) Inventors: William T. Dalebout, North Logan, UT (US); Gordon Cutler, Providence, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 225 days.

(21) Appl. No.: 15/461,271

(22) Filed: Mar. 16, 2017

(65) Prior Publication Data

US 2017/0266483 A1 Sep. 21, 2017

Related U.S. Application Data

(60) Provisional application No. 62/310,279, filed on Mar. 18, 2016.

(51) Int. Cl.

| | |
|---|---|
| ***A63B 22/02*** | (2006.01) |
| ***A63B 21/072*** | (2006.01) |
| ***A63B 21/22*** | (2006.01) |

(52) U.S. Cl.

CPC ..... *A63B 22/0285* (2013.01); *A63B 21/072* (2013.01); *A63B 22/0235* (2013.01); *A63B 21/225* (2013.01)

(58) Field of Classification Search

CPC .. A63B 1/00; A63B 1/005; A63B 3/00; A63B 21/15; A63B 21/151; A63B 21/154;

(Continued)

(56) References Cited

U.S. PATENT DOCUMENTS

| | | | |
|---|---|---|---|
| 232,022 | A | 9/1880 | Gifford |
| 284,294 | A | 9/1883 | Graves |

(Continued)

FOREIGN PATENT DOCUMENTS

| | | |
|---|---|---|
| CN | 203989681 | 12/2014 |
| KR | 100829774 | 5/2008 |

(Continued)

OTHER PUBLICATIONS

English Translation of Search Report for Taiwan Patent Application No. 104131458 dated Jun. 3, 2016.

(Continued)

*Primary Examiner* — Gary D Urbiel Goldner
(74) *Attorney, Agent, or Firm* — Ray Quinney & Nebeker

(57) ABSTRACT

A treadmill includes a platform where the platform includes a first side panel and a second side panel spaced apart at a distance from the first side panel, and a gap defined between the first side panel and the second side panel. The treadmill also includes a running deck contained within the platform and exposed within the gap, a first pulley connected to the running deck, a second pulley connected to the running deck opposite the first pulley, a tread belt surrounding the first pulley and the second pulley, a first post removably connected to the platform, a second post removably connected to the platform, and a first rail transversely connected to the first post and the second post.

20 Claims, 12 Drawing Sheets

(58) Field of Classification Search
CPC ... A63B 21/22; A63B 21/225; A63B 21/4023; A63B 21/4027; A63B 21/4033; A63B 21/4034; A63B 21/4035; A63B 22/0046; A63B 22/02; A63B 22/0285; A63B 69/0028; A63B 69/0035; A63B 69/0057; A63B 69/0064; A63B 2069/0031; A63B 2069/0033; A63B 71/0036; A63B 71/06; A63B 71/0619; A63B 71/0622; A63B 2071/0658; A63B 2210/00; A63B 2210/50; A63B 2225/09; A63B 2225/093
See application file for complete search history.

(56) References Cited

U.S. PATENT DOCUMENTS 321,388 A 6/1885 Ruebsam
339,638 A 4/1886 Goldie
421,779 A 2/1890 Steven
447,780 A 3/1891 Luge
450,792 A 4/1891 Dodd
659,216 A 10/1900 Dowling
663,486 A 12/1900 Boren
674,391 A 5/1901 Baker
683,284 A 9/1901 Honey
766,930 A 8/1904 Clemons
881,521 A 3/1908 Wilson
897,722 A 9/1908 Day
931,394 A 8/1909 Day
937,795 A 10/1909 Hackney
1,016,729 A 2/1912 Barrett
1,020,777 A 3/1912 Peterson
1,064,968 A 6/1913 Hagen
1,082,940 A 12/1913 Flora
1,211,765 A 1/1917 Schmidt
1,570,482 A 1/1926 Hale
1,580,530 A 4/1926 Rambo
1,585,748 A 5/1926 Wendelken
1,715,870 A 6/1929 Augustine
1,766,089 A 6/1930 Wood
1,778,635 A 10/1930 Heisler
1,824,406 A 9/1931 Petersime
1,850,530 A 3/1932 Brown
1,893,728 A 1/1933 Bullis
1,902,694 A 3/1933 Edwards
1,919,627 A * 7/1933 Fitz Gerald ..... A63B 22/02 482/54
1,928,089 A 9/1933 Blickman
1,973,945 A 9/1934 Chavin
1,978,579 A 10/1934 Hooks
1,982,843 A 12/1934 Traver
2,017,885 A * 10/1935 Atcheson ..... A63B 22/02 482/54
2,067,136 A 1/1937 Bridenbaugh
2,117,957 A 5/1938 Ritter
2,155,684 A * 4/1939 Richards ..... A63B 22/02 119/700
2,165,700 A 7/1939 Henry
2,177,957 A 10/1939 Stewart
2,219,219 A 10/1940 Boger
2,247,946 A 7/1941 Hein
2,255,864 A 9/1941 Stephens
2,315,485 A 4/1943 Jones
2,399,915 A 5/1946 Drake
2,440,644 A 4/1948 Powell
2,569,007 A 9/1951 Klyce
2,607,816 A 8/1952 Ryder
2,632,645 A 3/1953 Barkschat
2,645,539 A 7/1953 Thompson
2,646,282 A 7/1953 Ringman
2,648,540 A 8/1953 Hunter
2,674,453 A 4/1954 Hummert
2,743,623 A 5/1956 Wells
2,746,822 A 5/1956 Copenhaver
2,842,365 A 7/1958 Kelley
2,855,200 A 10/1958 Blickman
2,874,971 A 2/1959 Devery
2,969,060 A 1/1961 Swanda
2,984,594 A 5/1961 Runton
3,035,671 A 5/1962 Sicherman
3,059,312 A 10/1962 Jamieson
3,068,950 A 12/1962 Davidson
3,072,426 A 1/1963 Gilbert
3,112,108 A 11/1963 Hanke
3,127,171 A 3/1964 Noland et al.
3,179,071 A 4/1965 Johnston
3,193,287 A 7/1965 Robinson
3,205,888 A 9/1965 Stroop
3,316,898 A 5/1967 Brown
3,319,273 A 5/1967 Solin
3,342,485 A 9/1967 Gaul
3,345,067 A 10/1967 Smith
3,358,813 A 12/1967 Kohlhagen
3,368,746 A 2/1968 Zelinski
3,378,259 A 4/1968 Kupchinski
3,408,067 A 10/1968 Armstrong
3,408,069 A 10/1968 Lewis
3,411,497 A 11/1968 Rickey et al.
3,416,174 A 12/1968 Novitske
3,430,084 A 2/1969 Hall
3,430,507 A 3/1969 Hurst et al.
3,438,627 A 4/1969 La Lanne
3,444,830 A 5/1969 Doetsch
3,446,503 A 5/1969 Lawton
3,501,140 A 3/1970 Eichorn
3,511,500 A 5/1970 Dunn
3,514,110 A 5/1970 Thomander
3,518,985 A 7/1970 Quinton
3,522,947 A 8/1970 Anderson
3,547,435 A 12/1970 Scott
3,554,541 A 1/1971 Spoth
3,563,541 A 2/1971 Sanquist
3,566,861 A 3/1971 Weiss
3,567,219 A 3/1971 Foster
3,568,669 A 3/1971 Stites
3,572,700 A 3/1971 Mastropaolo
3,583,465 A 6/1971 Youngs et al.
3,586,322 A 6/1971 Kverneland
3,589,715 A 6/1971 Mark
3,592,466 A 7/1971 Parsons
3,598,404 A 8/1971 Bowman
3,602,502 A 8/1971 Jaegar
3,606,320 A 9/1971 Erwin, Jr.
3,608,898 A 9/1971 Berlin
3,614,097 A 10/1971 Blickman
3,628,654 A 12/1971 Haracz
3,628,791 A 12/1971 Garcia
3,634,895 A 1/1972 Childers
3,636,577 A 1/1972 Nissen
3,638,941 A 2/1972 Kulkens
3,640,528 A 2/1972 Proctor
3,641,601 A 2/1972 Sieg
3,642,279 A 2/1972 Cutter
3,643,943 A 2/1972 Erwin, Jr. et al.
3,650,529 A 3/1972 Salm
3,658,327 A 4/1972 Thiede
3,659,845 A 5/1972 Quinton
3,664,666 A 5/1972 Lloyd
3,686,776 A 8/1972 Dahl
3,689,066 A 9/1972 Hagen
3,703,284 A 11/1972 Hesen
3,708,166 A 1/1973 Annas
3,709,197 A 1/1973 Moseley
3,731,917 A 5/1973 Townsend
3,738,649 A 6/1973 Miller
3,741,538 A 6/1973 Useldinger
3,751,033 A 8/1973 Rosenthal
3,756,595 A 9/1973 Hague
3,788,412 A 1/1974 Vincent
3,792,860 A 2/1974 Seines
3,809,393 A 5/1974 Jones
3,814,420 A 6/1974 Encke
3,822,488 A 7/1974 Johnson
3,826,491 A 7/1974 Elder

(56) References Cited

U.S. PATENT DOCUMENTS 3,848,467 A 11/1974 Flavell
3,851,874 A 12/1974 Wilkin
3,858,938 A 1/1975 Kristensson et al.
3,861,215 A 1/1975 Bradley
3,869,121 A 3/1975 Flavell
3,870,297 A * 3/1975 Elder ..... A63B 22/0023 482/146
3,874,657 A 4/1975 Niebojewski
3,880,274 A 4/1975 Bechtloff
3,883,922 A 5/1975 Fleischhauer
3,892,404 A 7/1975 Martucci
3,901,379 A 8/1975 Bruhm
3,903,613 A 9/1975 Bisberg
3,904,196 A 9/1975 Berlin
3,909,857 A 10/1975 Herrera
3,912,263 A 10/1975 Yatso
3,918,710 A 11/1975 Niebojewski
3,926,430 A 12/1975 Good
3,929,026 A 12/1975 Hofmann
3,938,400 A 2/1976 Konyha
3,941,377 A 3/1976 Lie
3,948,513 A 4/1976 Pfotenhauer
3,963,101 A 6/1976 Stadelmann et al.
3,977,451 A 8/1976 Duba
3,981,500 A 9/1976 Ryan
4,012,015 A 3/1977 Nelson et al.
4,024,949 A 5/1977 Kleysteuber et al.
4,026,545 A 5/1977 Schonenberger
4,033,567 A 7/1977 Lipfert
4,056,265 A 11/1977 Ide
4,063,726 A 12/1977 Wilson
4,063,727 A 12/1977 Hall
4,066,257 A 1/1978 Moller
4,066,259 A 1/1978 Brentham
4,067,372 A 1/1978 Masson
4,072,309 A 2/1978 Wilson
4,074,903 A 2/1978 Diez de Aux
4,077,626 A 3/1978 Newman
4,082,267 A 4/1978 Flavell
4,093,196 A 6/1978 Bauer
4,094,330 A 6/1978 Jong
4,111,417 A 9/1978 Gardner
4,113,071 A 9/1978 Muller et al.
4,120,294 A 10/1978 Wolfe
4,141,158 A 2/1979 Benseler et al.
4,146,222 A 3/1979 Hribar
4,149,714 A 4/1979 Lambert, Jr.
4,151,988 A 5/1979 Nabinger
4,151,994 A 5/1979 Stalberger, Jr.
4,161,998 A 7/1979 Trimble
4,167,938 A 9/1979 Remih
4,168,061 A 9/1979 Gordon
4,171,805 A 10/1979 Abbott
4,179,134 A 12/1979 Atkinson
4,183,156 A 1/1980 Rudy
4,183,494 A 1/1980 Cleveland
4,188,030 A 2/1980 Hooper
4,199,139 A 4/1980 Mahnke
4,204,673 A 5/1980 Speer, Sr.
4,208,049 A 6/1980 Wilson
4,215,516 A 8/1980 Huschle et al.
4,216,856 A 8/1980 Moring et al.
4,227,689 A 10/1980 Keiser
4,235,437 A 11/1980 Ruis et al.
4,240,627 A 12/1980 Brentham
4,248,476 A 2/1981 Phelps
4,249,725 A 2/1981 Mattox
4,251,932 A 2/1981 Love
4,253,661 A 3/1981 Russell
4,258,821 A 3/1981 Wendt
4,258,913 A 3/1981 Brentham
4,274,625 A 6/1981 Gaetano
4,278,095 A 7/1981 Lapeyre
4,278,249 A 7/1981 Forrest
4,286,782 A 9/1981 Fuhrhop
4,290,601 A 9/1981 Mittelstadt
4,300,761 A 11/1981 Howard
4,313,602 A 2/1982 Sullivan
4,313,603 A 2/1982 Simjian
4,324,501 A 4/1982 Herbenar
4,333,978 A 6/1982 Kocher
4,334,676 A 6/1982 Schonenberger
4,334,695 A 6/1982 Ashby
4,337,283 A 6/1982 Haas, Jr.
4,342,452 A 8/1982 Summa
4,344,616 A 8/1982 Ogden
4,349,597 A 9/1982 Fine et al.
4,350,336 A 9/1982 Hanford
4,358,105 A 11/1982 Sweeney, Jr.
4,363,480 A 12/1982 Fisher et al.
4,363,486 A 12/1982 Chaudhry
4,367,895 A 1/1983 Pacitti et al.
4,369,081 A 1/1983 Curry et al.
4,370,766 A 2/1983 Teague, Jr.
4,374,587 A 2/1983 Ogden
4,377,045 A 3/1983 Aurensan
4,383,684 A 5/1983 Schliep
4,383,714 A 5/1983 Ishida
4,397,462 A 8/1983 Wilmarth
4,406,451 A 9/1983 Gaetano
4,408,613 A 10/1983 Relyea
4,413,821 A * 11/1983 Centafanti ..... A63B 71/0686 482/3
4,422,635 A 12/1983 Herod
4,422,636 A 12/1983 De angeli
4,423,864 A 1/1984 Wiik
4,426,077 A 1/1984 Becker
4,431,181 A 2/1984 Baswell
4,434,981 A 3/1984 Norton
4,441,708 A 4/1984 Brentham
4,445,684 A 5/1984 Ruff
4,452,448 A 6/1984 Ausherman
4,453,766 A 6/1984 DiVito
4,461,472 A 7/1984 Martinez
4,465,277 A 8/1984 Dittrich
4,476,582 A 10/1984 Strauss et al.
4,477,071 A 10/1984 Brown et al.
4,489,933 A 12/1984 Fisher
4,491,318 A 1/1985 Francke
4,494,662 A 1/1985 Clymer
4,496,147 A 1/1985 DeCloux et al.
4,499,784 A 2/1985 Shum
4,502,679 A 3/1985 De Lorenzo
4,505,474 A 3/1985 Mattox
4,505,475 A 3/1985 Olschansky et al.
4,509,510 A 4/1985 Hook
4,512,567 A 4/1985 Phillips
4,512,571 A 4/1985 Hermelin
4,522,394 A 6/1985 Broussard
4,529,194 A 7/1985 Haaheim
4,533,136 A 8/1985 Smith et al.
4,536,244 A 8/1985 Greci et al.
4,538,805 A 9/1985 Parviainen
4,542,899 A 9/1985 Hendricks
4,544,152 A 10/1985 Taitel
4,544,153 A 10/1985 Babcock
4,546,971 A 10/1985 Raasoch
4,549,733 A 10/1985 Salyer
4,563,001 A 1/1986 Terauds
4,563,003 A 1/1986 Bugallo et al.
4,564,193 A 1/1986 Stewart
4,566,689 A 1/1986 Ogden
4,566,732 A 1/1986 Ostergaard, Sr.
4,569,518 A 2/1986 Fulks
4,571,682 A 2/1986 Silverman et al.
4,572,500 A 2/1986 Weiss
4,572,504 A 2/1986 DiBartolo
4,576,352 A 3/1986 Ogden
4,576,376 A 3/1986 Miller
4,577,860 A 3/1986 Matias et al.
4,580,983 A 4/1986 Cassini et al.
4,581,269 A 4/1986 Tilman
4,582,320 A 4/1986 Shaw
4,589,656 A 5/1986 Baldwin

(56) References Cited

U.S. PATENT DOCUMENTS 4,591,147 A 5/1986 Smith et al.
4,592,544 A 6/1986 Smith et al.
4,600,196 A 7/1986 Jones
4,601,142 A 7/1986 Frommelt
4,602,779 A 7/1986 Ogden
4,610,449 A 9/1986 Diercks, Jr.
4,614,337 A 9/1986 Schonenberger
4,616,822 A 10/1986 Trulaske
4,618,139 A 10/1986 Haaheim
4,618,140 A 10/1986 Brown
4,619,454 A 10/1986 Walton
4,621,623 A 11/1986 Wang
4,624,457 A 11/1986 Silberman et al.
4,625,962 A 12/1986 Street
4,627,614 A 12/1986 De Angeli
4,627,615 A 12/1986 Nurkowski
4,627,616 A 12/1986 Kauffman
4,630,817 A 12/1986 Buckley
4,632,385 A 12/1986 Geraci
4,632,386 A 12/1986 Beech
4,632,390 A 12/1986 Richey
4,634,127 A 1/1987 Rockwell
4,635,927 A 1/1987 Shu
4,635,928 A 1/1987 Ogden et al.
4,637,605 A 1/1987 Ritchie
4,638,523 A 1/1987 Todd
4,638,969 A 1/1987 Brown
4,641,833 A 2/1987 Trethewey
4,642,080 A 2/1987 Takano et al.
4,643,418 A 2/1987 Bart
4,645,197 A 2/1987 Mcfee
4,645,200 A 2/1987 Hix
4,645,201 A 2/1987 Evans
4,645,917 A 2/1987 Penney et al.
4,647,041 A 3/1987 Whiteley
4,650,067 A 3/1987 Brule
4,650,184 A 3/1987 Brebner
4,650,185 A 3/1987 Cartwright
4,651,581 A 3/1987 Svensson
4,659,074 A 4/1987 Taitel et al.
4,659,077 A 4/1987 Stropkay
4,659,078 A 4/1987 Blome
4,662,630 A 5/1987 Dignard et al.
4,664,371 A 5/1987 Viander
4,664,373 A 5/1987 Hait
4,664,646 A 5/1987 Rorabaugh
4,673,177 A 6/1987 Szymski
4,674,740 A 6/1987 Iams et al.
4,674,743 A 6/1987 Hirano
4,678,185 A 7/1987 Mahnke
4,679,787 A 7/1987 Guilbault
4,684,121 A 8/1987 Nestegard
4,685,670 A 8/1987 Zinkin
4,687,195 A 8/1987 Potts
4,697,809 A 10/1987 Rockwell
4,700,946 A 10/1987 Breunig
4,702,475 A 10/1987 Elstein et al.
4,705,028 A * 11/1987 Melby ..... A61H 1/0259
482/51
4,705,267 A 11/1987 Jackson
4,708,337 A 11/1987 Shyu
4,709,917 A 12/1987 Yang
4,709,918 A 12/1987 Grinblat
4,709,920 A 12/1987 Schnell
4,711,447 A 12/1987 Mansfield
4,714,248 A 12/1987 Koss
4,718,207 A 1/1988 Frommelt
4,720,099 A 1/1988 Carlson
4,720,789 A 1/1988 Hector et al.
4,721,303 A 1/1988 Fitzpatrick
4,725,057 A 2/1988 Shifferaw
4,726,581 A 2/1988 Chang
4,729,558 A 3/1988 Kuo
4,729,562 A 3/1988 Pipasik
4,733,858 A 3/1988 Lan
4,743,009 A 5/1988 Beale
4,743,015 A 5/1988 Marshall
4,744,559 A 5/1988 Mahnke et al.
4,746,115 A 5/1988 Lahman
4,749,184 A 6/1988 Tobin
4,750,736 A 6/1988 Watterson
4,751,755 A 6/1988 Carey, Jr. et al.
4,756,098 A 7/1988 Boggia
4,757,987 A 7/1988 Allemand
4,759,540 A 7/1988 Yu et al.
4,771,148 A 9/1988 Bersonnet
4,772,015 A 9/1988 Carlson et al.
4,773,170 A 9/1988 Moore et al.
4,776,582 A 10/1988 Ramhorst
4,779,884 A 10/1988 Minati
4,786,049 A 11/1988 Lautenschlager
4,786,050 A 11/1988 Geschwender
4,788,493 A 11/1988 Liptak
4,790,528 A 12/1988 Nakao et al.
4,792,134 A 12/1988 Chen
4,797,968 A 1/1989 Wenzlick
4,798,760 A 1/1989 Diaz-Kotti
4,799,475 A 1/1989 Iams et al.
4,799,671 A 1/1989 Hoggan et al.
4,801,079 A 1/1989 Gonella
4,804,178 A 2/1989 Friedebach
4,805,901 A 2/1989 Kulick
4,807,874 A 2/1989 Little
4,809,804 A 3/1989 Houston et al.
4,809,972 A 3/1989 Rasmussen et al.
4,813,667 A 3/1989 Watterson
4,813,668 A 3/1989 Solloway
4,813,743 A 3/1989 Mizelle
4,817,939 A 4/1989 Augspurger et al.
4,818,175 A 4/1989 Kimura
4,819,583 A 4/1989 Guerra
4,822,029 A 4/1989 Sarno
4,822,034 A 4/1989 Shields
4,824,104 A 4/1989 Bloch
4,826,153 A 5/1989 Schalip
4,826,157 A 5/1989 Fitzpatrick
4,826,158 A 5/1989 Fields, Jr.
4,826,159 A 5/1989 Hersey
4,828,255 A 5/1989 Lahman
4,828,257 A 5/1989 Dyer et al.
4,830,362 A 5/1989 Bull
4,832,332 A 5/1989 Dumbser
4,836,530 A 6/1989 Stanley, Jr.
4,838,543 A 6/1989 Armstrong et al.
4,838,544 A 6/1989 Sasakawa et al.
4,842,266 A 6/1989 Sweeney, Sr.
4,842,274 A 6/1989 Oosthuizen
4,844,449 A 7/1989 Truslaske
4,844,450 A 7/1989 Rodgers, Jr.
4,848,737 A 7/1989 Ehrenfield
4,850,585 A 7/1989 Dalebout
4,861,023 A 8/1989 Wedman
4,861,025 A 8/1989 Rockwell
4,863,161 A 9/1989 Telle
4,865,344 A 9/1989 Romero, Sr. et al.
4,867,443 A 9/1989 Jensen
4,869,493 A 9/1989 Johnston
4,869,494 A 9/1989 Lambert, Sr.
4,869,497 A 9/1989 Stewart et al.
4,875,676 A 10/1989 Zimmer
4,877,239 A 10/1989 Dela Rosa
4,878,662 A 11/1989 Chern
4,878,663 A 11/1989 Luquette
4,880,227 A 11/1989 Sowell
4,883,272 A 11/1989 Lay
4,886,266 A 12/1989 Trulaske
4,891,764 A 1/1990 McIntosh
4,894,933 A 1/1990 Tonkel et al.
4,898,379 A 2/1990 Shiba
4,898,381 A 2/1990 Gordon
4,900,012 A 2/1990 Fu
4,900,017 A 2/1990 Bold, Jr.
4,900,018 A 2/1990 Ish, III
4,902,006 A 2/1990 Stallings, Jr.

(56) References Cited

U.S. PATENT DOCUMENTS 4,904,829 A 2/1990 Berthaud et al.
4,905,330 A 3/1990 Jacobs
4,907,795 A 3/1990 Shaw et al.
4,907,798 A 3/1990 Burchatz
4,909,504 A 3/1990 Yang
4,911,438 A 3/1990 Van Straaten
4,913,396 A 4/1990 Dalebout et al.
4,913,423 A 4/1990 Farran
4,915,377 A 4/1990 Malnke et al.
4,915,379 A 4/1990 Sapp
4,917,376 A 4/1990 Lo
4,919,418 A 4/1990 Miller
4,919,419 A 4/1990 Houston
4,921,242 A 5/1990 Watterson
4,921,247 A 5/1990 Sterling
4,923,193 A 5/1990 Pitzen et al.
4,925,183 A 5/1990 Kim
4,925,724 A 5/1990 Ogden
4,927,136 A 5/1990 Leask
4,928,546 A 5/1990 Walters
4,928,957 A 5/1990 Lanier et al.
4,930,768 A 6/1990 Lapcevic
4,930,769 A 6/1990 Nenoff
4,934,690 A 6/1990 Bull
4,934,692 A 6/1990 Owens
4,938,473 A 7/1990 Lee
4,940,233 A 7/1990 Bull
4,941,652 A 7/1990 Nagano et al.
4,941,673 A 7/1990 Bennett
4,948,121 A 8/1990 Haaheim et al.
4,949,954 A 8/1990 Hix
4,949,958 A 8/1990 Richey
4,949,959 A 8/1990 Stevens
4,952,265 A 8/1990 Yamanaka et al.
4,953,415 A 9/1990 Lehtonen
4,953,858 A 9/1990 Zelli
4,955,466 A 9/1990 Almes et al.
4,958,832 A 9/1990 Kim
4,960,276 A 10/1990 Feuer et al.
4,964,632 A 10/1990 Rockwell
4,968,028 A 11/1990 Wehrell
4,971,316 A 11/1990 Dalebout et al.
4,974,831 A 12/1990 Dunham
4,974,832 A 12/1990 Dalebout
4,976,424 A 12/1990 Sargeant et al.
4,976,428 A 12/1990 Ghazi
4,976,435 A 12/1990 Shatford
4,984,810 A 1/1991 Stearns et al.
4,986,261 A 1/1991 Iams et al.
4,989,860 A 2/1991 Iams et al.
4,998,725 A 3/1991 Watterson et al.
5,000,440 A 3/1991 Lynch
5,000,442 A 3/1991 Dalebout et al.
5,001,632 A 3/1991 Hall-Tipping
5,002,271 A 3/1991 Gonzales
5,004,224 A 4/1991 Wang
5,007,630 A 4/1991 Real et al.
5,007,631 A 4/1991 Wang
5,013,031 A 5/1991 Bull
5,016,870 A 5/1991 Bulloch et al.
5,020,793 A 6/1991 Loane
5,024,441 A 6/1991 Rousseau
5,026,049 A 6/1991 Goodman
5,027,303 A 6/1991 Witte
5,029,801 A 7/1991 Dalebout et al.
5,031,455 A 7/1991 Cline
5,031,901 A 7/1991 Saarinen
5,034,576 A 7/1991 Dalebout et al.
RE33,662 E 8/1991 Blair et al.
5,037,084 A 8/1991 Flor
5,037,089 A 8/1991 Spagnuolo
5,039,089 A 8/1991 Lapcevic
5,039,091 A 8/1991 Johnson
5,042,799 A 8/1991 Stanley
5,046,382 A 9/1991 Steinberg
5,046,722 A 9/1991 Antoon
5,048,823 A 9/1991 Bean
5,051,638 A 9/1991 Pyles
5,054,770 A 10/1991 Bull
5,058,881 A 10/1991 Measom
5,058,882 A 10/1991 Dalebout et al.
5,058,888 A 10/1991 Walker et al.
5,062,626 A 11/1991 Dalebout et al.
5,062,629 A 11/1991 Vaughan
5,062,632 A 11/1991 Dalebout et al.
5,066,000 A 11/1991 Dolan
5,067,710 A 11/1991 Watterson et al.
5,071,115 A 12/1991 Welch
5,072,928 A 12/1991 Stearns et al.
5,072,929 A 12/1991 Peterson et al.
5,074,550 A 12/1991 Sloan
5,077,916 A 1/1992 Beneteau
5,080,353 A 1/1992 Tench
5,081,991 A 1/1992 Chance
5,085,426 A 2/1992 Wanzer et al.
5,085,427 A 2/1992 Finn
5,087,047 A 2/1992 McConnell
5,088,729 A 2/1992 Dalebout
5,094,249 A 3/1992 Marras et al.
5,094,447 A 3/1992 Wang
5,096,225 A 3/1992 Osawa
5,102,122 A 4/1992 Piane, Jr.
5,102,380 A 4/1992 Jacobson et al.
5,104,119 A 4/1992 Lynch
5,104,120 A 4/1992 Watterson et al.
5,108,093 A 4/1992 Watterson
5,109,778 A 5/1992 Berkowitz et al.
5,110,117 A 5/1992 Fisher et al.
5,112,045 A 5/1992 Mason et al.
5,114,388 A 5/1992 Trulaske
5,114,391 A 5/1992 Pitzen et al.
5,123,629 A 6/1992 Takeuchi
5,123,885 A 6/1992 Shields
5,123,886 A 6/1992 Cook
5,129,872 A 7/1992 Dalton et al.
5,131,895 A 7/1992 Rogers, Jr.
5,135,216 A 8/1992 Bingham et al.
5,135,458 A 8/1992 Huang
5,137,501 A 8/1992 Mertesdorf
5,138,730 A 8/1992 Masuda
5,141,480 A 8/1992 Lennox et al.
5,142,358 A 8/1992 Jason
5,145,475 A 9/1992 Cares
5,145,481 A 9/1992 Friedebach
5,147,266 A 9/1992 Ricard
5,149,084 A 9/1992 Dalebout et al.
5,149,312 A 9/1992 Croft et al.
5,154,684 A 10/1992 Delf
5,158,520 A 10/1992 Lemke et al.
5,162,029 A 11/1992 Schine
5,163,885 A 11/1992 Wanzer et al.
5,167,159 A 12/1992 Lucking
5,167,597 A 12/1992 David
5,171,196 A 12/1992 Lynch
5,178,593 A 1/1993 Roberts
5,178,599 A 1/1993 Scott
5,181,894 A 1/1993 Shieng
5,184,295 A 2/1993 Mann
5,184,988 A 2/1993 Dunham
5,186,697 A 2/1993 Rennex
5,192,255 A 3/1993 Dalebout et al.
5,192,257 A 3/1993 Panasewicz
5,192,258 A 3/1993 Keller
5,195,781 A 3/1993 Osawa
5,195,935 A 3/1993 Fencel
5,199,931 A 4/1993 Easley et al.
5,201,694 A 4/1993 Zappel
5,203,229 A 4/1993 Chen
5,203,800 A 4/1993 Meredith
5,203,826 A 4/1993 Dalebout
5,205,798 A 4/1993 Lekhtman
5,205,800 A 4/1993 Grant
5,207,489 A 5/1993 Miller
5,207,622 A 5/1993 Wilkinson et al.

(56) References Cited

U.S. PATENT DOCUMENTS 5,207,625 A 5/1993 White
5,207,628 A 5/1993 Graham
5,211,617 A 5/1993 Millen
5,215,510 A 6/1993 Baran
5,217,422 A 6/1993 Domzalski
5,226,866 A 7/1993 Engel et al.
5,232,422 A 8/1993 Bishop, Jr.
5,234,392 A 8/1993 Clark
5,240,417 A 8/1993 Smithson et al.
5,242,339 A 9/1993 Thornton
5,242,340 A 9/1993 Jerome
5,242,343 A 9/1993 Miller
5,242,347 A 9/1993 Keeton
5,247,853 A 9/1993 Dalebout
5,250,012 A 10/1993 Whitcomb, Jr.
5,250,013 A 10/1993 Brangi
5,254,067 A 10/1993 Habing et al.
5,256,117 A 10/1993 Potts et al.
5,256,118 A 10/1993 Chen
5,256,126 A 10/1993 Grotstein
5,257,701 A 11/1993 Edelson
5,257,964 A 11/1993 Petters
5,261,864 A 11/1993 Fitzpatrick
5,269,736 A 12/1993 Roberts
5,271,416 A 12/1993 Lepley
5,273,285 A 12/1993 Long
5,277,678 A 1/1994 Friedebach et al.
5,279,528 A 1/1994 Dalebout et al.
5,279,529 A 1/1994 Eschenbach
5,279,531 A 1/1994 Jen Huey
5,282,776 A 2/1994 Dalebout
5,284,461 A 2/1994 Wilkinson et al.
5,290,205 A 3/1994 Densmore et al.
5,290,211 A 3/1994 Stearns
5,292,293 A 3/1994 Schumacher
5,295,927 A 3/1994 Easley
5,295,928 A 3/1994 Rennex
5,295,935 A 3/1994 Wang
5,299,992 A 4/1994 Wilkinson
5,299,993 A 4/1994 Habing
5,302,162 A 4/1994 Pasero
5,306,221 A 4/1994 Itaru
5,308,075 A 5/1994 Theriault
5,308,304 A 5/1994 Habing
5,310,392 A 5/1994 Lo
5,313,852 A 5/1994 Arena
5,314,391 A 5/1994 Potash et al.
5,314,392 A 5/1994 Hawkins et al.
5,314,394 A 5/1994 Ronan
5,316,534 A 5/1994 Dalebout et al.
5,318,487 A 6/1994 Golen et al.
5,320,343 A 6/1994 McKinney
5,320,588 A 6/1994 Wanzer et al.
5,320,591 A 6/1994 Harmon et al.
5,320,641 A 6/1994 Riddle
5,324,242 A 6/1994 Lo
5,328,420 A 7/1994 Allen
5,328,422 A 7/1994 Nichols
5,328,429 A 7/1994 Potash et al.
5,330,401 A 7/1994 Walstead
5,330,402 A 7/1994 Johnson
5,334,120 A 8/1994 Rasmussen
5,336,144 A 8/1994 Rodden
5,336,145 A 8/1994 Keiser
5,336,146 A 8/1994 Piaget et al.
5,342,264 A 8/1994 Gordon
5,342,271 A 8/1994 Long
RE34,728 E 9/1994 Hall-Tipping
5,344,372 A 9/1994 Hung
5,344,376 A 9/1994 Bostic et al.
5,348,524 A 9/1994 Grant
5,350,344 A 9/1994 Kissel
5,352,166 A 10/1994 Chang
5,352,167 A 10/1994 Ulicny
5,352,169 A 10/1994 Eschenbach
5,353,452 A 10/1994 Rulis
5,354,248 A 10/1994 Rawls et al.
5,354,251 A 10/1994 Sleamaker
5,356,356 A 10/1994 Hildebrandt et al.
5,358,461 A 10/1994 Bailey, Jr.
5,359,986 A 11/1994 Magrath, III et al.
5,362,069 A 11/1994 Hall-Tipping
5,362,295 A 11/1994 Nurge
5,364,327 A 11/1994 Graham
5,368,532 A 11/1994 Farnet
5,372,556 A 12/1994 Ropp
5,372,559 A 12/1994 Dalebout et al.
5,372,560 A 12/1994 Chang
5,372,564 A 12/1994 Spirito
5,374,227 A 12/1994 Webb
5,378,212 A 1/1995 Pin-Kuo
5,382,207 A 1/1995 Skowronski et al.
5,382,208 A 1/1995 Hu
5,382,209 A 1/1995 Pasier
5,383,827 A 1/1995 Stern
5,383,828 A 1/1995 Sands et al.
5,385,346 A 1/1995 Carroll et al.
5,385,519 A 1/1995 Hsu
5,385,520 A * 1/1995 Lepine ..... A63B 22/0023 482/51
5,387,169 A 2/1995 Wang
5,387,170 A 2/1995 Rawls et al.
5,387,171 A 2/1995 Casey et al.
5,394,922 A 3/1995 Colson et al.
5,396,876 A 3/1995 Liscio et al.
5,398,948 A 3/1995 Mathis
5,401,226 A 3/1995 Stearns
5,403,251 A 4/1995 Belsito et al.
5,403,252 A 4/1995 Leon et al.
5,403,253 A 4/1995 Gaylord
5,403,254 A 4/1995 Lundin et al.
5,403,255 A 4/1995 Johnston
5,406,661 A 4/1995 Pekar
5,407,403 A 4/1995 Coleman
5,407,408 A 4/1995 Wilkinson
5,409,435 A 4/1995 Daniels
RE34,959 E 5/1995 Potts
5,410,971 A 5/1995 Golden et al.
5,417,643 A 5/1995 Taylor
5,419,570 A 5/1995 Bollotte
5,419,571 A 5/1995 Vaughan
5,419,751 A 5/1995 Byrd et al.
5,423,729 A 6/1995 Eschenbach
5,423,730 A 6/1995 Hirsch
5,429,563 A 7/1995 Engel et al.
5,429,569 A 7/1995 Gunnari
5,431,612 A 7/1995 Holden
5,433,679 A 7/1995 Szymczak et al.
5,435,315 A 7/1995 McPhee et al.
5,435,798 A 7/1995 Habing et al.
5,441,467 A 8/1995 Stevens
5,441,468 A 8/1995 Deckers et al.
5,449,334 A 9/1995 Kingsbury
5,454,772 A 10/1995 Rodden
5,454,773 A 10/1995 Blanchard et al.
5,456,648 A 10/1995 Edinburg
5,460,379 A 10/1995 Cleland
5,460,586 A 10/1995 Wilkinson
5,462,503 A 10/1995 Benjamin et al.
5,462,504 A 10/1995 Trulaske et al.
5,466,200 A 11/1995 Ulrich et al.
5,466,203 A 11/1995 Chen
5,468,205 A 11/1995 McFall et al.
5,470,298 A 11/1995 Curtis
5,471,405 A 11/1995 Marsh
5,474,087 A 12/1995 Nashner
5,474,510 A 12/1995 Chen
5,476,430 A 12/1995 Lee et al.
5,484,358 A 1/1996 Wang et al.
5,484,362 A 1/1996 Skowronski et al.
5,487,707 A 1/1996 Sharf et al.
5,489,249 A 2/1996 Brewer et al.
5,489,250 A 2/1996 Densmore et al.
5,490,818 A 2/1996 Haber et al.

(56) References Cited

U.S. PATENT DOCUMENTS 5,492,514 A 2/1996 Daum
5,492,520 A 2/1996 Brown
5,496,235 A 3/1996 Stevens
5,496,236 A 3/1996 Buonauito
5,496,238 A 3/1996 Taylor
5,496,239 A 3/1996 Kallman
5,499,956 A 3/1996 Habing et al.
5,505,011 A 4/1996 Bleimhofer
5,507,271 A 4/1996 Actor
5,509,870 A 4/1996 Lloyd
5,512,025 A 4/1996 Dalebout et al.
5,512,029 A 4/1996 Barnard
5,514,053 A 5/1996 Hawkins et al.
5,518,471 A 5/1996 Hettinger et al.
5,518,473 A 5/1996 Miller
5,520,599 A 5/1996 Chen
5,522,783 A 6/1996 Gordon
5,527,245 A 6/1996 Dalebout et al.
5,529,553 A 6/1996 Finlayson
5,529,554 A 6/1996 Eschenbach
5,531,658 A 7/1996 L. S. C.
5,533,899 A 7/1996 Young
5,533,948 A 7/1996 Wilkinson
5,533,951 A 7/1996 Chang
5,538,489 A 7/1996 Magid
5,542,892 A 8/1996 Buhler
5,545,112 A 8/1996 Densmore et al.
5,549,052 A 8/1996 Hoffman
5,549,536 A 8/1996 Clark
5,551,934 A 9/1996 Binette
5,551,937 A 9/1996 Kwo
5,554,033 A 9/1996 Bizzi et al.
5,554,083 A 9/1996 Chen
5,554,085 A 9/1996 Dalebout
5,556,362 A 9/1996 Whipps
5,562,572 A 10/1996 Carmein
5,562,574 A 10/1996 Miller
5,563,487 A 10/1996 Davis
5,568,993 A 10/1996 Potzick
5,569,128 A 10/1996 Dalebout
5,569,138 A 10/1996 Wang et al.
5,573,485 A 11/1996 Geschwender
5,575,740 A 11/1996 Piaget
5,577,985 A 11/1996 Miller
5,577,987 A 11/1996 Brown
5,580,249 A 12/1996 Jacobsen et al.
5,582,563 A 12/1996 Fan
5,584,700 A 12/1996 Feldman et al.
5,584,779 A 12/1996 Knecht
5,586,736 A 12/1996 Mollet
5,588,938 A 12/1996 Schneider et al.
5,590,893 A 1/1997 Robinson et al.
5,591,104 A 1/1997 Andrus et al.
5,591,106 A 1/1997 Dalebout et al.
5,591,107 A 1/1997 Rodgers, Jr.
5,591,908 A 1/1997 Reid
5,593,372 A 1/1997 Rodgers, Jr.
5,593,380 A 1/1997 Bittikofer
5,595,556 A 1/1997 Dalebout et al.
5,599,261 A 2/1997 Easley et al.
5,600,310 A 2/1997 Whipple, III et al.
5,603,675 A 2/1997 Wu
5,603,678 A 2/1997 Wilson
5,607,375 A 3/1997 Dalebout
5,613,216 A 3/1997 Galler
5,613,856 A 3/1997 Hoover
5,616,103 A 4/1997 Lee
5,622,527 A 4/1997 Watterson et al.
5,625,577 A 4/1997 Kunii et al.
5,626,539 A 5/1997 Piaget
5,626,540 A * 5/1997 Hall ..... A61H 1/0229 482/69
5,630,566 A 5/1997 Case
5,632,209 A 5/1997 Sakakibara
5,634,870 A 6/1997 Wilkinson
5,643,142 A 7/1997 Salerno et al.
5,643,144 A 7/1997 Trulaske
5,643,147 A 7/1997 Huang
5,643,152 A 7/1997 Simonson
5,643,153 A 7/1997 Nylen et al.
5,643,157 A 7/1997 Seliber
5,645,509 A 7/1997 Brewer et al.
5,645,914 A 7/1997 Horowitz
5,649,882 A 7/1997 Parikh et al.
5,650,709 A 7/1997 Rotunda et al.
5,653,662 A 8/1997 Rodgers, Jr.
5,655,997 A 8/1997 Greenberg et al.
5,656,003 A 8/1997 Robinson et al.
5,658,227 A 8/1997 Stearns
5,662,557 A 9/1997 Watterson et al.
5,665,031 A 9/1997 Hsieh
5,665,033 A 9/1997 Palmer
5,667,459 A 9/1997 Su
5,667,461 A * 9/1997 Hall ..... A61H 1/0229 472/15
5,669,833 A 9/1997 Stone
5,669,857 A 9/1997 Watterson et al.
5,669,865 A 9/1997 Gordon
5,672,140 A 9/1997 Watterson et al.
5,674,156 A 10/1997 Watterson et al.
5,674,453 A 10/1997 Watterson et al.
5,676,624 A 10/1997 Watterson et al.
5,679,047 A 10/1997 Engel
5,679,101 A 10/1997 Magid
5,683,332 A 11/1997 Watterson et al.
5,685,804 A 11/1997 Whan-Tong et al.
5,688,209 A 11/1997 Trulaske et al.
5,688,216 A 11/1997 Mauriello
5,690,582 A 11/1997 Ulrich et al.
5,690,587 A 11/1997 Gruenangerl
5,690,589 A 11/1997 Rodgers, Jr.
5,692,994 A 12/1997 Eschenbach
5,695,435 A 12/1997 Dalebout et al.
5,695,436 A 12/1997 Huang
5,702,325 A 12/1997 Watterson et al.
5,704,879 A 1/1998 Watterson et al.
5,707,319 A 1/1998 Riley
5,708,355 A 1/1998 Schrey
5,709,632 A 1/1998 Socwell
5,709,633 A 1/1998 Sokol
5,711,745 A 1/1998 Yang
5,711,749 A 1/1998 Miller
5,713,549 A 2/1998 Shieh
5,713,821 A 2/1998 Nissen
5,716,308 A 2/1998 Lee
5,718,657 A 2/1998 Dalebout et al.
5,718,660 A 2/1998 Chen
5,720,200 A 2/1998 Anderson et al.
5,720,474 A 2/1998 Sugiyama
5,722,917 A 3/1998 Olschansky et al.
5,722,920 A 3/1998 Bauer
5,722,922 A 3/1998 Watterson et al.
5,725,459 A 3/1998 Rexach
5,730,236 A 3/1998 Miller et al.
5,733,228 A 3/1998 Stevens
5,733,229 A 3/1998 Dalebout et al.
5,735,586 A 4/1998 Cheng
5,735,773 A 4/1998 Vittone
5,735,776 A 4/1998 Swezey
5,738,612 A 4/1998 Tsuda
5,741,205 A 4/1998 Doll et al.
5,743,193 A 4/1998 Kakuta et al.
5,743,832 A 4/1998 Sands et al.
5,743,833 A 4/1998 Watterson et al.
5,743,835 A 4/1998 Trotter
5,746,682 A 5/1998 Hung
5,749,372 A 5/1998 Allen
5,749,787 A 5/1998 Jank
5,749,807 A 5/1998 Webb
5,749,809 A 5/1998 Lin
5,749,813 A 5/1998 Domzalski
5,752,879 A 5/1998 Berdut
5,752,897 A 5/1998 Skowronski et al.
5,755,642 A 5/1998 Miller

(56) References Cited

U.S. PATENT DOCUMENTS

| | | | |
|---|---|---|---|
| 5,755,645 | A | 5/1998 | Miller et al. |
| 5,755,651 | A | 5/1998 | Homyonfer |
| 5,759,136 | A | 6/1998 | Chen |
| 5,760,353 | A | 6/1998 | Rapp |
| 5,761,831 | A | 6/1998 | Cho |
| 5,762,584 | A | 6/1998 | Daniels |
| 5,762,587 | A | 6/1998 | Dalebout et al. |
| 5,762,588 | A | 6/1998 | Chen |
| 5,769,759 | A | 6/1998 | Alter |
| 5,771,152 | A | 6/1998 | Crompton et al. |
| 5,772,522 | A | 6/1998 | Nesbit |
| 5,772,558 | A | 6/1998 | Rodgers, Jr. |
| 5,772,560 | A | 6/1998 | Watterson et al. |
| 5,776,582 | A | 7/1998 | Needham |
| 5,779,599 | A | 7/1998 | Chen |
| 5,779,607 | A | 7/1998 | Harris |
| 5,782,639 | A | 7/1998 | Beal |
| 5,782,723 | A | 7/1998 | Kuo |
| 5,785,630 | A | 7/1998 | Bobick et al. |
| 5,788,609 | A | 8/1998 | Miller |
| 5,788,610 | A | 8/1998 | Eschenbach |
| 5,788,611 | A | 8/1998 | Kuo |
| 5,792,027 | A | 8/1998 | Gvoich |
| 5,792,031 | A | 8/1998 | Alton |
| 5,795,270 | A | 8/1998 | Woods et al. |
| 5,797,578 | A | 8/1998 | Graffeo |
| 5,803,874 | A | 9/1998 | Wilkinson |
| 5,803,877 | A | 9/1998 | Franey |
| 5,803,882 | A | 9/1998 | Habing et al. |
| 5,807,210 | A | 9/1998 | Devlin |
| 5,810,696 | A | 9/1998 | Webb |
| 5,810,697 | A | 9/1998 | Joiner |
| 5,810,698 | A | 9/1998 | Hullett et al. |
| 5,813,142 | A | 9/1998 | Demon |
| 5,813,947 | A | 9/1998 | Densmore |
| 5,813,953 | A | 9/1998 | Whipple |
| 5,816,981 | A | 10/1998 | Hung |
| 5,820,478 | A | 10/1998 | Wood et al. |
| 5,823,618 | A | 10/1998 | Fox et al. |
| 5,827,155 | A | 10/1998 | Jensen et al. |
| 5,827,158 | A | 10/1998 | Drecksel |
| 5,830,107 | A | 11/1998 | Brigliadoro |
| 5,830,113 | A | 11/1998 | Coody et al. |
| 5,830,114 | A | 11/1998 | Halfen et al. |
| 5,833,577 | A | 11/1998 | Hurt |
| 5,833,583 | A | 11/1998 | Chuang |
| 5,833,584 | A | 11/1998 | Piaget et al. |
| 5,833,587 | A | 11/1998 | Strong et al. |
| 5,836,770 | A | 11/1998 | Powers |
| 5,839,990 | A | 11/1998 | Virkkala |
| 5,839,993 | A | 11/1998 | Fox |
| 5,842,961 | A | 12/1998 | Davis |
| 5,846,166 | A | 12/1998 | Kuo |
| 5,848,954 | A | 12/1998 | Stearns et al. |
| 5,852,264 | A | 12/1998 | Muller |
| 5,855,537 | A | 1/1999 | Coody et al. |
| 5,855,538 | A | 1/1999 | Argabright |
| 5,857,939 | A | 1/1999 | Kaufman |
| 5,857,940 | A | 1/1999 | Husted |
| 5,857,941 | A | 1/1999 | Maresh |
| 5,857,943 | A | 1/1999 | Murray |
| 5,860,893 | A | 1/1999 | Watterson et al. |
| 5,860,894 | A | 1/1999 | Dalebout et al. |
| 5,860,899 | A | 1/1999 | Rassman |
| 5,865,710 | A | 2/1999 | Wilson-Hyde |
| 5,868,108 | A | 2/1999 | Schmitz et al. |
| 5,868,648 | A | 2/1999 | Coody et al. |
| 5,871,421 | A | 2/1999 | Trulaske et al. |
| 5,876,095 | A | 3/1999 | Johnston |
| 5,879,271 | A | 3/1999 | Stearns et al. |
| 5,879,273 | A | 3/1999 | Wei |
| 5,879,276 | A | 3/1999 | Miller |
| 5,882,281 | A | 3/1999 | Stearns et al. |
| 5,885,197 | A | 3/1999 | Barton |
| 5,888,172 | A | 3/1999 | Andrus et al. |
| 5,890,562 | A | 4/1999 | Bartels et al. |
| 5,890,995 | A | 4/1999 | Bobick et al. |
| 5,891,001 | A | 4/1999 | Carnes et al. |
| 5,891,003 | A | 4/1999 | Deac et al. |
| 5,895,339 | A | 4/1999 | Maresh |
| 5,895,340 | A | 4/1999 | Keller |
| 5,897,457 | A | 4/1999 | Mackovjak |
| 5,897,459 | A | 4/1999 | Habing et al. |
| 5,897,460 | A | 4/1999 | McBride et al. |
| 5,897,461 | A | 4/1999 | Socwell |
| 5,899,833 | A | 5/1999 | Ryan et al. |
| 5,899,834 | A | 5/1999 | Dalebout et al. |
| 5,902,214 | A | 5/1999 | Makikawa et al. |
| 5,904,398 | A | 5/1999 | Farricielli |
| 5,904,636 | A | 5/1999 | Chen |
| 5,906,269 | A | 5/1999 | Zabron et al. |
| 5,906,564 | A | 5/1999 | Jacobsen |
| 5,910,070 | A | 6/1999 | Henry et al. |
| 5,910,072 | A | 6/1999 | Rawls et al. |
| 5,911,132 | A | 6/1999 | Sloane |
| 5,913,751 | A | 6/1999 | Eschenbach |
| 5,916,064 | A | 6/1999 | Eschenbach |
| 5,916,069 | A | 6/1999 | Wang |
| 5,917,692 | A | 6/1999 | Schmitz et al. |
| 5,919,118 | A | 7/1999 | Stearns |
| 5,921,892 | A | 7/1999 | Easton |
| 5,921,896 | A | 7/1999 | Boland |
| 5,925,001 | A | 7/1999 | Hoyt et al. |
| 5,938,551 | A | 8/1999 | Warner |
| 5,938,565 | A | 8/1999 | Bernacki |
| 5,938,570 | A | 8/1999 | Maresh |
| 5,938,571 | A | 8/1999 | Stevens |
| 5,938,575 | A | 8/1999 | Stearns |
| 5,940,502 | A | 8/1999 | Hirai et al. |
| 5,940,911 | A | 8/1999 | Wang |
| 5,941,807 | A | 8/1999 | Cassidy |
| 5,943,794 | A | 8/1999 | Gelsomini |
| 5,944,641 | A | 8/1999 | Habing |
| 5,947,869 | A | 9/1999 | Shea |
| 5,947,872 | A | 9/1999 | Ryan et al. |
| 5,951,441 | A | 9/1999 | Dalebout |
| 5,951,444 | A | 9/1999 | Webber |
| 5,951,447 | A | 9/1999 | Butler |
| 5,951,449 | A | 9/1999 | Oppriecht |
| 5,957,814 | A | 9/1999 | Eschenbach |
| 5,961,423 | A | 10/1999 | Sellers |
| 5,961,430 | A | 10/1999 | Zuckerman et al. |
| 5,967,944 | A | 10/1999 | Vittone et al. |
| 5,967,954 | A | 10/1999 | Habing |
| 5,967,955 | A | 10/1999 | Westfall et al. |
| 5,971,902 | A | 10/1999 | Robertson et al. |
| 5,976,039 | A | 11/1999 | Epel et al. |
| 5,976,061 | A | 11/1999 | Moon et al. |
| 5,980,430 | A | 11/1999 | Wang |
| 5,980,432 | A | 11/1999 | Ahman |
| 5,984,798 | A | 11/1999 | Gilmour |
| 5,984,839 | A | 11/1999 | Corkum |
| 5,989,161 | A | 11/1999 | Wang et al. |
| 5,989,163 | A | 11/1999 | Rodgers, Jr. |
| 5,989,168 | A | 11/1999 | See |
| 5,991,143 | A | 11/1999 | Wright et al. |
| 5,993,358 | A | 11/1999 | Gureghian et al. |
| 5,993,359 | A | 11/1999 | Eschenbach |
| 5,993,362 | A | 11/1999 | Ghobadi |
| 5,997,447 | A | 12/1999 | Giannelli et al. |
| 5,997,450 | A | 12/1999 | Wilkinson |
| 6,003,481 | A | 12/1999 | Pischinger et al. |
| 6,004,244 | A | 12/1999 | Simonson |
| 6,006,379 | A | 12/1999 | Hensley |
| 6,010,432 | A | 1/2000 | Vawter |
| 6,012,591 | A | 1/2000 | Brandenberg |
| 6,012,772 | A | 1/2000 | Conde et al. |
| 6,013,011 | A | 1/2000 | Moore et al. |
| 6,015,367 | A | 1/2000 | Scaramucci |
| 6,015,368 | A | 1/2000 | Clem |
| 6,027,429 | A | 2/2000 | Daniels |
| 6,027,430 | A | 2/2000 | Stearns et al. |
| 6,027,432 | A | 2/2000 | Cheng |
| 6,029,858 | A | 2/2000 | Srokose |

(56) References Cited

U.S. PATENT DOCUMENTS 6,030,320 A 2/2000 Stearns
6,030,321 A 2/2000 Fuentes
6,030,323 A 2/2000 Fontenot
6,033,344 A 3/2000 Trulaske et al.
6,033,347 A 3/2000 Dalebout et al.
6,033,350 A 3/2000 Krull
6,036,622 A 3/2000 Gordon
6,042,512 A 3/2000 Eschenbach
6,042,514 A 3/2000 Abelbeck
6,042,515 A 3/2000 Wang
6,042,516 A 3/2000 Norton
6,042,518 A 3/2000 Hildebrandt et al.
6,042,523 A 3/2000 Graham
6,045,487 A 4/2000 Miller
6,045,488 A 4/2000 Eschenbach
6,045,490 A 4/2000 Shafer
6,045,491 A 4/2000 McNergney
6,050,920 A 4/2000 Ehrenfried
6,050,921 A 4/2000 Wang
6,050,922 A 4/2000 Wang
6,050,923 A 4/2000 Yu
6,053,844 A 4/2000 Clem
6,053,847 A 4/2000 Stearns et al.
6,053,848 A 4/2000 Eschenbach
6,055,747 A 5/2000 Lombardino
6,056,678 A 5/2000 Giannelli et al.
6,059,692 A 5/2000 Hickman
6,059,695 A 5/2000 Hung
6,063,009 A 5/2000 Stearns
6,066,075 A 5/2000 Poulton
6,068,578 A 5/2000 Wang
6,068,579 A 5/2000 Killian et al.
6,071,031 A 6/2000 Bailey
6,071,216 A 6/2000 Giannelli et al.
6,075,525 A 6/2000 Hsieh
6,077,196 A 6/2000 Eschenbach
6,077,198 A 6/2000 Eschenbach
6,077,199 A 6/2000 Hsu
6,077,200 A 6/2000 Lin
6,080,091 A 6/2000 Habing et al.
6,086,520 A 7/2000 Rodriquez
6,090,014 A 7/2000 Eschenbach
6,090,016 A 7/2000 Kuo
6,095,951 A 8/2000 Skowronski et al.
6,099,439 A 8/2000 Ryan et al.
6,102,412 A 8/2000 Staffaroni
6,102,832 A 8/2000 Tani
6,110,076 A 8/2000 Hurt
6,110,077 A 8/2000 Yu
6,113,188 A 9/2000 Stewart et al.
6,113,519 A * 9/2000 Goto ..... A63B 71/0009 482/51
6,113,522 A 9/2000 Montgomery
6,117,049 A 9/2000 Lowe
6,120,421 A 9/2000 Kuo
6,123,646 A 9/2000 Colassi
6,123,647 A 9/2000 Mitchell
6,123,648 A 9/2000 Stevens
6,123,649 A 9/2000 Lee
6,123,650 A 9/2000 Birrell
6,125,851 A 10/2000 Walker et al.
6,126,574 A 10/2000 Stearns et al.
6,126,575 A 10/2000 Wang
6,126,576 A 10/2000 Wang
6,129,962 A 10/2000 Quigley et al.
6,132,314 A 10/2000 Aiki
6,132,340 A 10/2000 Wang
6,135,924 A 10/2000 Gibbs et al.
6,135,925 A 10/2000 Liu
6,142,870 A 11/2000 Wada et al.
6,142,913 A 11/2000 Ewert
6,142,914 A 11/2000 Crawford et al.
6,142,915 A 11/2000 Eschenbach
6,146,313 A 11/2000 Whan-Tong et al.
6,146,315 A 11/2000 Schonenberger
6,149,551 A 11/2000 Pyles et al.
6,149,552 A 11/2000 Chen
6,152,856 A 11/2000 Studor et al.
6,152,859 A 11/2000 Stearns
6,162,183 A 12/2000 Hoover
6,163,451 A 12/2000 Chiu
6,165,107 A 12/2000 Birrell
6,168,551 B1 1/2001 McGuinness
6,171,216 B1 1/2001 Wang
6,171,219 B1 1/2001 Simonson
6,174,267 B1 1/2001 Dalebout
6,174,268 B1 1/2001 Novak
6,176,814 B1 1/2001 Ryan et al.
6,179,753 B1 1/2001 Barker et al.
6,181,647 B1 1/2001 Tipton
6,183,397 B1 2/2001 Stearns et al.
6,186,290 B1 2/2001 Carlson
6,186,460 B1 2/2001 Lin
6,186,929 B1 2/2001 Endelman et al.
6,189,846 B1 2/2001 Wang
6,190,289 B1 2/2001 Pyles et al.
6,193,635 B1 2/2001 Webber et al.
6,203,474 B1 3/2001 Jones
6,206,795 B1 3/2001 Ou
6,210,305 B1 4/2001 Eschenbach
6,213,919 B1 4/2001 Wang
6,215,870 B1 4/2001 Hirai et al.
6,217,487 B1 4/2001 Reinert
6,220,990 B1 4/2001 Crivello
6,220,995 B1 4/2001 Chen
6,224,516 B1 5/2001 Disch
6,224,519 B1 5/2001 Doolittle
6,228,003 B1 5/2001 Hald et al.
6,230,047 B1 5/2001 McHugh
6,230,460 B1 5/2001 Huyett
6,231,482 B1 5/2001 Thompson
6,231,946 B1 5/2001 Brown, Jr. et al.
6,234,935 B1 5/2001 Chu
6,234,936 B1 5/2001 Wang
6,237,583 B1 5/2001 Ripley et al.
6,238,323 B1 5/2001 Simonson
6,241,638 B1 6/2001 Hurt
6,244,988 B1 6/2001 Delman
6,244,992 B1 6/2001 James
6,245,001 B1 6/2001 Siaperas
6,251,047 B1 6/2001 Stearns et al.
6,251,048 B1 6/2001 Kaufman
6,251,052 B1 6/2001 Simonson
6,254,514 B1 7/2001 Maresh et al.
6,254,515 B1 7/2001 Carman et al.
6,261,022 B1 7/2001 Dalebout et al.
6,261,209 B1 7/2001 Coody
6,264,586 B1 7/2001 Webber
6,267,710 B1 7/2001 Liu
6,273,842 B1 8/2001 Wang
6,273,843 B1 8/2001 Lo
6,276,749 B1 8/2001 Okazawa et al.
6,277,054 B1 8/2001 Kuo
6,277,056 B1 8/2001 McBride et al.
6,280,361 B1 8/2001 Harvey et al.
6,280,362 B1 8/2001 Dalebout et al.
6,280,367 B1 8/2001 Arsenault
6,282,816 B1 9/2001 Rosendahl
6,283,896 B1 9/2001 Grunfeld
6,287,240 B1 9/2001 Trabbic
6,293,375 B1 9/2001 Chen
6,296,594 B1 10/2001 Simonson
6,299,959 B1 10/2001 Squires et al.
6,302,815 B1 10/2001 Shishido et al.
6,302,826 B1 10/2001 Lee
6,302,828 B1 10/2001 Martin et al.
6,302,829 B1 10/2001 Schmidt
6,302,830 B1 10/2001 Stearns
6,302,833 B1 10/2001 Ellis et al.
6,306,108 B1 10/2001 Butler
6,307,167 B1 10/2001 Kajio et al.
6,312,363 B1 11/2001 Watterson et al.
6,314,667 B1 11/2001 Rife et al.
6,315,486 B1 11/2001 Lunz

(56) References Cited

U.S. PATENT DOCUMENTS

| | | | |
|---|---|---|---|
| 6,322,059 | B1 | 11/2001 | Kelm et al. |
| 6,322,481 | B1 | 11/2001 | Krull |
| 6,325,745 | B1 | 12/2001 | Yu |
| 6,325,746 | B1 | 12/2001 | Wang |
| 6,328,676 | B1 | 12/2001 | Alessandri |
| 6,328,677 | B1 | 12/2001 | Drapeau |
| 6,334,624 | B1 | 1/2002 | Giglio |
| 6,344,986 | B1 | 2/2002 | Jain et al. |
| 6,347,603 | B1 | 2/2002 | Felger |
| 6,348,028 | B1 | 2/2002 | Cragg |
| 6,350,218 | B1 | 2/2002 | Dalebout et al. |
| 6,352,494 | B2 | 3/2002 | McAlonan |
| 6,357,077 | B1 | 3/2002 | Jones, Jr. et al. |
| 6,361,476 | B1 | 3/2002 | Eschenbach |
| 6,368,252 | B1 | 4/2002 | Stearns |
| 6,368,254 | B1 | 4/2002 | Wall |
| 6,371,738 | B2 | 4/2002 | Jones |
| 6,371,895 | B1 | 4/2002 | Endelman et al. |
| 6,375,580 | B1 | 4/2002 | Schmidt |
| 6,379,289 | B1 | 4/2002 | Gossie |
| 6,382,627 | B1 | 5/2002 | Lundberg |
| 6,383,120 | B1 | 5/2002 | Lo |
| 6,387,015 | B1 | 5/2002 | Watson |
| 6,387,016 | B1 | 5/2002 | Lo |
| 6,387,020 | B1 | 5/2002 | Simonson |
| 6,390,953 | B1 | 5/2002 | Maresh |
| 6,390,955 | B1 | 5/2002 | Wang |
| 6,394,239 | B1 | 5/2002 | Carlson |
| 6,397,797 | B1 | 6/2002 | Kolmanovsky et al. |
| 6,398,695 | B2 | 6/2002 | Miller |
| 6,402,666 | B2 | 6/2002 | Krull |
| 6,409,632 | B1 | 6/2002 | Eschenbach |
| 6,409,633 | B1 | 6/2002 | Abelbeck |
| 6,413,197 | B2 | 7/2002 | McKechnie et al. |
| 6,416,442 | B1 | 7/2002 | Stearns et al. |
| 6,416,444 | B1 | 7/2002 | Lim |
| 6,419,611 | B1 | 7/2002 | Levine et al. |
| 6,422,976 | B1 | 7/2002 | Eschenbach |
| 6,422,977 | B1 | 7/2002 | Eschenbach |
| 6,422,980 | B1 | 7/2002 | Simonson |
| 6,422,983 | B1 | 7/2002 | Weck |
| 6,428,449 | B1 | 8/2002 | Apseloff |
| 6,430,997 | B1 | 8/2002 | French et al. |
| 6,432,026 | B1 | 8/2002 | Wang |
| 6,435,466 | B1 | 8/2002 | Adams |
| 6,436,007 | B1 | 8/2002 | Eschenbach |
| 6,436,008 | B1 | 8/2002 | Skowronski et al. |
| 6,440,013 | B1 | 8/2002 | Brown |
| 6,440,042 | B2 | 8/2002 | Eschenbach |
| 6,443,875 | B1 | 9/2002 | Golen, Jr. et al. |
| 6,447,424 | B1 | 9/2002 | Ashby et al. |
| 6,447,430 | B1 | 9/2002 | Webb et al. |
| 6,450,284 | B1 | 9/2002 | Sakyo et al. |
| 6,450,922 | B1 | 9/2002 | Henderson et al. |
| 6,450,923 | B1 | 9/2002 | Vatti |
| 6,450,925 | B1 | 9/2002 | Kuo |
| 6,454,679 | B1 | 9/2002 | Radow |
| 6,454,682 | B1 | 9/2002 | Kuo |
| 6,455,960 | B1 | 9/2002 | Trago et al. |
| 6,458,060 | B1 | 10/2002 | Watterson et al. |
| 6,458,061 | B2 | 10/2002 | Simonson |
| 6,461,275 | B1 | 10/2002 | Wang et al. |
| 6,461,279 | B1 | 10/2002 | Kuo |
| 6,466,460 | B1 | 10/2002 | Rein et al. |
| 6,468,189 | B2 | 10/2002 | Alessandri |
| 6,471,622 | B1 | 10/2002 | Hammer et al. |
| 6,475,121 | B2 | 11/2002 | Wang |
| 6,478,721 | B1 | 11/2002 | Hunter |
| 6,482,128 | B1 | 11/2002 | Michalow |
| 6,482,132 | B2 | 11/2002 | Eschenbach |
| 6,485,397 | B1 | 11/2002 | Manderbacka |
| 6,488,020 | B1 | 12/2002 | Rosas-Magallan |
| 6,491,610 | B1 | 12/2002 | Henn |
| 6,494,814 | B1 | 12/2002 | Wang |
| 6,494,817 | B2 | 12/2002 | Lake |
| 6,500,097 | B1 | 12/2002 | Hall |
| 6,503,173 | B2 | 1/2003 | Clem |
| 6,505,503 | B1 | 1/2003 | Teresi et al. |
| 6,506,142 | B2 | 1/2003 | Itoh |
| 6,513,532 | B2 | 2/2003 | Mault et al. |
| 6,513,669 | B2 | 2/2003 | Ozawa et al. |
| 6,514,180 | B1 | 2/2003 | Rawls |
| 6,520,891 | B1 | 2/2003 | Stephens, Jr. |
| 6,527,674 | B1 | 3/2003 | Clem |
| 6,527,678 | B1 | 3/2003 | Wang |
| 6,527,685 | B2 | 3/2003 | Endelman et al. |
| 6,527,796 | B1 | 3/2003 | Magovern |
| 6,530,864 | B1 | 3/2003 | Parks |
| 6,533,707 | B2 | 3/2003 | Wang |
| 6,537,184 | B2 | 3/2003 | Kim |
| 6,539,931 | B2 | 4/2003 | Trajkovic et al. |
| 6,543,247 | B2 | 4/2003 | Strauss |
| 6,544,146 | B1 | 4/2003 | Stearns et al. |
| 6,547,698 | B2 | 4/2003 | Inagawa |
| 6,547,701 | B1 | 4/2003 | Eschenbach |
| 6,547,702 | B1 | 4/2003 | Heidecke |
| 6,551,218 | B2 | 4/2003 | Goh |
| 6,551,223 | B2 | 4/2003 | Cheng |
| 6,554,749 | B2 | 4/2003 | lund et al. |
| 6,558,299 | B1 | 5/2003 | Slattery |
| 6,558,301 | B1 | 5/2003 | Jackson |
| 6,561,960 | B2 | 5/2003 | Webber |
| 6,563,489 | B1 | 5/2003 | Latypov et al. |
| 6,569,061 | B2 | 5/2003 | Stearns et al. |
| 6,569,062 | B2 | 5/2003 | Wang |
| 6,572,511 | B1 | 6/2003 | Volpe |
| 6,572,512 | B2 | 6/2003 | Anderson et al. |
| 6,572,513 | B1 | 6/2003 | Whan-Tong et al. |
| 6,575,878 | B1 | 6/2003 | Choy |
| 6,579,210 | B1 | 6/2003 | Stearns et al. |
| 6,579,211 | B2 | 6/2003 | Wu |
| 6,582,342 | B2 | 6/2003 | Kaufman |
| 6,582,344 | B2 | 6/2003 | Tang |
| 6,585,624 | B1 | 7/2003 | Chen |
| 6,585,626 | B2 | 7/2003 | McBride |
| 6,589,138 | B2 | 7/2003 | Dyer et al. |
| 6,592,502 | B1 | 7/2003 | Phillips |
| 6,599,223 | B2 | 7/2003 | Wang |
| 6,601,016 | B1 | 7/2003 | Brown et al. |
| 6,601,358 | B2 | 8/2003 | Panatta |
| 6,601,825 | B2 | 8/2003 | Bressner et al. |
| 6,604,008 | B2 | 8/2003 | Chudley et al. |
| 6,605,020 | B1 | 8/2003 | Huang |
| 6,609,478 | B2 | 8/2003 | Del Valle |
| 6,610,063 | B2 | 8/2003 | Kumar et al. |
| 6,612,969 | B2 | 9/2003 | Eschenbach |
| 6,612,971 | B1 | 9/2003 | Morris |
| 6,619,681 | B2 | 9/2003 | Gutierrez |
| 6,620,079 | B2 | 9/2003 | Kuo |
| 6,623,407 | B2 | 9/2003 | Novak |
| 6,623,409 | B1 | 9/2003 | Abelbeck |
| 6,626,799 | B2 | 9/2003 | Watterson et al. |
| 6,626,802 | B1 | 9/2003 | Rodgers, Jr. |
| 6,626,803 | B1 | 9/2003 | Oglesby et al. |
| 6,629,902 | B2 | 10/2003 | Murphy et al. |
| 6,629,909 | B1 | 10/2003 | Stearns et al. |
| 6,629,910 | B1 | 10/2003 | Krull |
| 6,632,161 | B1 | 10/2003 | Nir |
| 6,634,996 | B2 | 10/2003 | Jacobsen |
| 6,637,811 | B2 | 10/2003 | Zheng |
| 6,637,818 | B2 | 10/2003 | Williams |
| 6,645,125 | B1 | 11/2003 | Stearns et al. |
| 6,645,126 | B1 | 11/2003 | Martin et al. |
| 6,645,130 | B2 | 11/2003 | Webber |
| 6,648,800 | B2 | 11/2003 | Stearns et al. |
| 6,648,801 | B2 | 11/2003 | Stearns et al. |
| 6,648,802 | B2 | 11/2003 | Ware |
| 6,652,424 | B2 | 11/2003 | Dalebout |
| 6,652,425 | B1 | 11/2003 | Martin et al. |
| 6,652,429 | B2 | 11/2003 | Bushnell |
| 6,660,949 | B2 | 12/2003 | Kamino et al. |
| 6,661,136 | B1 | 12/2003 | Lee |
| 6,663,127 | B2 | 12/2003 | Miller |
| 6,663,498 | B2 | 12/2003 | Stipan |

(56) References Cited

U.S. PATENT DOCUMENTS

| | | | |
|---|---|---|---|
| 6,663,500 | B2 | 12/2003 | Huang |
| 6,666,800 | B2 | 12/2003 | Krull |
| 6,666,801 | B1 | 12/2003 | Michalow |
| 6,668,678 | B1 | 12/2003 | Baba et al. |
| 6,669,600 | B2 | 12/2003 | Warner |
| 6,669,609 | B2 | 12/2003 | Gerschefske et al. |
| 6,671,975 | B2 | 1/2004 | Hennessey |
| 6,672,991 | B2 | 1/2004 | O'Malley |
| 6,672,992 | B1 | 1/2004 | Lo et al. |
| 6,672,994 | B1 | 1/2004 | Stearns et al. |
| 6,676,530 | B2 | 1/2004 | Lochtefeld |
| 6,676,572 | B2 | 1/2004 | Wang |
| 6,676,579 | B1 | 1/2004 | Lin |
| 6,679,816 | B1 | 1/2004 | Krull |
| 6,679,820 | B2 | 1/2004 | Barkus et al. |
| 6,681,704 | B1 | 1/2004 | Brookhiser |
| 6,681,728 | B2 | 1/2004 | Haghgooie |
| 6,682,460 | B2 | 1/2004 | Lo |
| 6,682,461 | B2 | 1/2004 | Wang |
| 6,685,169 | B2 | 2/2004 | Shim |
| 6,685,601 | B1 | 2/2004 | Knapp |
| 6,685,602 | B2 | 2/2004 | Colosky, Jr. et al. |
| 6,685,607 | B1 | 2/2004 | Olson |
| 6,689,019 | B2 | 2/2004 | Ohrt et al. |
| 6,689,020 | B2 | 2/2004 | Stearns |
| 6,689,075 | B2 | 2/2004 | West |
| 6,695,694 | B2 | 2/2004 | Ishikawa et al. |
| 6,698,110 | B1 | 3/2004 | Robbins |
| 6,699,159 | B2 | 3/2004 | Rouse |
| 6,699,162 | B2 | 3/2004 | Chen |
| 6,702,719 | B1 | 3/2004 | Brown et al. |
| 6,705,977 | B1 | 3/2004 | Ziak |
| 6,708,427 | B2 | 3/2004 | Sussmann et al. |
| 6,712,737 | B1 | 3/2004 | Nusbaum |
| 6,712,740 | B2 | 3/2004 | Simonson |
| 6,716,142 | B2 | 4/2004 | Kuo |
| 6,716,144 | B1 | 4/2004 | Shifferaw |
| 6,719,667 | B2 | 4/2004 | Wong et al. |
| 6,719,669 | B1 | 4/2004 | Wang |
| 6,723,413 | B2 | 4/2004 | Walters |
| 6,726,600 | B2 | 4/2004 | Miller |
| 6,726,601 | B1 | 4/2004 | Beutel |
| 6,726,602 | B2 | 4/2004 | Chang |
| 6,730,002 | B2 | 5/2004 | Hald et al. |
| 6,733,423 | B1 | 5/2004 | Chang |
| 6,733,424 | B2 | 5/2004 | Krull |
| 6,736,360 | B1 | 5/2004 | Buczek |
| 6,738,274 | B2 | 5/2004 | Prasad et al. |
| 6,740,009 | B1 | 5/2004 | Hall |
| 6,741,052 | B2 | 5/2004 | Fitzgibbon |
| 6,743,153 | B2 | 6/2004 | Watterson et al. |
| 6,746,371 | B1 | 6/2004 | Brown et al. |
| 6,747,427 | B1 | 6/2004 | Carson |
| 6,749,542 | B2 | 6/2004 | Wu |
| 6,758,790 | B1 | 7/2004 | Ellis |
| 6,758,791 | B1 | 7/2004 | Kuo |
| 6,758,792 | B1 | 7/2004 | Chang |
| 6,761,387 | B2 | 7/2004 | Sloss |
| 6,761,667 | B1 | 7/2004 | Cutler et al. |
| 6,764,429 | B1 | 7/2004 | Michalow |
| 6,764,430 | B1 | 7/2004 | Fencel |
| 6,764,431 | B2 | 7/2004 | Yoss |
| 6,765,726 | B2 | 7/2004 | French et al. |
| 6,767,314 | B2 | 7/2004 | Thompson |
| 6,770,015 | B2 | 8/2004 | Simonson |
| 6,776,740 | B1 | 8/2004 | Anderson et al. |
| 6,778,938 | B1 | 8/2004 | Ng et al. |
| 6,783,134 | B2 | 8/2004 | Geary |
| 6,783,482 | B2 | 8/2004 | Oglesby et al. |
| 6,786,821 | B2 | 9/2004 | Nobe et al. |
| 6,786,848 | B2 | 9/2004 | Yamashita et al. |
| 6,786,852 | B2 | 9/2004 | Watterson et al. |
| 6,790,162 | B1 | 9/2004 | Ellis et al. |
| 6,793,609 | B1 | 9/2004 | Fan |
| 6,796,159 | B2 | 9/2004 | Kelm et al. |
| 6,796,925 | B2 | 9/2004 | Martinez |
| 6,796,927 | B2 | 9/2004 | Toyama |
| 6,800,050 | B2 | 10/2004 | Moavro |
| 6,807,869 | B2 | 10/2004 | Farringdon et al. |
| 6,808,458 | B1 | 10/2004 | Jung |
| 6,808,475 | B2 | 10/2004 | Kehrbaum |
| 6,811,519 | B2 | 11/2004 | Kuo |
| 6,811,520 | B2 | 11/2004 | Wu |
| 6,817,117 | B1 | 11/2004 | Campbell |
| 6,817,968 | B2 | 11/2004 | Galbraith et al. |
| 6,821,230 | B2 | 11/2004 | Dalebout et al. |
| 6,824,210 | B2 | 11/2004 | Zheng |
| 6,824,502 | B1 | 11/2004 | Huang |
| 6,830,540 | B2 | 12/2004 | Watterson |
| 6,830,541 | B2 | 12/2004 | Wu |
| 6,835,166 | B1 | 12/2004 | Stearns et al. |
| 6,837,829 | B2 | 1/2005 | Eschenbach |
| 6,837,830 | B2 | 1/2005 | Eldridge |
| 6,837,838 | B2 | 1/2005 | List |
| 6,840,892 | B1 | 1/2005 | Wu |
| 6,842,928 | B2 | 1/2005 | Yang et al. |
| 6,843,732 | B1 | 1/2005 | Huang |
| 6,843,757 | B2 | 1/2005 | Pan et al. |
| 6,846,272 | B2 | 1/2005 | Rosenow et al. |
| 6,849,032 | B2 | 2/2005 | Chu |
| 6,852,068 | B2 | 2/2005 | Ogawa |
| 6,852,069 | B2 | 2/2005 | Park |
| 6,855,093 | B2 | 2/2005 | Anderson et al. |
| 6,855,097 | B2 | 2/2005 | Krull |
| 6,857,993 | B2 | 2/2005 | Yeh |
| 6,860,836 | B1 | 3/2005 | Wu |
| 6,860,839 | B1 | 3/2005 | Dice |
| 6,866,141 | B2 | 3/2005 | Saeki |
| 6,872,168 | B2 | 3/2005 | Wang et al. |
| 6,872,175 | B2 | 3/2005 | Lin |
| 6,875,157 | B1 | 4/2005 | Wang |
| 6,875,160 | B2 | 4/2005 | Watterson et al. |
| 6,878,099 | B2 | 4/2005 | Corbalis et al. |
| 6,878,101 | B2 | 4/2005 | Colley |
| 6,880,416 | B2 | 4/2005 | Koch |
| 6,880,487 | B2 | 4/2005 | Reinkensmeyer et al. |
| 6,881,176 | B2 | 4/2005 | Oishi et al. |
| 6,887,185 | B1 | 5/2005 | Kuo |
| 6,887,190 | B1 | 5/2005 | Azari |
| 6,893,383 | B1 | 5/2005 | Chang et al. |
| 6,896,645 | B1 | 5/2005 | Krull |
| 6,899,657 | B2 | 5/2005 | Chuang |
| 6,899,659 | B2 | 5/2005 | Anderson et al. |
| 6,902,513 | B1 | 6/2005 | Mcclure |
| 6,902,515 | B2 | 6/2005 | Howell et al. |
| 6,905,446 | B2 | 6/2005 | Greenland |
| 6,908,416 | B2 | 6/2005 | Mercado et al. |
| 6,908,417 | B2 | 6/2005 | Jackson |
| 6,910,991 | B2 | 6/2005 | Matsumoto |
| 6,913,562 | B2 | 7/2005 | Chen |
| 6,913,563 | B2 | 7/2005 | Chen |
| 6,916,278 | B2 | 7/2005 | Webber |
| 6,918,858 | B2 | 7/2005 | Watterson et al. |
| 6,918,859 | B1 | 7/2005 | Yeh |
| 6,918,860 | B1 | 7/2005 | Nusbaum |
| 6,920,947 | B2 | 7/2005 | Kamen et al. |
| 6,921,354 | B1 | 7/2005 | Shifferaw |
| 6,921,355 | B2 | 7/2005 | Campanaro et al. |
| 6,923,746 | B1 | 8/2005 | Skowronski et al. |
| 6,923,747 | B1 | 8/2005 | Chu |
| 6,926,644 | B2 | 8/2005 | Chen |
| 6,926,646 | B1 | 8/2005 | Nguyen |
| 6,932,745 | B1 | 8/2005 | Ellis |
| 6,944,294 | B2 | 9/2005 | Tsay |
| 6,945,912 | B2 | 9/2005 | Levi |
| 6,945,917 | B1 | 9/2005 | Baatz |
| 6,949,053 | B1 | 9/2005 | Stearns |
| 6,949,054 | B1 | 9/2005 | Stearns |
| 6,953,418 | B1 | 10/2005 | Chen |
| 6,953,424 | B2 | 10/2005 | Kusumoto et al. |
| 6,964,632 | B1 | 11/2005 | Ko |
| 6,966,872 | B2 | 11/2005 | Eschenbach |
| 6,974,404 | B1 | 12/2005 | Watterson et al. |
| 6,976,698 | B2 | 12/2005 | Kuiken |

(56) References Cited

U.S. PATENT DOCUMENTS

| | | | |
|---|---|---|---|
| 6,979,283 | B2 | 12/2005 | Pan |
| 6,991,588 | B1 | 1/2006 | Adams |
| 6,993,270 | B2 | 1/2006 | Yoshioka et al. |
| 6,994,306 | B1 | 2/2006 | Sweere et al. |
| 6,994,657 | B1 | 2/2006 | Eschenbach |
| 6,997,852 | B2 | 2/2006 | Watterson et al. |
| 6,997,856 | B1 | 2/2006 | Krull |
| 7,001,288 | B2 | 2/2006 | Harrell |
| 7,003,122 | B2 | 2/2006 | Chen |
| 7,003,828 | B2 | 2/2006 | Roussy |
| 7,004,271 | B1 | 2/2006 | Kamen et al. |
| 7,004,887 | B2 | 2/2006 | Pan et al. |
| 7,004,888 | B1 | 2/2006 | Weng |
| 7,004,895 | B2 | 2/2006 | Perry |
| 7,008,352 | B2 | 3/2006 | Grossi |
| 7,008,359 | B2 | 3/2006 | Fan et al. |
| 7,009,613 | B2 | 3/2006 | Goden |
| 7,011,326 | B1 | 3/2006 | Schroeder et al. |
| 7,011,607 | B2 | 3/2006 | Kolda et al. |
| 7,011,609 | B1 | 3/2006 | Kuo |
| 7,014,599 | B2 | 3/2006 | Ashley |
| 7,022,047 | B2 | 4/2006 | Cohen et al. |
| 7,022,048 | B1 | 4/2006 | Fernandez |
| 7,022,049 | B2 | 4/2006 | Ryan et al. |
| 7,022,051 | B2 | 4/2006 | Ota |
| 7,025,713 | B2 | 4/2006 | Dalebout |
| 7,032,870 | B2 | 4/2006 | Sweere et al. |
| 7,033,176 | B2 | 4/2006 | Feldman |
| 7,033,269 | B2 | 4/2006 | Namba et al. |
| 7,033,306 | B2 | 4/2006 | Graber |
| 7,037,241 | B2 | 5/2006 | Kuo |
| 7,039,263 | B2 | 5/2006 | Towle |
| 7,041,034 | B1 | 5/2006 | Stearns et al. |
| 7,041,038 | B2 | 5/2006 | Smith |
| 7,041,041 | B1 | 5/2006 | Evans |
| 7,044,891 | B1 | 5/2006 | Rivera |
| 7,044,897 | B2 | 5/2006 | Myers et al. |
| 7,047,817 | B2 | 5/2006 | Lanham |
| 7,052,426 | B2 | 5/2006 | Battat et al. |
| 7,052,440 | B2 | 5/2006 | Pyles et al. |
| 7,052,442 | B2 | 5/2006 | Watterson |
| 7,052,444 | B2 | 5/2006 | Webber |
| 7,052,446 | B2 | 5/2006 | Morris et al. |
| 7,055,899 | B2 | 6/2006 | Zhurong et al. |
| 7,060,005 | B2 | 6/2006 | Carlsen et al. |
| 7,060,006 | B1 | 6/2006 | Watterson et al. |
| 7,060,007 | B2 | 6/2006 | Juva |
| 7,060,008 | B2 | 6/2006 | Watterson et al. |
| 7,060,012 | B2 | 6/2006 | Howell et al. |
| 7,070,415 | B2 | 7/2006 | Hojo et al. |
| 7,070,545 | B2 | 7/2006 | Lull et al. |
| 7,073,852 | B1 | 7/2006 | Zheng |
| 7,077,788 | B2 | 7/2006 | Chang |
| 7,077,791 | B2 | 7/2006 | Krull |
| 7,081,069 | B2 | 7/2006 | Hsu |
| 7,081,073 | B1 | 7/2006 | Smith |
| 7,082,703 | B2 | 8/2006 | Greene et al. |
| 7,083,546 | B2 | 8/2006 | Zillig |
| 7,083,582 | B2 | 8/2006 | Chen |
| 7,086,994 | B2 | 8/2006 | Turak et al. |
| 7,086,995 | B2 | 8/2006 | Reyes |
| 7,090,621 | B2 | 8/2006 | Loane |
| 7,090,622 | B2 | 8/2006 | Hetrick |
| 7,097,591 | B2 | 8/2006 | Moon |
| 7,097,593 | B2 | 8/2006 | Chang |
| 7,100,517 | B1 | 9/2006 | Godwin |
| 7,101,319 | B1 | 9/2006 | Potts |
| 7,101,322 | B2 | 9/2006 | Carle |
| 7,101,330 | B2 | 9/2006 | Elbaz et al. |
| 7,104,926 | B2 | 9/2006 | Carlson |
| 7,104,930 | B2 | 9/2006 | Lo et al. |
| 7,104,937 | B2 | 9/2006 | Arbuckle |
| 7,108,641 | B2 | 9/2006 | Pertegaz-Esteban |
| 7,108,659 | B2 | 9/2006 | Ross et al. |
| 7,112,161 | B2 | 9/2006 | Maresh et al. |
| 7,115,073 | B2 | 10/2006 | Nizamuddin |
| 7,125,369 | B2 | 10/2006 | Endelman |
| 7,125,371 | B2 | 10/2006 | Henderson |
| 7,132,939 | B2 | 11/2006 | Tyndall et al. |
| 7,140,487 | B2 | 11/2006 | Motoda |
| 7,140,626 | B1 | 11/2006 | Keay |
| 7,141,005 | B2 | 11/2006 | Wu |
| 7,141,008 | B2 | 11/2006 | Krull et al. |
| 7,147,591 | B2 | 12/2006 | McAvoy |
| 7,153,240 | B1 * | 12/2006 | Wu ..... A63B 22/0235 482/54 |
| 7,156,776 | B2 | 1/2007 | Maser |
| 7,163,488 | B2 | 1/2007 | Anders |
| 7,163,493 | B1 | 1/2007 | Kuo |
| 7,163,498 | B1 | 1/2007 | Abelbeck |
| 7,163,500 | B2 | 1/2007 | Endelman et al. |
| 7,166,062 | B1 | 1/2007 | Watterson et al. |
| 7,166,064 | B2 | 1/2007 | Watterson et al. |
| 7,166,067 | B2 | 1/2007 | Talish et al. |
| 7,168,668 | B2 | 1/2007 | Coyle |
| 7,169,087 | B2 | 1/2007 | Ercanbrack et al. |
| 7,169,088 | B2 | 1/2007 | Rodgers, Jr. |
| 7,169,093 | B2 | 1/2007 | Simonson et al. |
| 7,172,531 | B2 | 2/2007 | Rodgers, Jr. |
| 7,172,536 | B2 | 2/2007 | Liu |
| 7,175,193 | B2 | 2/2007 | Wu |
| 7,179,204 | B2 | 2/2007 | Anderson et al. |
| 7,179,207 | B2 | 2/2007 | Gerschefske |
| 7,179,208 | B1 | 2/2007 | Nalley |
| 7,179,209 | B2 | 2/2007 | Sechrest et al. |
| 7,186,189 | B2 | 3/2007 | Huang |
| 7,188,439 | B2 | 3/2007 | DiBenedetto et al. |
| 7,189,190 | B2 | 3/2007 | Lamar et al. |
| 7,192,387 | B2 | 3/2007 | Mendel |
| 7,192,388 | B2 | 3/2007 | Dalebout et al. |
| 7,195,568 | B2 | 3/2007 | Huang |
| 7,196,491 | B2 | 3/2007 | Mayhew et al. |
| 7,201,705 | B2 | 4/2007 | Rodgers, Jr. |
| 7,201,707 | B1 | 4/2007 | Moon |
| 7,204,328 | B2 | 4/2007 | LoPresti |
| 7,211,029 | B2 | 5/2007 | Kau |
| 7,214,167 | B2 | 5/2007 | Stearns |
| 7,217,224 | B2 | 5/2007 | Thomas |
| 7,217,225 | B2 | 5/2007 | Husted et al. |
| 7,220,219 | B2 | 5/2007 | Papadopoulos et al. |
| 7,220,221 | B2 | 5/2007 | Mosimann et al. |
| 7,223,209 | B2 | 5/2007 | Lee |
| 7,223,213 | B2 | 5/2007 | Golesh |
| 7,223,216 | B1 | 5/2007 | McBride |
| 7,225,694 | B2 | 6/2007 | Said |
| 7,226,402 | B1 | 6/2007 | Joya |
| 7,234,200 | B2 | 6/2007 | Chase |
| 7,235,942 | B2 | 6/2007 | Nagaoka et al. |
| 7,238,147 | B2 | 7/2007 | Mills et al. |
| 7,247,128 | B2 | 7/2007 | Oga |
| 7,250,022 | B2 | 7/2007 | Dalebout |
| 7,257,468 | B1 | 8/2007 | Costa et al. |
| 7,258,039 | B2 | 8/2007 | Lin |
| 7,258,651 | B2 | 8/2007 | Clarke |
| 7,260,950 | B2 | 8/2007 | Choi et al. |
| 7,264,554 | B2 | 9/2007 | Bentley |
| 7,269,038 | B2 | 9/2007 | Shekhawat |
| 7,278,934 | B2 | 10/2007 | McBride et al. |
| 7,278,966 | B2 | 10/2007 | Hjelt et al. |
| 7,279,868 | B2 | 10/2007 | Lanni |
| 7,282,016 | B2 | 10/2007 | Simonson |
| 7,285,075 | B2 | 10/2007 | Cutler et al. |
| 7,287,770 | B2 | 10/2007 | Drabant et al. |
| 7,290,760 | B1 | 11/2007 | Lindsay |
| 7,291,096 | B2 | 11/2007 | Ho |
| 7,291,100 | B2 | 11/2007 | Dodge |
| 7,292,151 | B2 | 11/2007 | Ferguson |
| 7,293,510 | B1 | 11/2007 | Siao |
| 7,294,094 | B1 | 11/2007 | Howle |
| 7,294,100 | B2 | 11/2007 | Bull |
| 7,303,508 | B2 | 12/2007 | Toyama et al. |
| 7,303,510 | B2 | 12/2007 | Gebhardt |
| 7,311,640 | B2 | 12/2007 | Baatz |
| 7,316,633 | B2 | 1/2008 | Liao et al. |

(56) References Cited

U.S. PATENT DOCUMENTS

| | | | |
|---|---|---|---|
| 7,319,457 | B2 | 1/2008 | Lin et al. |
| 7,322,653 | B2 | 1/2008 | Dragusin |
| 7,322,907 | B2 | 1/2008 | Bowser |
| 7,329,212 | B2 | 2/2008 | Roque |
| 7,331,227 | B2 | 2/2008 | Kang et al. |
| 7,334,350 | B2 | 2/2008 | Ellis, III |
| 7,335,135 | B2 | 2/2008 | Wang |
| 7,335,139 | B2 | 2/2008 | Bartholomew et al. |
| 7,335,140 | B2 | 2/2008 | Webber et al. |
| 7,335,147 | B2 | 2/2008 | Jones |
| 7,344,481 | B2 | 3/2008 | Watterson et al. |
| 7,346,935 | B1 | 3/2008 | Patterson |
| 7,347,806 | B2 | 3/2008 | Nakano et al. |
| 7,351,187 | B2 | 4/2008 | Seliber |
| 7,352,365 | B2 | 4/2008 | Trachte |
| 7,354,380 | B2 | 4/2008 | Volpe, Jr. |
| 7,357,756 | B2 | 4/2008 | Demas |
| 7,357,758 | B2 | 4/2008 | Polk, III |
| 7,359,121 | B2 | 4/2008 | French et al. |
| 7,361,122 | B2 | 4/2008 | Porth |
| 7,361,125 | B2 | 4/2008 | Webber et al. |
| 7,362,016 | B2 | 4/2008 | Cheng |
| 7,364,538 | B2 | 4/2008 | Aucamp |
| 7,366,921 | B2 | 4/2008 | Ranganathan |
| 7,367,926 | B2 | 5/2008 | Clark |
| 7,367,957 | B2 | 5/2008 | Huang et al. |
| 7,369,121 | B2 | 5/2008 | Lane |
| 7,374,522 | B2 | 5/2008 | Arnold |
| 7,377,881 | B2 | 5/2008 | Moon |
| 7,377,882 | B2 | 5/2008 | Watterson |
| 7,381,161 | B2 | 6/2008 | Ellis |
| 7,384,013 | B2 | 6/2008 | Yen |
| 7,393,308 | B1 | 7/2008 | Huang |
| 7,402,145 | B1 | 7/2008 | Woggon |
| 7,404,232 | B2 | 7/2008 | Chase |
| 7,410,449 | B2 | 8/2008 | Yeh |
| 7,413,532 | B1 | 8/2008 | Monsrud et al. |
| 7,425,189 | B1 | 9/2008 | Eschenbach |
| 7,428,760 | B2 | 9/2008 | McCrimmon |
| 7,429,236 | B2 | 9/2008 | Dalebout et al. |
| 7,432,677 | B2 | 10/2008 | Heydt et al. |
| 7,435,202 | B2 | 10/2008 | Daly et al. |
| 7,435,203 | B2 | 10/2008 | Anderson et al. |
| 7,435,205 | B2 | 10/2008 | Reyes et al. |
| 7,452,311 | B2 | 11/2008 | Barnes |
| 7,455,621 | B1 | 11/2008 | Anthony |
| 7,455,626 | B2 | 11/2008 | Trevino et al. |
| 7,455,628 | B1 | 11/2008 | Stearns |
| 7,461,825 | B2 | 12/2008 | Olivera |
| 7,462,135 | B2 | 12/2008 | Lo |
| 7,470,219 | B2 | 12/2008 | Larson |
| 7,470,234 | B1 | 12/2008 | Elhag et al. |
| 7,473,211 | B2 | 1/2009 | Lee |
| 7,475,613 | B2 | 1/2009 | Bailey |
| 7,482,050 | B2 | 1/2009 | Olson |
| 7,485,076 | B2 | 2/2009 | Lee |
| 7,488,277 | B1 | 2/2009 | Knapp |
| 7,491,154 | B2 | 2/2009 | Yonehana et al. |
| 7,494,450 | B2 | 2/2009 | Solomon |
| 7,494,454 | B2 | 2/2009 | Sheets |
| 7,497,784 | B2 | 3/2009 | Henry |
| 7,497,806 | B2 | 3/2009 | Duncan et al. |
| 7,507,183 | B2 | 3/2009 | Anderson |
| 7,507,187 | B2 | 3/2009 | Dyer et al. |
| 7,507,189 | B2 | 3/2009 | Krull |
| 7,510,508 | B2 | 3/2009 | Santomassimo et al. |
| 7,510,511 | B2 | 3/2009 | Von Detten |
| 7,511,710 | B2 | 3/2009 | Barrett |
| 7,517,303 | B2 | 4/2009 | Crawford et al. |
| 7,520,840 | B2 | 4/2009 | Shifferaw |
| 7,524,272 | B2 | 4/2009 | Bruck et al. |
| 7,525,293 | B1 | 4/2009 | Notohamiprodjo et al. |
| 7,537,546 | B2 | 5/2009 | Watterson et al. |
| 7,537,549 | B2 | 5/2009 | Nelson et al. |
| 7,537,550 | B1 | 5/2009 | Krull |
| 7,537,552 | B2 | 5/2009 | Dalebout et al. |
| 7,540,828 | B2 | 6/2009 | Watterson et al. |
| 7,540,829 | B1 | 6/2009 | Lin |
| 7,542,040 | B2 | 6/2009 | Templeman |
| 7,544,153 | B2 | 6/2009 | Trevino et al. |
| 7,547,255 | B2 | 6/2009 | Lochtefeld et al. |
| 7,549,938 | B2 | 6/2009 | Leighton et al. |
| 7,549,947 | B2 | 6/2009 | Hickman et al. |
| 7,553,260 | B2 | 6/2009 | Piaget et al. |
| 7,553,262 | B2 | 6/2009 | Piane, Jr. |
| 7,556,590 | B2 | 7/2009 | Watterson et al. |
| 7,556,591 | B2 | 7/2009 | Chuang |
| 7,559,879 | B2 | 7/2009 | Anderson et al. |
| 7,563,203 | B2 | 7/2009 | Dalebout et al. |
| 7,563,205 | B2 | 7/2009 | Alling |
| 7,563,235 | B2 | 7/2009 | Der Meer |
| 7,569,000 | B2 | 8/2009 | Wang |
| 7,569,004 | B2 | 8/2009 | Kolomeir |
| 7,572,206 | B2 | 8/2009 | Wilkins et al. |
| 7,575,537 | B2 | 8/2009 | Ellis |
| 7,578,771 | B1 | 8/2009 | Towley, III et al. |
| 7,585,251 | B2 | 9/2009 | Doody, Jr. et al. |
| 7,585,254 | B1 | 9/2009 | Vittone |
| 7,585,258 | B2 | 9/2009 | Watson et al. |
| 7,588,520 | B2 | 9/2009 | Nalley |
| 7,591,770 | B2 | 9/2009 | Stewart et al. |
| 7,591,795 | B2 | 9/2009 | Whalen et al. |
| 7,594,873 | B2 | 9/2009 | Terao et al. |
| 7,594,877 | B2 | 9/2009 | Anderson et al. |
| 7,594,878 | B1 | 9/2009 | Joannou |
| 7,594,880 | B2 | 9/2009 | Webber |
| 7,601,101 | B2 | 10/2009 | Jackson et al. |
| 7,601,105 | B1 | 10/2009 | Gipson, III et al. |
| 7,602,301 | B1 | 10/2009 | Stirling et al. |
| 7,604,571 | B2 | 10/2009 | Wilkins et al. |
| 7,604,572 | B2 | 10/2009 | Stanford |
| 7,604,573 | B2 | 10/2009 | Dalebout et al. |
| 7,608,015 | B2 | 10/2009 | Radow |
| 7,608,021 | B1 | 10/2009 | Nalley |
| 7,608,023 | B2 | 10/2009 | Casagrande |
| 7,608,028 | B2 | 10/2009 | Pertegaz-Esteban |
| 7,614,639 | B2 | 11/2009 | Tholkes et al. |
| 7,614,981 | B2 | 11/2009 | Cao |
| 7,614,991 | B2 | 11/2009 | Fox |
| 7,618,345 | B2 | 11/2009 | Corbalis et al. |
| 7,618,346 | B2 | 11/2009 | Crawford et al. |
| 7,618,350 | B2 | 11/2009 | Dalebout et al. |
| 7,621,850 | B2 | 11/2009 | Piaget et al. |
| 7,621,855 | B1 | 11/2009 | Krull |
| 7,625,314 | B2 | 12/2009 | Ungari |
| 7,625,315 | B2 | 12/2009 | Hickman |
| 7,625,319 | B2 | 12/2009 | Kang et al. |
| 7,625,321 | B2 | 12/2009 | Simonson et al. |
| 7,628,730 | B1 | 12/2009 | Watterson et al. |
| 7,628,732 | B1 | 12/2009 | Porszasz et al. |
| 7,628,733 | B2 | 12/2009 | Donner |
| 7,628,737 | B2 | 12/2009 | Kowallis et al. |
| 7,630,201 | B2 | 12/2009 | Asahi |
| 7,637,847 | B1 | 12/2009 | Hickman |
| 7,637,850 | B2 | 12/2009 | Lin |
| 7,639,520 | B1 | 12/2009 | Zansky et al. |
| 7,645,212 | B2 | 1/2010 | Ashby et al. |
| 7,645,214 | B2 | 1/2010 | Lull |
| 7,645,215 | B2 | 1/2010 | Gordon |
| 7,645,218 | B2 | 1/2010 | Potok et al. |
| 7,647,196 | B2 | 1/2010 | Kahn et al. |
| 7,648,441 | B2 | 1/2010 | Silk |
| 7,648,443 | B2 | 1/2010 | Schenk |
| 7,648,446 | B2 | 1/2010 | Chiles et al. |
| 7,650,987 | B2 | 1/2010 | Taniguchi et al. |
| 7,651,442 | B2 | 1/2010 | Carlson |
| 7,651,450 | B2 | 1/2010 | Wehrell |
| 7,654,229 | B2 | 2/2010 | Smith |
| 7,654,938 | B2 | 2/2010 | Webber et al. |
| 7,658,694 | B2 | 2/2010 | Ungari |
| 7,658,695 | B1 | 2/2010 | Amsbury et al. |
| 7,658,698 | B2 | 2/2010 | Pacheco et al. |
| 7,665,794 | B2 | 2/2010 | Kachouh |
| 7,670,263 | B2 | 3/2010 | Ellis |

(56) References Cited

U.S. PATENT DOCUMENTS

| | | | |
|---|---|---|---|
| 7,674,205 | B2 | 3/2010 | Dalebout et al. |
| 7,674,206 | B2 | 3/2010 | Jones |
| 7,677,518 | B2 | 3/2010 | Chouinard et al. |
| 7,682,286 | B2 | 3/2010 | Badarneh et al. |
| 7,682,287 | B1 | 3/2010 | Hsieh |
| 7,682,290 | B2 | 3/2010 | Liao et al. |
| 7,682,291 | B2 | 3/2010 | Gill et al. |
| 7,686,742 | B2 | 3/2010 | Tischler |
| 7,690,317 | B2 | 4/2010 | Beck et al. |
| 7,690,556 | B1 | 4/2010 | Kahn et al. |
| 7,691,031 | B2 | 4/2010 | Toyama et al. |
| 7,691,069 | B2 | 4/2010 | Adams |
| 7,695,406 | B2 | 4/2010 | Waters |
| 7,695,409 | B2 | 4/2010 | Helie et al. |
| 7,704,191 | B2 | 4/2010 | Smith et al. |
| 7,704,192 | B2 | 4/2010 | Dyer et al. |
| 7,704,199 | B2 | 4/2010 | Koch |
| 7,706,547 | B2 | 4/2010 | Luo |
| 7,708,668 | B2 | 5/2010 | Rodgers, Jr. |
| 7,708,670 | B2 | 5/2010 | Bowser |
| 7,708,672 | B2 | 5/2010 | Gibson et al. |
| 7,713,172 | B2 | 5/2010 | Watterson et al. |
| 7,713,177 | B2 | 5/2010 | Lo |
| 7,717,826 | B2 | 5/2010 | Cox et al. |
| 7,717,827 | B2 | 5/2010 | Kurunmäki et al. |
| 7,717,828 | B2 | 5/2010 | Simonson et al. |
| 7,717,829 | B2 | 5/2010 | Wang |
| 7,717,830 | B1 | 5/2010 | Charniga et al. |
| 7,722,503 | B1 | 5/2010 | Smith et al. |
| 7,722,507 | B2 | 5/2010 | Yoo |
| 7,722,509 | B2 | 5/2010 | Eder |
| 7,731,634 | B2 | 6/2010 | Stewart et al. |
| 7,731,635 | B2 | 6/2010 | Dyer |
| 7,736,272 | B2 | 6/2010 | Martens |
| 7,736,273 | B2 | 6/2010 | Cox et al. |
| 7,736,279 | B2 | 6/2010 | Dalebout et al. |
| 7,736,280 | B2 | 6/2010 | Weier et al. |
| 7,736,281 | B2 | 6/2010 | Corbalis et al. |
| 7,740,562 | B2 | 6/2010 | Jones |
| 7,740,563 | B2 | 6/2010 | Dalebout et al. |
| 7,741,975 | B2 | 6/2010 | Shum et al. |
| 7,745,716 | B1 | 6/2010 | Murphy |
| 7,749,137 | B2 | 7/2010 | Watt et al. |
| 7,749,138 | B2 | 7/2010 | Wang |
| 7,753,824 | B2 | 7/2010 | Wang |
| 7,753,830 | B1 | 7/2010 | Marsh et al. |
| 7,753,861 | B1 | 7/2010 | Kahn et al. |
| 7,757,346 | B2 | 7/2010 | Chase |
| 7,758,469 | B2 | 7/2010 | Dyer et al. |
| 7,758,470 | B2 | 7/2010 | Hirata et al. |
| 7,758,478 | B2 | 7/2010 | Golesh et al. |
| 7,761,212 | B2 | 7/2010 | Takebayashi |
| 7,762,935 | B2 | 7/2010 | Doble |
| 7,762,952 | B2 | 7/2010 | Lee et al. |
| 7,764,990 | B2 | 7/2010 | Martikka et al. |
| 7,766,797 | B2 | 8/2010 | Dalebout |
| 7,771,319 | B1 | 8/2010 | Lannon |
| 7,771,320 | B2 | 8/2010 | Riley et al. |
| 7,771,329 | B2 | 8/2010 | Dalebout et al. |
| 7,771,371 | B2 | 8/2010 | Avni |
| 7,775,128 | B2 | 8/2010 | Roessingh et al. |
| 7,775,936 | B2 | 8/2010 | Wilkinson |
| 7,775,943 | B2 | 8/2010 | Vittone |
| 7,780,577 | B2 | 8/2010 | Arnold |
| 7,780,578 | B2 | 8/2010 | Packham |
| 7,785,232 | B2 | 8/2010 | Cole et al. |
| 7,789,800 | B1 | 9/2010 | Watterson et al. |
| 7,794,363 | B2 | 9/2010 | Wang |
| 7,795,824 | B2 | 9/2010 | Shen et al. |
| 7,798,946 | B2 | 9/2010 | Dalebout et al. |
| 7,805,186 | B2 | 9/2010 | Pulkkinen et al. |
| 7,806,006 | B2 | 10/2010 | Phillips et al. |
| 7,806,589 | B2 | 10/2010 | Tashman |
| 7,806,780 | B1 | 10/2010 | Plunkett |
| 7,806,805 | B2 | 10/2010 | Barufka et al. |
| 7,811,209 | B2 | 10/2010 | Crawford et al. |
| 7,815,548 | B2 | 10/2010 | Barre |
| 7,815,549 | B2 | 10/2010 | Crawford et al. |
| 7,815,550 | B2 | 10/2010 | Watterson et al. |
| 7,815,552 | B2 | 10/2010 | Dibble et al. |
| 7,815,554 | B2 | 10/2010 | Gibson et al. |
| 7,819,779 | B2 | 10/2010 | Chang |
| 7,825,319 | B2 | 11/2010 | Turner |
| 7,828,699 | B2 | 11/2010 | P'erez De Lazarraga |
| 7,833,135 | B2 | 11/2010 | Radow |
| 7,837,161 | B2 | 11/2010 | Chase |
| 7,837,595 | B2 | 11/2010 | Rice |
| 7,839,058 | B1 | 11/2010 | Churchill et al. |
| 7,846,070 | B2 | 12/2010 | Oglesby et al. |
| 7,850,514 | B2 | 12/2010 | Weber |
| 7,850,537 | B2 | 12/2010 | Stern |
| 7,854,669 | B2 | 12/2010 | Marty et al. |
| 7,854,690 | B2 | 12/2010 | Trevino et al. |
| 7,862,475 | B2 | 1/2011 | Watterson |
| 7,862,483 | B2 | 1/2011 | Hendrickson et al. |
| 7,862,489 | B2 | 1/2011 | Savsek |
| 7,871,355 | B2 | 1/2011 | Yeh |
| 7,871,357 | B2 | 1/2011 | Gibson et al. |
| 7,873,849 | B2 | 1/2011 | Mucignat et al. |
| 7,874,963 | B2 | 1/2011 | Grind |
| 7,878,950 | B1 | 2/2011 | Bastian |
| 7,878,956 | B2 | 2/2011 | Kadar |
| 7,883,445 | B2 | 2/2011 | Olrik et al. |
| 7,883,448 | B2 | 2/2011 | Wang |
| 7,887,465 | B2 | 2/2011 | Uffelman |
| 7,887,470 | B2 | 2/2011 | Chen |
| 7,892,148 | B1 | 2/2011 | Stauffer et al. |
| 7,892,149 | B2 | 2/2011 | Wu |
| 7,892,150 | B1 | 2/2011 | Colley |
| 7,892,155 | B2 | 2/2011 | Pearson et al. |
| 7,892,159 | B2 | 2/2011 | McVay et al. |
| 7,901,324 | B2 | 3/2011 | Kodama |
| 7,901,325 | B2 | 3/2011 | Henderson |
| 7,901,753 | B2 | 3/2011 | Carr |
| 7,905,817 | B2 | 3/2011 | Giannascoli et al. |
| 7,908,981 | B2 | 3/2011 | Agee |
| 7,909,740 | B2 | 3/2011 | Dalebout et al. |
| 7,914,420 | B2 | 3/2011 | Daly et al. |
| 7,914,421 | B2 | 3/2011 | Weier et al. |
| 7,918,768 | B2 | 4/2011 | Rogozinski |
| 7,919,950 | B2 | 4/2011 | Uno et al. |
| 7,922,635 | B2 | 4/2011 | Lull et al. |
| 7,927,253 | B2 | 4/2011 | Vincent |
| 7,927,257 | B2 | 4/2011 | Patel |
| 7,927,267 | B2 | 4/2011 | Splane |
| 7,931,563 | B2 | 4/2011 | Shaw et al. |
| 7,938,751 | B2 | 5/2011 | Nicolas et al. |
| 7,938,755 | B1 | 5/2011 | Dyer et al. |
| 7,941,945 | B2 | 5/2011 | Gerber |
| 7,942,783 | B2 | 5/2011 | Ochi |
| 7,942,788 | B2 | 5/2011 | Wu |
| 7,946,967 | B2 | 5/2011 | Berhanu |
| 7,946,968 | B2 | 5/2011 | Kjellberg |
| 7,949,295 | B2 | 5/2011 | Kumar et al. |
| 7,951,046 | B1 | 5/2011 | Barber, Jr. |
| 7,959,124 | B2 | 6/2011 | Phifer et al. |
| 7,967,728 | B2 | 6/2011 | Zavadsky |
| 7,967,730 | B2 | 6/2011 | Crawford et al. |
| 7,972,245 | B2 | 7/2011 | Temple et al. |
| 7,972,249 | B1 | 7/2011 | Napalan |
| 7,976,437 | B1 | 7/2011 | Von Detten |
| 7,978,081 | B2 | 7/2011 | Shears et al. |
| 7,985,164 | B2 | 7/2011 | Ashby |
| 7,985,166 | B2 | 7/2011 | Farnsworth et al. |
| 7,988,600 | B2 | 8/2011 | Rodgers, Jr. |
| 7,992,879 | B2 | 8/2011 | Eisenberg et al. |
| 8,001,472 | B2 | 8/2011 | Gilley et al. |
| 8,002,674 | B2 | 8/2011 | Piaget et al. |
| 8,002,684 | B2 | 8/2011 | Fithealth |
| 8,006,574 | B2 | 8/2011 | Meyer |
| 8,007,407 | B2 | 8/2011 | Richter |
| 8,007,409 | B2 | 8/2011 | Elllis |
| 8,007,422 | B2 | 8/2011 | Zaccherini |
| 8,009,045 | B2 | 8/2011 | Cehelnik |

(56) References Cited

U.S. PATENT DOCUMENTS

| | | | |
|---|---|---|---|
| 8,011,242 | B2 | 9/2011 | O'neill |
| 8,012,003 | B2 | 9/2011 | Sterchi et al. |
| 8,012,067 | B2 | 9/2011 | Constantinos |
| 8,012,068 | B1 | 9/2011 | Malcolm |
| 8,021,277 | B2 | 9/2011 | Baudhuin |
| 8,025,609 | B2 | 9/2011 | Giannelli et al. |
| 8,029,415 | B2 | 10/2011 | Ashby et al. |
| 8,029,418 | B2 | 10/2011 | Nishimura |
| 8,033,959 | B2 | 10/2011 | Oleson et al. |
| 8,033,960 | B1 | 10/2011 | Dalebout et al. |
| 8,037,574 | B2 | 10/2011 | Chase |
| 8,038,117 | B2 | 10/2011 | Chen et al. |
| 8,038,577 | B2 | 10/2011 | Mcintosh |
| 8,040,117 | B2 | 10/2011 | Telefus |
| 8,043,173 | B2 | 10/2011 | Menalagha et al. |
| 8,047,965 | B2 | 11/2011 | Shea |
| 8,047,966 | B2 | 11/2011 | Dorogusker et al. |
| 8,047,970 | B2 | 11/2011 | Nalley |
| 8,055,469 | B2 | 11/2011 | Kulach et al. |
| 8,057,366 | B2 | 11/2011 | Schippers |
| 8,057,368 | B1 | 11/2011 | Lyszczarz |
| 8,062,196 | B1 | 11/2011 | Khubani |
| 8,063,776 | B2 | 11/2011 | Ruha |
| 8,065,926 | B2 | 11/2011 | Meyer |
| 8,066,514 | B2 | 11/2011 | Clarke |
| 8,070,657 | B2 | 12/2011 | Loach |
| 8,075,453 | B1 | 12/2011 | Wilkinson |
| 8,079,937 | B2 | 12/2011 | Bedell |
| 8,079,939 | B1 | 12/2011 | Wang |
| 8,082,029 | B2 | 12/2011 | Honda |
| 8,083,645 | B2 | 12/2011 | Asukai et al. |
| 8,083,693 | B1 | 12/2011 | McKeon et al. |
| 8,088,044 | B2 | 1/2012 | Tchao et al. |
| 8,092,352 | B2 | 1/2012 | Irving et al. |
| 8,096,925 | B2 | 1/2012 | Radding et al. |
| 8,103,379 | B2 | 1/2012 | Biba et al. |
| 8,103,517 | B2 | 1/2012 | Hinnebusch |
| 8,104,411 | B2 | 1/2012 | Fenton |
| 8,105,213 | B2 | 1/2012 | Stewart et al. |
| 8,109,858 | B2 | 2/2012 | Redmann |
| 8,109,864 | B2 | 2/2012 | Tseng |
| 8,113,990 | B2 | 2/2012 | Kolman et al. |
| 8,113,994 | B2 | 2/2012 | Piaget et al. |
| 8,118,709 | B2 | 2/2012 | Mckirdy |
| 8,118,888 | B2 | 2/2012 | Molter |
| 8,123,527 | B2 | 2/2012 | Holljes |
| 8,141,276 | B2 | 3/2012 | Ellis |
| 8,147,385 | B2 | 4/2012 | Crawford et al. |
| 8,152,702 | B2 | 4/2012 | Pacheco |
| 8,157,708 | B2 | 4/2012 | Daly |
| 8,162,769 | B2 | 4/2012 | Henry |
| 8,162,804 | B2 | 4/2012 | Tagliabue |
| 8,172,729 | B2 | 5/2012 | Ellis |
| 8,177,688 | B2 | 5/2012 | Burnfield et al. |
| 8,182,399 | B2 | 5/2012 | Davis et al. |
| 8,188,700 | B2 | 5/2012 | Tseng et al. |
| 8,192,332 | B2 | 6/2012 | Baker et al. |
| 8,192,338 | B2 | 6/2012 | Solow |
| 8,200,323 | B2 | 6/2012 | Dibenedetto et al. |
| 8,206,266 | B2 | 6/2012 | Hall |
| 8,221,290 | B2 | 7/2012 | Vincent et al. |
| 8,221,295 | B2 | 7/2012 | Wilkins |
| 8,235,724 | B2 | 8/2012 | Gilley et al. |
| 8,240,430 | B2 | 8/2012 | Downey |
| 8,241,182 | B2 | 8/2012 | Julskjaer et al. |
| 8,241,186 | B2 | 8/2012 | Brodess et al. |
| 8,241,187 | B2 | 8/2012 | Moon et al. |
| 8,251,874 | B2 | 8/2012 | Ashby et al. |
| 8,257,232 | B2 | 9/2012 | Albert |
| 8,260,858 | B2 | 9/2012 | Belz et al. |
| 8,272,996 | B2 | 9/2012 | Weier |
| 8,275,265 | B2 | 9/2012 | Kobyakov et al. |
| 8,280,259 | B2 | 10/2012 | George et al. |
| 8,287,434 | B2 | 10/2012 | Zavadsky et al. |
| 8,298,125 | B2 | 10/2012 | Colledge et al. |
| 8,302,213 | B2 | 11/2012 | Kriesel |
| 8,306,635 | B2 | 11/2012 | Pryor |
| 8,308,618 | B2 | 11/2012 | Bayerlein |
| 8,309,870 | B2 | 11/2012 | Peterson et al. |
| 8,310,468 | B2 | 11/2012 | Martin |
| 8,315,823 | B2 | 11/2012 | Berme et al. |
| 8,317,663 | B2 | 11/2012 | Stewart et al. |
| 8,320,578 | B2 | 11/2012 | Kahn et al. |
| 8,323,156 | B2 | 12/2012 | Ozawa et al. |
| 8,323,157 | B2 | 12/2012 | Campanaro et al. |
| 8,329,265 | B2 | 12/2012 | Cook |
| 8,333,681 | B2 | 12/2012 | Schmidt |
| 8,343,016 | B1 | 1/2013 | Astilean |
| 8,360,904 | B2 | 1/2013 | Oleson et al. |
| 8,360,935 | B2 | 1/2013 | Olsen et al. |
| 8,360,936 | B2 | 1/2013 | Dibenedetto et al. |
| 8,368,329 | B1 | 2/2013 | Depew et al. |
| 8,376,911 | B2 | 2/2013 | Ogg et al. |
| 8,378,647 | B2 | 2/2013 | Yonezawa et al. |
| 8,394,005 | B2 | 3/2013 | Solow et al. |
| 8,395,366 | B2 | 3/2013 | Uno |
| 8,398,529 | B2 | 3/2013 | Ellis |
| 8,403,816 | B2 | 3/2013 | Park |
| 8,429,223 | B2 | 4/2013 | Gilley et al. |
| 8,435,160 | B1 | 5/2013 | Clum |
| 8,446,275 | B2 | 5/2013 | Utter, II |
| 8,449,620 | B2 | 5/2013 | Hakansson et al. |
| 8,454,437 | B2 | 6/2013 | Dugan |
| 8,459,479 | B2 | 6/2013 | Yourist |
| 8,467,979 | B2 | 6/2013 | Sobolewski |
| 8,475,346 | B2 | 7/2013 | Gerschefske et al. |
| 8,475,367 | B1 | 7/2013 | Yuen et al. |
| 8,480,541 | B1 | 7/2013 | Brunts |
| 8,485,944 | B2 | 7/2013 | Drazan |
| 8,485,945 | B2 | 7/2013 | Leonhard |
| 8,487,759 | B2 | 7/2013 | Hill |
| 8,493,757 | B2 | 7/2013 | Carletti et al. |
| 8,505,597 | B2 | 8/2013 | Sharperson |
| 8,506,370 | B2 | 8/2013 | Homsi |
| 8,506,459 | B2 | 8/2013 | Cassidy et al. |
| 8,512,209 | B2 | 8/2013 | Guidi et al. |
| 8,512,210 | B2 | 8/2013 | Shauli |
| 8,516,723 | B2 | 8/2013 | Ferrigan et al. |
| 8,527,101 | B2 | 9/2013 | Burris et al. |
| 8,533,620 | B2 | 9/2013 | Hoffman et al. |
| 8,535,247 | B2 | 9/2013 | Williams |
| 8,537,017 | B2 | 9/2013 | Mack et al. |
| 8,540,560 | B2 | 9/2013 | Crowley et al. |
| 8,540,607 | B2 | 9/2013 | Kissel et al. |
| 8,550,962 | B2 | 10/2013 | Piaget et al. |
| 8,552,859 | B2 | 10/2013 | Pakula et al. |
| 8,556,090 | B2 | 10/2013 | Chen |
| 8,562,489 | B2 | 10/2013 | Burton et al. |
| 8,564,235 | B2 | 10/2013 | Burris et al. |
| 8,569,963 | B2 | 10/2013 | Walters |
| 8,571,250 | B2 | 10/2013 | Royer |
| 8,573,982 | B1 | 11/2013 | Chuang |
| 8,574,131 | B2 | 11/2013 | Daly |
| 8,585,561 | B2 | 11/2013 | Watt et al. |
| 8,602,951 | B2 | 12/2013 | Morris |
| 8,608,624 | B2 | 12/2013 | Shabodyash et al. |
| 8,614,595 | B2 | 12/2013 | Acatrinei |
| 8,614,902 | B2 | 12/2013 | Pansier et al. |
| 8,615,377 | B1 | 12/2013 | Yuen et al. |
| 8,617,008 | B2 | 12/2013 | Marty et al. |
| 8,622,747 | B2 | 1/2014 | Chu et al. |
| 8,647,240 | B2 | 2/2014 | Heidecke |
| 8,651,030 | B2 | 2/2014 | Coffman |
| 8,655,004 | B2 | 2/2014 | Prest et al. |
| 8,657,724 | B2 | 2/2014 | Yang |
| 8,671,853 | B2 | 3/2014 | Flaherty |
| 8,678,897 | B2 | 3/2014 | Englert et al. |
| 8,690,578 | B1 | 4/2014 | Nusbaum et al. |
| 8,690,735 | B2 | 4/2014 | Watterson et al. |
| 8,690,738 | B1 | 4/2014 | Astilian |
| 8,701,567 | B1 | 4/2014 | Esfandiari et al. |
| 8,702,430 | B2 | 4/2014 | Dibenedetto et al. |
| 8,702,567 | B2 | 4/2014 | Hu |
| 8,706,530 | B2 | 4/2014 | Ohnemus et al. |

(56) References Cited

U.S. PATENT DOCUMENTS

| | | | |
|---|---|---|---|
| 8,708,870 | B2 | 4/2014 | Nalley |
| 8,714,346 | B2 | 5/2014 | Freitag |
| 8,727,946 | B2 | 5/2014 | Greenhill et al. |
| 8,727,947 | B2 | 5/2014 | Tagliabue |
| 8,734,157 | B1 | 5/2014 | Hummel, III |
| 8,734,301 | B2 | 5/2014 | Remelius |
| 8,734,302 | B2 | 5/2014 | Hsieh |
| 8,738,321 | B2 | 5/2014 | Yuen et al. |
| 8,739,974 | B2 | 6/2014 | TeVault et al. |
| 8,740,753 | B2 | 6/2014 | Olson et al. |
| 8,740,756 | B2 | 6/2014 | Shabodyash et al. |
| 8,747,285 | B2 | 6/2014 | Hof |
| 8,749,380 | B2 | 6/2014 | Vock et al. |
| 8,758,201 | B2 | 6/2014 | Ashby et al. |
| 8,762,077 | B2 | 6/2014 | Redmond |
| 8,762,101 | B2 | 6/2014 | Yuen et al. |
| 8,764,609 | B1 | 7/2014 | Elahmadie |
| 8,771,153 | B2 | 7/2014 | Dalebout et al. |
| 8,777,820 | B2 | 7/2014 | Lo |
| 8,783,326 | B1 | 7/2014 | Vaninger et al. |
| 8,784,274 | B1 | 7/2014 | Chuang |
| 8,784,275 | B2 | 7/2014 | Mikan |
| 8,784,278 | B2 | 7/2014 | Flake |
| 8,786,575 | B2 | 7/2014 | Miller |
| 8,790,222 | B2 | 7/2014 | Burger |
| 8,801,578 | B2 | 8/2014 | Corbalis et al. |
| 8,801,581 | B2 | 8/2014 | Lai et al. |
| 8,801,582 | B2 | 8/2014 | Huang et al. |
| 8,814,762 | B2 | 8/2014 | Butler |
| 8,821,350 | B2 | 9/2014 | Maertz |
| 8,823,314 | B2 | 9/2014 | Lumsden et al. |
| 8,824,166 | B2 | 9/2014 | Rohrbach |
| 8,824,697 | B2 | 9/2014 | Christoph |
| 8,825,445 | B2 | 9/2014 | Hoffman et al. |
| 8,837,174 | B2 | 9/2014 | Hosotani |
| 8,839,725 | B2 | 9/2014 | Kooistra |
| 8,840,075 | B2 | 9/2014 | Olson |
| 8,840,569 | B2 | 9/2014 | Flaction et al. |
| 8,845,498 | B2 | 9/2014 | Webb |
| 8,847,988 | B2 | 9/2014 | Geisner et al. |
| 8,851,565 | B2 | 10/2014 | Hontz et al. |
| 8,858,409 | B2 | 10/2014 | Trees |
| 8,864,627 | B2 | 10/2014 | Bayerlein et al. |
| 8,876,661 | B2 | 11/2014 | Lu |
| 8,876,668 | B2 | 11/2014 | Hendrickson et al. |
| 8,888,660 | B1 | 11/2014 | Oteman |
| 8,892,999 | B2 | 11/2014 | Nims et al. |
| 8,894,549 | B2 | 11/2014 | Colledge |
| 8,894,551 | B2 | 11/2014 | Kerdjoudj |
| 8,913,409 | B2 | 12/2014 | Hui et al. |
| 8,920,288 | B2 | 12/2014 | Dalebout |
| 8,920,291 | B2 | 12/2014 | Chen et al. |
| 8,920,347 | B2 | 12/2014 | Bayerlein |
| 8,922,498 | B2 | 12/2014 | Vesely |
| 8,926,475 | B2 | 1/2015 | Lin et al. |
| 8,926,479 | B2 | 1/2015 | Chen et al. |
| 8,939,831 | B2 | 1/2015 | Dugan |
| 8,956,290 | B2 | 2/2015 | Gilley et al. |
| 8,956,715 | B2 | 2/2015 | Kim |
| 8,961,439 | B2 | 2/2015 | Yang et al. |
| 8,968,163 | B1 | 3/2015 | Vidmar |
| 8,979,709 | B2 | 3/2015 | Toback et al. |
| 8,986,165 | B2 | 3/2015 | Ashby |
| 8,986,807 | B2 | 3/2015 | Rodgers |
| 8,986,808 | B2 | 3/2015 | George |
| 8,990,732 | B2 | 3/2015 | Farrenkopf et al. |
| 8,996,978 | B2 | 3/2015 | Richstein et al. |
| 9,005,085 | B2 | 4/2015 | Astilean |
| 9,008,973 | B2 | 4/2015 | French |
| 9,011,291 | B2 | 4/2015 | Birrell |
| 9,015,952 | B2 | 4/2015 | Magosaki |
| 9,028,368 | B2 | 5/2015 | Ashby et al. |
| 9,033,137 | B2 | 5/2015 | Koppes et al. |
| 9,033,712 | B2 | 5/2015 | Vasin |
| 9,038,218 | B1 | 5/2015 | Heil et al. |
| 9,039,578 | B2 | 5/2015 | Dalebout |
| 9,044,637 | B2 | 6/2015 | Karl |
| 9,050,486 | B2 | 6/2015 | Reed |
| 9,050,491 | B2 | 6/2015 | Gordon et al. |
| 9,050,498 | B2 | 6/2015 | Lu et al. |
| 9,063,026 | B2 | 6/2015 | Nassef |
| 9,072,930 | B2 | 7/2015 | Ashby et al. |
| 9,072,932 | B2 | 7/2015 | Piaget et al. |
| 9,072,941 | B2 | 7/2015 | Duda et al. |
| 9,081,534 | B2 | 7/2015 | Yuen et al. |
| 9,081,889 | B2 | 7/2015 | Ingrassia et al. |
| 9,083,245 | B2 | 7/2015 | Zhao et al. |
| 9,084,565 | B2 | 7/2015 | Mason et al. |
| 9,084,712 | B2 | 7/2015 | Roerdink et al. |
| 9,089,732 | B2 | 7/2015 | Andon et al. |
| 9,091,008 | B2 | 7/2015 | Mathieu |
| 9,095,740 | B2 | 8/2015 | Wu |
| 9,108,079 | B2 | 8/2015 | Solow et al. |
| 9,108,081 | B2 | 8/2015 | Giannelli et al. |
| 9,114,275 | B2 | 8/2015 | Lu et al. |
| 9,114,276 | B2 | 8/2015 | Bayerlein et al. |
| 9,119,983 | B2 | 9/2015 | Rhea |
| 9,119,988 | B2 * | 9/2015 | Murray ..... A63B 22/0235 |
| 9,126,071 | B2 | 9/2015 | Smith |
| 9,126,072 | B2 | 9/2015 | Watterson |
| 9,132,051 | B2 | 9/2015 | Heil |
| 9,138,614 | B2 | 9/2015 | Lu et al. |
| 9,138,615 | B2 | 9/2015 | Olson et al. |
| 9,144,703 | B2 | 9/2015 | Dalebout et al. |
| 9,148,077 | B2 | 9/2015 | Henderson |
| 9,149,683 | B2 | 9/2015 | Smith |
| 9,162,102 | B1 | 10/2015 | Eder et al. |
| 9,162,106 | B1 | 10/2015 | Scheiman |
| 9,168,414 | B2 | 10/2015 | Liu et al. |
| 9,174,085 | B2 | 11/2015 | Foley |
| 9,186,537 | B2 | 11/2015 | Arnold et al. |
| 9,186,549 | B2 | 11/2015 | Watterson et al. |
| 9,186,552 | B1 | 11/2015 | Deal |
| 9,192,800 | B1 | 11/2015 | Meyer et al. |
| 9,198,622 | B2 | 12/2015 | Kaleal et al. |
| 9,199,115 | B2 | 12/2015 | Yim et al. |
| 9,199,123 | B2 | 12/2015 | Solow |
| 9,201,458 | B2 | 12/2015 | Hunt et al. |
| 9,220,940 | B2 | 12/2015 | Al Kuwari |
| 9,221,545 | B2 | 12/2015 | Popescu et al. |
| 9,223,936 | B2 | 12/2015 | Aragones et al. |
| 9,224,291 | B2 | 12/2015 | Moll-Carrillo et al. |
| 9,226,692 | B2 | 1/2016 | Haas |
| 9,227,101 | B2 | 1/2016 | Maguire |
| 9,233,272 | B2 * | 1/2016 | Villani ..... A63B 22/02 |
| 9,242,139 | B2 | 1/2016 | Holley |
| 9,242,142 | B2 | 1/2016 | Vincent et al. |
| 9,254,409 | B2 | 2/2016 | Dalebout et al. |
| 9,256,711 | B2 | 2/2016 | Horseman |
| 9,257,054 | B2 | 2/2016 | Coza et al. |
| 9,263,967 | B2 | 2/2016 | McCune |
| 9,278,248 | B2 | 3/2016 | Tyger |
| 9,283,431 | B2 | 3/2016 | Marty |
| 9,289,063 | B2 | 3/2016 | Baugh et al. |
| 9,289,648 | B2 | 3/2016 | Watterson |
| 9,289,674 | B2 | 3/2016 | Winsper et al. |
| 9,292,935 | B2 | 3/2016 | Koduri et al. |
| 9,308,415 | B2 | 4/2016 | Crawford et al. |
| 9,308,417 | B2 | 4/2016 | Grundy |
| 9,311,802 | B1 | 4/2016 | Chin et al. |
| 9,314,666 | B2 | 4/2016 | Canavan et al. |
| 9,317,660 | B2 | 4/2016 | Burich et al. |
| 9,320,457 | B2 | 4/2016 | Flaction et al. |
| 9,330,239 | B2 | 5/2016 | Koduri et al. |
| 9,330,544 | B2 | 5/2016 | Levesque et al. |
| 9,333,388 | B2 | 5/2016 | Lee et al. |
| 9,339,681 | B1 | 5/2016 | Nalley |
| 9,339,683 | B2 | 5/2016 | Dilli et al. |
| 9,352,185 | B2 | 5/2016 | Hendrickson et al. |
| 9,352,186 | B2 | 5/2016 | Watterson |
| 9,352,187 | B2 | 5/2016 | Piaget et al. |
| 9,357,551 | B2 | 5/2016 | Gutman |
| 9,358,422 | B2 | 6/2016 | Brontman |
| 9,364,706 | B2 | 6/2016 | Lo |

(56) References Cited

U.S. PATENT DOCUMENTS 9,364,708 B2 6/2016 Luger et al.
9,364,714 B2 6/2016 Koduri et al.
9,367,668 B2 6/2016 Flynt et al.
9,369,178 B2 6/2016 Matsutani
9,370,687 B2 6/2016 Hao
9,370,691 B2 6/2016 Nissila et al.
9,375,605 B2 6/2016 Tyger
9,378,336 B2 6/2016 Ohnemus et al.
9,387,387 B2 7/2016 Dalebout
9,389,718 B1 7/2016 Letourneur
9,392,941 B2 7/2016 Powch et al.
9,393,453 B2 7/2016 Watterson
9,403,047 B2 8/2016 Olson
9,403,051 B2 8/2016 Cutler
9,409,050 B2 8/2016 Mintz
9,411,940 B2 8/2016 Burroughs et al.
9,415,257 B2 8/2016 Habing
9,427,615 B2 8/2016 Pretz et al.
9,452,315 B1 9/2016 Murray et al.
9,452,320 B2 9/2016 Yang
9,455,623 B2 9/2016 Fan et al.
9,455,784 B2 9/2016 Cune et al.
9,457,219 B2 10/2016 Smith
9,457,220 B2 10/2016 Olson
9,457,224 B2 10/2016 Giannelli et al.
9,457,256 B2 10/2016 Aragones et al.
9,463,349 B1 10/2016 Chang
9,480,874 B2 11/2016 Cutler
9,486,658 B2 11/2016 Alexander
9,492,704 B2 11/2016 Mortensen et al.
9,498,668 B2 11/2016 Smith
9,498,671 B1 11/2016 Softky
9,505,241 B2 11/2016 Cuzin
9,511,254 B2 12/2016 Netter
9,511,259 B2 12/2016 Mountain
9,511,864 B2 12/2016 Hyoudo et al.
9,517,378 B2 12/2016 Ashby et al.
9,521,901 B2 12/2016 Dalebout
9,533,187 B2 1/2017 Dalebout
9,539,458 B1 1/2017 Ross
9,539,461 B2 1/2017 Ercanbrack
9,540,071 B2 1/2017 Jordan et al.
9,540,174 B2 1/2017 Josserond et al.
9,545,541 B2 1/2017 Aragones et al.
9,550,091 B2 1/2017 Emerson
9,560,917 B2 2/2017 Roslund, Jr.
9,569,986 B2 2/2017 Levine et al.
9,573,017 B2 2/2017 Chang
9,579,534 B2 2/2017 Sutkowski et al.
9,579,544 B2 2/2017 Watterson
9,582,976 B2 2/2017 Chin et al.
9,586,085 B2 3/2017 Arnold et al.
9,586,090 B2 3/2017 Watterson et al.
9,604,099 B2 3/2017 Taylor
9,604,757 B2 3/2017 Spivack et al.
9,610,475 B1 4/2017 DeKnock et al.
9,610,506 B2 4/2017 Dugan
9,616,276 B2 4/2017 Dalebout
9,616,278 B2 4/2017 Olson
9,623,281 B2 4/2017 Hendrickson
9,623,286 B1 4/2017 Chen
9,642,415 B2 5/2017 Pease et al.
9,665,873 B2 5/2017 Ackland
9,673,904 B2 6/2017 Palanisamy et al.
9,675,839 B2 6/2017 Dalebout
9,681,313 B2 6/2017 Malach
9,682,306 B2 6/2017 Lin et al.
9,682,307 B2 6/2017 Dalebout
9,694,234 B2 7/2017 Dalebout et al.
9,694,242 B2 7/2017 Ashby
9,700,780 B2 7/2017 Riley et al.
9,707,441 B2 7/2017 Yang
9,707,447 B1 7/2017 Lopez Babodilla
9,731,158 B1 8/2017 Lo
9,737,747 B1 8/2017 Walsh et al.
9,737,755 B2 8/2017 Dalebout
9,750,454 B2 9/2017 Walke
9,757,605 B2 9/2017 Olson et al.
9,764,184 B2 9/2017 Kueker et al.
9,767,785 B2 9/2017 Ashby
9,776,032 B2 10/2017 Moran
9,776,039 B1 10/2017 Xu
9,782,625 B1 10/2017 Blum et al.
9,795,822 B2 10/2017 Smith et al.
9,795,827 B2 10/2017 Wiener et al.
9,795,855 B2 10/2017 Jafarifesharaki
9,808,672 B2 11/2017 Dalebout
9,808,673 B2 11/2017 Robinson
9,814,927 B2 11/2017 Forystek
9,814,929 B2 11/2017 Moser
9,814,930 B2 11/2017 Manzke et al.
9,827,458 B2 11/2017 Dalton
9,829,068 B2 11/2017 Marchetti
9,833,658 B2 12/2017 Wiener et al.
9,846,438 B2 12/2017 Rihn et al.
9,849,326 B2 12/2017 Smith
9,849,330 B2 12/2017 Lagree
9,884,222 B2 2/2018 Chen
9,889,334 B2 2/2018 Ashby et al.
9,895,567 B2 2/2018 Lee
9,901,767 B2 2/2018 Kuo
9,901,780 B2 2/2018 DeLuca et al.
9,901,805 B2 2/2018 Hughes, Jr.
9,914,011 B2 3/2018 Downey et al.
9,914,014 B2 3/2018 Lagree et al.
9,937,375 B2 4/2018 Zhu
9,943,719 B2 4/2018 Smith et al.
9,948,349 B2 4/2018 Malach
9,950,209 B2 4/2018 Randall et al.
9,956,450 B2 5/2018 Albertsen et al.
9,968,816 B2 5/2018 Olson et al.
9,968,821 B2 5/2018 Finlayson et al.
9,968,823 B2 5/2018 Cutler
9,975,003 B2 5/2018 Molins et al.
9,979,182 B2 5/2018 Lin et al.
9,980,465 B2 5/2018 Hayashi
9,987,513 B2 6/2018 Yim et al.
9,987,517 B1 6/2018 Kuo
9,990,126 B2 6/2018 Chanyontpatanakul
9,993,680 B2 6/2018 Gordon
9,993,711 B2 6/2018 Moya Saez
10,004,940 B2 6/2018 Badarneh
10,004,945 B2 6/2018 Sauter
10,010,169 B2 7/2018 Grotenhuis
10,010,755 B2 7/2018 Watterson
10,010,756 B2 7/2018 Watterson
10,022,590 B2 7/2018 Foley et al.
10,036,443 B2 7/2018 Galasso et al.
10,039,952 B2 8/2018 Chang
10,039,970 B2 8/2018 Lee et al.
10,046,222 B2 8/2018 Hawkins, III et al.
10,065,070 B2 9/2018 Huang
10,070,816 B2 9/2018 Cowley et al.
10,071,285 B2 9/2018 Smith et al.
10,086,254 B2 10/2018 Watterson
10,118,064 B1 * 11/2018 Cox ..... A63B 21/0023
10,188,890 B2 1/2019 Olson
10,207,143 B2 2/2019 Dalebout
10,207,145 B2 2/2019 Tyger
10,207,148 B2 2/2019 Powell
10,252,109 B2 4/2019 Watterson
10,272,317 B2 4/2019 Watterson
10,279,212 B2 5/2019 Dalebout et al.
10,293,211 B2 5/2019 Watterson et al.
10,343,017 B2 7/2019 Jackson
10,376,736 B2 8/2019 Powell et al.
2001/0001303 A1 5/2001 Ohsuga et al.
2001/0008053 A1 7/2001 Belli
2002/0016235 A1 2/2002 Ashby et al.
2002/0025888 A1 2/2002 Germanton
2002/0043909 A1 4/2002 Nielsen
2002/0055418 A1 5/2002 Pyles et al.
2002/0055422 A1 5/2002 Airmet
2002/0066735 A1 6/2002 Hewlitt et al.

(56) References Cited

U.S. PATENT DOCUMENTS

2002/0077221 A1 6/2002 Dalebout et al.
2002/0128127 A1 9/2002 Chen
2002/0160883 A1 10/2002 Dugan
2003/0045406 A1 3/2003 Stone
2003/0060344 A1 3/2003 Varner
2003/0069108 A1 4/2003 Rubinstein
2003/0073545 A1 4/2003 Liu
2003/0092532 A1 5/2003 Giannelli et al.
2003/0092540 A1 5/2003 Gillen
2003/0096675 A1 5/2003 Wang
2003/0104908 A1 6/2003 Tung
2003/0128186 A1 7/2003 Laker
2003/0134718 A1 7/2003 Kim
2003/0148853 A1 8/2003 Alessandri
2003/0171189 A1 9/2003 Kaufman
2003/0171190 A1 9/2003 Rice
2003/0176815 A1 9/2003 Baba et al.
2004/0005961 A1 1/2004 Iund
2004/0014571 A1 1/2004 Haynes
2004/0023761 A1 2/2004 Emery
2004/0023766 A1 2/2004 Slone
2004/0025754 A1 2/2004 Dye
2004/0029645 A1 2/2004 Chen
2004/0043871 A1 3/2004 Chang
2004/0043873 A1 3/2004 Wilkinson et al.
2004/0051392 A1 3/2004 Badarneh
2004/0053748 A1 3/2004 Lo et al.
2004/0100484 A1 5/2004 Barrett
2004/0132586 A1 7/2004 Leighton et al.
2004/0138030 A1 7/2004 Wang
2004/0152566 A1 8/2004 Yeh
2004/0160336 A1 8/2004 Hoch
2004/0163574 A1 8/2004 Schoenbach
2004/0171464 A1 9/2004 Ashby et al.
2004/0171465 A1 9/2004 Hald
2004/0176215 A1 9/2004 Gramaccioni
2004/0180719 A1 9/2004 Feldman
2004/0181972 A1 9/2004 Csorba
2004/0224740 A1 11/2004 Ball et al.
2004/0242378 A1 12/2004 Pan
2004/0242380 A1 12/2004 Kuivala
2004/0266587 A1 12/2004 Miller
2005/0003931 A1 1/2005 Mills et al.
2005/0008992 A1 1/2005 Westergaard et al.
2005/0009668 A1 1/2005 Savettiere
2005/0023292 A1 2/2005 Market et al.
2005/0037904 A1 2/2005 Chang
2005/0043155 A1 2/2005 Yannitte
2005/0049117 A1 3/2005 Rodgers
2005/0054492 A1 3/2005 Neff
2005/0075213 A1 4/2005 Arick
2005/0096189 A1 5/2005 Chen
2005/0107220 A1 5/2005 Wang
2005/0107226 A1 5/2005 Monda
2005/0130814 A1 6/2005 Nitta
2005/0143226 A1 6/2005 Heidecke
2005/0148440 A1 7/2005 Denton
2005/0148442 A1 7/2005 Watterson
2005/0159273 A1 7/2005 Chen
2005/0164839 A1 7/2005 Watterson
2005/0170935 A1 8/2005 Manser
2005/0170936 A1 8/2005 Quinn
2005/0172311 A1 8/2005 Hjelt et al.
2005/0196737 A1 9/2005 Mann
2005/0209050 A1 9/2005 Bartels
2005/0239600 A1 10/2005 Liang
2005/0239607 A1 10/2005 Chang
2005/0245370 A1 11/2005 Boland
2005/0272562 A1 12/2005 Alessandri et al.
2005/0272577 A1 12/2005 Olson
2005/0277520 A1 12/2005 Van Waes
2005/0288155 A1 12/2005 Yang
2006/0003869 A1 1/2006 Huang et al.
2006/0019804 A1 1/2006 Young
2006/0035757 A1 2/2006 Flick et al.
2006/0040797 A1 2/2006 Chang
2006/0047447 A1 3/2006 Brady et al.
2006/0058162 A1 3/2006 Vieno et al.
2006/0063644 A1 3/2006 Yang
2006/0122035 A1 6/2006 Felix
2006/0122038 A1 6/2006 Lin
2006/0122044 A1 6/2006 Ho
2006/0135322 A1 6/2006 Rocker
2006/0148622 A1 7/2006 Chen
2006/0160665 A1 7/2006 Tai
2006/0160666 A1 7/2006 Wang
2006/0166791 A1 7/2006 Liao
2006/0166799 A1 7/2006 Boland et al.
2006/0172862 A1 8/2006 Badarneh et al.
2006/0189440 A1 8/2006 Gravagne
2006/0194679 A1 8/2006 Hatcher
2006/0205568 A1 9/2006 Huang
2006/0217237 A1* 9/2006 Rhodes ..... A63B 21/225
482/61
2006/0240947 A1 10/2006 Qu
2006/0240951 A1 10/2006 Wang
2006/0240955 A1 10/2006 Pu
2006/0240959 A1 10/2006 Huang
2006/0244187 A1 11/2006 Downey
2006/0247109 A1 11/2006 Powell
2006/0248965 A1 11/2006 Wyatt
2006/0252602 A1 11/2006 Brown
2006/0258513 A1 11/2006 Routley
2006/0276306 A1 12/2006 Pan et al.
2006/0287089 A1 12/2006 Addington et al.
2006/0287147 A1 12/2006 Kriesel
2006/0287163 A1 12/2006 Wang
2006/0288846 A1 12/2006 Logan
2007/0004562 A1 1/2007 Pan et al.
2007/0004569 A1 1/2007 Cao
2007/0006489 A1 1/2007 Case, Jr. et al.
2007/0027002 A1 2/2007 Clark et al.
2007/0038137 A1 2/2007 Arand et al.
2007/0042868 A1 2/2007 Fisher
2007/0049464 A1 3/2007 Chou
2007/0049465 A1 3/2007 Wu
2007/0049466 A1 3/2007 Hubbard
2007/0049470 A1 3/2007 Pyles et al.
2007/0060449 A1 3/2007 Lo
2007/0060451 A1 3/2007 Lucas
2007/0066448 A1 3/2007 Pan et al.
2007/0087908 A1 4/2007 Pan et al.
2007/0111858 A1 5/2007 Dugan
2007/0117683 A1 5/2007 Ercanbrack et al.
2007/0117687 A1* 5/2007 Larson ..... A63B 22/203
482/70
2007/0123389 A1 5/2007 Martin
2007/0123390 A1 5/2007 Mathis
2007/0123396 A1 5/2007 Ellis
2007/0142177 A1 6/2007 Simms et al.
2007/0142183 A1 6/2007 Chang
2007/0151489 A1 7/2007 Byrne
2007/0155277 A1 7/2007 Amitai et al.
2007/0155495 A1 7/2007 Goo
2007/0161468 A1 7/2007 Yanagisawa et al.
2007/0167292 A1 7/2007 Kuo
2007/0184953 A1 8/2007 Luberski et al.
2007/0190508 A1 8/2007 Dalton
2007/0191190 A1 8/2007 Kuo
2007/0197345 A1 8/2007 Wallace et al.
2007/0197353 A1 8/2007 Hundley
2007/0201727 A1 8/2007 Birrell et al.
2007/0204430 A1 9/2007 Chase
2007/0214630 A1 9/2007 Kim
2007/0219066 A1 9/2007 Wang
2007/0225119 A1 9/2007 Schenk
2007/0225126 A1 9/2007 Yoo
2007/0225127 A1 9/2007 Pan et al.
2007/0232455 A1 10/2007 Hanoun
2007/0232463 A1 10/2007 Wu
2007/0245612 A1 10/2007 Tresenfeld
2007/0247320 A1 10/2007 Morahan
2007/0249467 A1 10/2007 Hong et al.
2007/0270667 A1 11/2007 Coppi et al.

(56) References Cited

U.S. PATENT DOCUMENTS

2007/0270726 A1 11/2007 Chou
2007/0281828 A1 12/2007 Rice
2007/0281831 A1 12/2007 Wang
2007/0284495 A1 12/2007 Charles
2007/0296313 A1 12/2007 Wang
2007/0298935 A1 12/2007 Badarneh
2007/0298937 A1 12/2007 Shah
2008/0001772 A1 1/2008 Saito
2008/0004162 A1 1/2008 Chen
2008/0015095 A1* 1/2008 Savsek ..... A63B 21/0455 482/121
2008/0018211 A1 1/2008 Dye
2008/0020898 A1 1/2008 Pyles et al.
2008/0020907 A1 1/2008 Lin
2008/0026658 A1 1/2008 Kriesel
2008/0026838 A1 1/2008 Dunstan et al.
2008/0032864 A1 2/2008 Hakki
2008/0032870 A1 2/2008 Wu
2008/0039301 A1 2/2008 Halbridge
2008/0046246 A1 2/2008 Hakki
2008/0057889 A1 3/2008 Jan
2008/0070756 A1 3/2008 Chu
2008/0070757 A1* 3/2008 Albert ..... A63B 69/0064 482/54
2008/0076972 A1 3/2008 Dorogusker et al.
2008/0096745 A1 4/2008 Perry
2008/0103024 A1 5/2008 Habing
2008/0103034 A1 5/2008 Mihara et al.
2008/0108917 A1 5/2008 Joutras et al.
2008/0119337 A1* 5/2008 Wilkins ..... A63B 5/00 482/130
2008/0139370 A1 6/2008 Charnitski
2008/0153682 A1 6/2008 Chen et al.
2008/0155077 A1 6/2008 James
2008/0161170 A1 7/2008 Lumpee
2008/0161653 A1 7/2008 Lin et al.
2008/0171640 A1 7/2008 Chang
2008/0171922 A1 7/2008 Teller
2008/0176717 A1 7/2008 Wang
2008/0176718 A1 7/2008 Wang
2008/0182724 A1 7/2008 Guthrie
2008/0187689 A1 8/2008 Dierkens et al.
2008/0188362 A1 8/2008 Chen
2008/0191864 A1 8/2008 Wolfson
2008/0200287 A1 8/2008 Marty et al.
2008/0207407 A1 8/2008 Yeh
2008/0214971 A1 9/2008 Talish
2008/0216717 A1 9/2008 Jones
2008/0228110 A1 9/2008 Berme
2008/0229875 A1 9/2008 Ray
2008/0234111 A1 9/2008 Packham
2008/0242511 A1 10/2008 Munoz et al.
2008/0250729 A1 10/2008 Kriesel
2008/0255794 A1 10/2008 Levine
2008/0279896 A1 11/2008 Heinen et al.
2008/0280733 A1 11/2008 Dickie et al.
2008/0280734 A1 11/2008 Dickie et al.
2008/0280735 A1 11/2008 Dickie et al.
2008/0287262 A1 11/2008 Chou
2008/0300110 A1 12/2008 Smith et al.
2008/0300115 A1 12/2008 Erlandson
2008/0300914 A1 12/2008 Karkanias et al.
2008/0312047 A1 12/2008 Feng
2008/0318737 A1 12/2008 Chu
2009/0001831 A1 1/2009 Cho et al.
2009/0023553 A1 1/2009 Shim
2009/0027925 A1 1/2009 Kanouda et al.
2009/0029831 A1 1/2009 Weier
2009/0042698 A1 2/2009 Wang
2009/0048073 A1 2/2009 Roimicher
2009/0048493 A1 2/2009 James et al.
2009/0054751 A1 2/2009 Babashan et al.
2009/0069159 A1 3/2009 Wang
2009/0075781 A1 3/2009 Schwarzberg et al.
2009/0075784 A1 3/2009 Hoggan
2009/0080808 A1 3/2009 Hagen
2009/0093347 A1 4/2009 Wang
2009/0105052 A1 4/2009 Dalebout et al.
2009/0105548 A1 4/2009 Bart
2009/0111664 A1 4/2009 Kau
2009/0111666 A1 4/2009 Wang
2009/0111670 A1 4/2009 Williams
2009/0118098 A1 5/2009 Yeh
2009/0124463 A1 5/2009 Lin
2009/0124464 A1 5/2009 Kastelic
2009/0124465 A1 5/2009 Wang
2009/0124466 A1 5/2009 Zhang
2009/0128516 A1 5/2009 Rimon et al.
2009/0131225 A1 5/2009 Burdea
2009/0156363 A1 6/2009 Guidi et al.
2009/0156364 A1 6/2009 Simeoni
2009/0158871 A1 6/2009 Chuo
2009/0163327 A1 6/2009 Huang et al.
2009/0170672 A1 7/2009 Mcmullen
2009/0180646 A1 7/2009 Vulfson et al.
2009/0181829 A1 7/2009 Wu
2009/0181830 A1 7/2009 Wu
2009/0181831 A1 7/2009 Kuo
2009/0209393 A1 8/2009 Crater et al.
2009/0221405 A1 9/2009 Wang
2009/0221407 A1 9/2009 Hauk
2009/0258710 A1 10/2009 Quatrochi et al.
2009/0269728 A1 10/2009 Verstegen et al.
2009/0286653 A1 11/2009 Wiber
2010/0015585 A1 1/2010 Baker
2010/0022354 A1 1/2010 Fisher
2010/0034665 A1 2/2010 Zhong et al.
2010/0035726 A1 2/2010 Fisher et al.
2010/0063426 A1 3/2010 Planke
2010/0064255 A1 3/2010 Rottler et al.
2010/0079291 A1 4/2010 Kroll et al.
2010/0081548 A1 4/2010 Labedz
2010/0105527 A1 4/2010 Johnson
2010/0113223 A1 5/2010 Chiles et al.
2010/0130337 A1 5/2010 Stewart
2010/0137105 A1 6/2010 Mclaughlin
2010/0175634 A1 7/2010 Chang et al.
2010/0192715 A1 8/2010 Vauchel et al.
2010/0197462 A1 8/2010 Piane, Jr.
2010/0197465 A1 8/2010 Stevenson
2010/0210418 A1 8/2010 Park
2010/0216600 A1 8/2010 Noffsinger
2010/0216607 A1 8/2010 Mueller
2010/0227740 A1 9/2010 Liu
2010/0240458 A1 9/2010 Gaiba et al.
2010/0279822 A1 11/2010 Ford
2010/0285929 A1* 11/2010 Bayerlein ..... A61H 1/0237 482/54
2010/0285933 A1 11/2010 Nalley
2010/0304931 A1 12/2010 Stumpf
2010/0311552 A1 12/2010 Sumners
2010/0317488 A1 12/2010 Cartaya
2011/0028282 A1 2/2011 Sbragia
2011/0054359 A1 3/2011 Sazonov et al.
2011/0056328 A1 3/2011 Ko
2011/0061840 A1 3/2011 Goldmann
2011/0065371 A1 3/2011 Leff
2011/0065373 A1 3/2011 Goldmann
2011/0067361 A1 3/2011 Sloan
2011/0073743 A1 3/2011 Shamie
2011/0082013 A1 4/2011 Bastian
2011/0086707 A1 4/2011 Loveland
2011/0087137 A1 4/2011 Hanoun
2011/0093100 A1 4/2011 Ramsay
2011/0098157 A1 4/2011 Whalen et al.
2011/0098615 A1 4/2011 Whalen et al.
2011/0109283 A1 5/2011 Kapels et al.
2011/0111936 A1* 5/2011 Shabodyash ..... A61H 11/00 482/142
2011/0131005 A1 6/2011 Ueshima et al.
2011/0136627 A1 6/2011 Williams
2011/0143769 A1 6/2011 Jones et al.
2011/0152037 A1 6/2011 Yeong-Haw Tsou
2011/0152635 A1 6/2011 Morris et al.

(56) References Cited

U.S. PATENT DOCUMENTS

2011/0165995 A1 7/2011 Paulus
2011/0172060 A1 7/2011 Morales et al.
2011/0175744 A1 7/2011 Englert et al.
2011/0201481 A1 8/2011 Lo
2011/0205164 A1 8/2011 Hansen et al.
2011/0221672 A1 9/2011 Osterhout et al.
2011/0237399 A1* 9/2011 Toback ..... A63B 5/16 482/8
2011/0275489 A1 11/2011 Apau
2011/0275499 A1 11/2011 Eschenbach
2011/0281691 A1 11/2011 Ellis
2011/0294625 A1* 12/2011 Flake ..... A63B 22/0264 482/54
2011/0308919 A1 12/2011 Hahn
2012/0010053 A1 1/2012 Bayerlein et al.
2012/0021873 A1 1/2012 Brunner
2012/0071301 A1 3/2012 Kaylor et al.
2012/0088633 A1 4/2012 Crafton
2012/0088640 A1 4/2012 Wissink
2012/0132877 A1 5/2012 Wang
2012/0165162 A1 6/2012 Lu
2012/0174833 A1 7/2012 Early
2012/0178590 A1 7/2012 Lu
2012/0190502 A1 7/2012 Paulus et al.
2012/0218184 A1 8/2012 Wissmar
2012/0230504 A1 9/2012 Kuroda
2012/0242774 A1 9/2012 Numano et al.
2012/0253489 A1 10/2012 Dugan
2012/0258433 A1 10/2012 Hope et al.
2012/0270705 A1 10/2012 Lo
2012/0293141 A1 11/2012 Zhang et al.
2012/0295774 A1 11/2012 Dalebout et al.
2012/0298017 A1 11/2012 Chen
2012/0326873 A1 12/2012 Utter, II
2013/0002533 A1 1/2013 Burroughs et al.
2013/0014321 A1* 1/2013 Sullivan ..... E04H 4/0018 4/506
2013/0018494 A1 1/2013 Amini
2013/0053222 A1 2/2013 Lo
2013/0065732 A1 3/2013 Hopp
2013/0123083 A1 5/2013 Sip
2013/0130868 A1 5/2013 Hou
2013/0130869 A1 5/2013 Hou
2013/0141235 A1 6/2013 Utter, II
2013/0147411 A1 6/2013 Pang et al.
2013/0150214 A1 6/2013 Wu
2013/0154441 A1 6/2013 Redmond
2013/0172152 A1 7/2013 Watterson
2013/0172153 A1 7/2013 Watterson
2013/0178334 A1 7/2013 Brammer
2013/0185003 A1 7/2013 Carbeck et al.
2013/0190136 A1 7/2013 Watterson
2013/0196821 A1 8/2013 Watterson et al.
2013/0196827 A1 8/2013 Chang
2013/0228063 A1 9/2013 Turner
2013/0237383 A1 9/2013 Chen
2013/0244836 A1 9/2013 Maughan
2013/0245966 A1 9/2013 Burroughs et al.
2013/0263418 A1 10/2013 Johnson, Jr.
2013/0267386 A1 10/2013 Her
2013/0274067 A1 10/2013 Watterson et al.
2013/0274071 A1 10/2013 Wang
2013/0281241 A1 10/2013 Watterson
2013/0346043 A1 12/2013 Mewes et al.
2014/0011645 A1 1/2014 Johnson et al.
2014/0026788 A1 1/2014 Kallio, III et al.
2014/0031703 A1 1/2014 Rayner et al.
2014/0056461 A1 2/2014 Afshar
2014/0073488 A1 3/2014 Wu
2014/0080678 A1 3/2014 Wu
2014/0085077 A1 3/2014 Luna et al.
2014/0087922 A1* 3/2014 Bayerlein ..... A63B 22/0235 482/54
2014/0121066 A1 5/2014 Huang et al.
2014/0156228 A1 6/2014 Molettiere et al.
2014/0187383 A1 7/2014 Martin
2014/0187389 A1 7/2014 Berg
2014/0221160 A1 8/2014 Hardy et al.
2014/0222173 A1 8/2014 Giedwoyn et al.
2014/0274564 A1 9/2014 Greenbaum
2014/0274574 A1 9/2014 Shorten et al.
2014/0274579 A1 9/2014 Olson
2014/0358473 A1 12/2014 Goel et al.
2014/0360413 A1 12/2014 Schenk
2015/0003621 A1 1/2015 Trammell
2015/0004579 A1 1/2015 Shelton
2015/0016623 A1 1/2015 Trammell
2015/0038300 A1 2/2015 Forhan et al.
2015/0044648 A1 2/2015 White et al.
2015/0065273 A1 3/2015 Lake
2015/0065301 A1 3/2015 Oteman
2015/0105220 A1 4/2015 Hong
2015/0182779 A1 7/2015 Dalebout
2015/0201722 A1 7/2015 Brouard
2015/0202487 A1 7/2015 Wu
2015/0209610 A1 7/2015 Dalebout et al.
2015/0209617 A1 7/2015 Hsiao
2015/0251047 A1 9/2015 Maanitty
2015/0251055 A1 9/2015 Ashby
2015/0253210 A1 9/2015 Ashby et al.
2015/0265903 A1 9/2015 Kolen et al.
2015/0352396 A1 12/2015 Dalebout
2015/0352401 A1 12/2015 Johnson
2015/0367161 A1 12/2015 Wiegardt
2015/0367176 A1 12/2015 Bejestan et al.
2016/0008650 A1 1/2016 Jue et al.
2016/0016035 A1 1/2016 Hao
2016/0027325 A1 1/2016 Malhotra
2016/0047446 A1 2/2016 Hung
2016/0058335 A1 3/2016 Ashby
2016/0089563 A1* 3/2016 Dilli ..... A63B 22/0046 482/54
2016/0096064 A1 4/2016 Gatti
2016/0101311 A1 4/2016 Workman
2016/0193518 A1 7/2016 Baxter
2016/0206248 A1 7/2016 Sartor et al.
2016/0206922 A1 7/2016 Dalebout et al.
2016/0211841 A1 7/2016 Harrison
2016/0219968 A1 8/2016 Martin
2016/0263426 A1 9/2016 Mueller et al.
2016/0303421 A1 10/2016 Tyger et al.
2016/0339298 A1 11/2016 Kats
2016/0346617 A1 12/2016 Srugo et al.
2016/0367851 A1 12/2016 Astilean et al.
2016/0374317 A1* 12/2016 Hayashi ..... A01K 15/027 119/700
2017/0056711 A1 3/2017 Dalebout et al.
2017/0056715 A1 3/2017 Dalebout et al.
2017/0056726 A1 3/2017 Dalebout et al.
2017/0068782 A1 3/2017 Pillai et al.
2017/0113093 A1 4/2017 Bellavista et al.
2017/0136289 A1 5/2017 Frank
2017/0136291 A1 5/2017 Huang
2017/0136339 A1 5/2017 Habiche
2017/0165523 A1 6/2017 Chou
2017/0189745 A1 7/2017 Hamilton et al.
2017/0216660 A1 8/2017 Lernihan
2017/0266481 A1 9/2017 Dalebout
2017/0266483 A1 9/2017 Dalebout et al.
2017/0266532 A1 9/2017 Watterson
2017/0266533 A1 9/2017 Dalebout
2017/0266534 A1 9/2017 Watterson
2017/0274242 A1 9/2017 Corbalis
2017/0326411 A1 11/2017 Watterson
2017/0368442 A1 12/2017 Baudhuin
2018/0001135 A1 1/2018 Powell
2018/0036585 A1 2/2018 Powell
2018/0056111 A1 3/2018 Chiang et al.
2018/0092603 A1 4/2018 Duan et al.
2018/0099179 A1 4/2018 Chatterton et al.
2018/0099180 A1 4/2018 Wilkinson
2018/0099181 A1 4/2018 Powell et al.
2018/0099205 A1 4/2018 Watterson
2018/0104533 A1 4/2018 Powell et al.

(56) References Cited

U.S. PATENT DOCUMENTS

| | | | |
|---|---|---|---|
| 2018/0111018 | A1 | 4/2018 | Lee |
| 2018/0117385 | A1 | 5/2018 | Watterson et al. |
| 2018/0117388 | A1 | 5/2018 | Porter |
| 2018/0117419 | A1 | 5/2018 | Jackson |
| 2018/0147440 | A1 | 5/2018 | Lin |
| 2018/0154205 | A1 | 6/2018 | Watterson |
| 2018/0154207 | A1 | 6/2018 | Hochstrasser |
| 2018/0154208 | A1 | 6/2018 | Powell et al. |
| 2018/0154209 | A1 | 6/2018 | Watterson |
| 2019/0058370 | A1 | 2/2019 | Tinney |
| 2019/0151698 | A1 | 5/2019 | Olson |
| 2019/0192898 | A1 | 6/2019 | Dalebout et al. |
| 2019/0192952 | A1 | 6/2019 | Powell |
| 2019/0209893 | A1 | 7/2019 | Watterson et al. |

FOREIGN PATENT DOCUMENTS

| | | |
|---|---|---|
| TW | I339127 | 8/2008 |
| TW | M422981 | 2/2012 |
| TW | M504568 | 3/2015 |

OTHER PUBLICATIONS

English Translation of Search Report for Taiwan Patent Application No. 105126694 dated Oct. 3, 2017.

International Search Report and Written Opinion issued in PCT/US2016/048692 dated Sep. 1, 2016.

International Search Report and Written Opinion issued in PCT/US2017/023002 dated Jun. 28, 2017.

International Search Report and Written Opinion issued in PCT/US2017/022989 dated May 23, 2017.

U.S. Appl. No. 16/378,022, filed Apr. 8, 2019, Watterson.

U.S. Appl. No. 16/435,104, filed Jun. 7, 2019, Buchanan.

U.S. Appl. No. 16/508,827, filed Jul. 11, 2019, Powell, et al.

U.S. Appl. No. 16/508,860, filed Jul. 11, 2019, Ashby, et al.

* cited by examiner

TREADMILL WITH REMOVABLE SUPPORTS

RELATED APPLICATIONS

This application claims priority to U.S. Patent Application Ser. No. 62/310,279 titled "Treadmill with Removable Supports" and filed on 18 Mar. 2016, which application is herein incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, and cycling among others activities. In contrast, anaerobic exercise typically involves high intensity exercises over a short duration of time. Popular forms of anaerobic exercise include strength training and short distance running.

Many choose to perform aerobic exercises indoors, such as in a gym or their home. Often, a user uses an aerobic exercise machine to have an aerobic workout indoors. One type of aerobic exercise machine is a treadmill, which is a machine that has a running deck attached to a support frame. The running deck can support the weight of a person using the machine. The running deck incorporates a tread belt that is driven by a motor. A user can run or walk in place on the tread belt by running or walking at the tread belt's speed. The speed and other operations of the treadmill are generally controlled through a control module that is also attached to the support frame and within a convenient reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include elliptical machines, rowing machines, stepper machines, and stationary bikes to name a few.

One type of treadmill is disclosed in U.S. Pat. No. 4,729,558 issued to Hai P. Kuo. In this reference, an improved running exerciser comprises a base frame having a first shaft and second shaft, a pair of inverted U-shaped members each mounted at one side of the base frame, a track in the form of endless loop around the first shaft and the second shaft, a pulley fastened on one end of the first shaft, a motor assembly having a tubular rod enclosing the first shaft, a pair of conical clutch discs put over a driving shaft of the motor assembly, a belt connecting the pulley to the clutch discs, a speed control mechanism mounted on one of the inverted U-shaped members for regulating speed of the track, and a stand for lifting a front end of the base frame to incline the endless loop to form a slope.

SUMMARY

In one embodiment, a treadmill includes a platform where the platform includes a first side panel and a second side panel spaced apart at a distance from the first side panel, and a gap defined between the first side panel and the second side panel. The treadmill also includes a running deck contained within the platform and exposed within the gap, a first pulley connected to the running deck, a second pulley connected to the running deck opposite the first pulley, a tread belt surrounding the first pulley and the second pulley, a first post removably connected to the platform, a second post removably connected to the platform, and a first rail transversely connected to the first post and the second post.

The running deck may include a deck length between the first pulley and the second pulley and a deck width transversely oriented with respect to the deck length where the deck width is at least 2.5 feet wide.

The platform may include a profile height of less than six inches.

The platform may include a profile height of less than four inches.

The platform may further define a recess and at least one of the first post and the second post may be connected to the platform within the recess.

The recess may include an electrical contact that forms an electrical connection with the at least one of the first post and the second post when an end of the first post of the second post is inserted into the recess.

The recess may include a pop-up cover that is urged upward when at least one of the first post and the second post is removed from the recess.

The treadmill may further include a flywheel connected to at least one of the first pulley and the second pulley. The flywheel may include a rotational axis, a flywheel length aligned with the rotational axis, and an outer diameter transverse the flywheel length. The flywheel length may be greater than the outer diameter.

The flywheel length may be at least 4.0 inches.

The flywheel length may be at least 6.0 inches.

The flywheel may be supported on a first flywheel end and a second flywheel end.

The treadmill may further include a display screen incorporated into the platform.

The treadmill may further include a third post removably connected to the platform, a fourth post removably connected to the platform, and a second rail transversely connected to the third post and the fourth post.

The second rail may be aligned with first rail and along a deck length of the deck.

In one embodiment, a platform where the platform includes a first side panel and a second side panel spaced apart at a distance from the first side panel, and a gap defined between the first side panel and the second side panel. The treadmill also includes a running deck contained within the platform and exposed within the gap, a first pulley connected to the running deck, a second pulley connected to the running deck opposite the first pulley, a tread belt surrounding the first pulley and the second pulley, a first post removably connected to the platform, a second post removably connected to the platform, a first rail transversely connected to the first post and the second post, the platform further defines a recess, at least one of the first post and the second post is connected to the platform within the recess, and the recess includes an electrical contact disposed within the recess forms an electrical connection with the at least one of the first post and the second post when an end of the first post of the second post is inserted into the recess.

The recess may include a pop-up cover that is urged upward when at least one of the first post and the second post is removed from the recess.

The treadmill may further include a flywheel connected to at least one of the first pulley and the second pulley. The flywheel may include a rotational axis, a flywheel length aligned with the rotational axis, and an outer diameter transverse the flywheel length. The flywheel length may be greater than the outer diameter.

The running deck may include a deck length between the first pulley and the second pulley and a deck width transversely oriented with respect to the deck length where the deck width is at least 2.5 feet wide.

The treadmill may further include a display screen incorporated into the platform.

In one embodiment, a treadmill includes a platform where the platform includes a first side panel and a second side panel spaced apart at a distance from the first side panel, and a gap defined between the first side panel and the second side panel. The treadmill also includes a running deck contained within the platform and exposed within the gap, a first pulley connected to the running deck, a second pulley connected to the running deck opposite the first pulley, a tread belt surrounding the first pulley and the second pulley, a first post removably connected to the platform, a second post removably connected to the platform, a first rail transversely connected to the first post and the second post, the platform further defines a recess, at least one of the first post and the second post is connected to the platform within the recess, and the recess includes an electrical contact disposed within the recess forms an electrical connection with the at least one of the first post and the second post when an end of the first post of the second post is inserted into the recess, the recess includes a pop-up cover that is urged upward when at least one of the first post and the second post is removed from the recess, and a flywheel connected to at least one of the first pulley and the second pulley. The flywheel includes a rotational axis, a flywheel length aligned with the rotational axis, and an outer diameter transverse the flywheel length. The flywheel is supported on a first flywheel end and a second flywheel end. The flywheel length is greater than the outer diameter. The running deck includes a deck length between the first pulley and the second pulley and a deck width transversely oriented with respect to the deck length where the deck width is at least 2.5 feet wide. Further, a display screen is incorporated into the platform.

In one embodiment, a treadmill includes a deck, a first pulley disposed in a first portion of the deck, a second pulley disposed in a second portion of the deck, a tread belt surrounding the first pulley and the second pulley, a scale mechanism incorporated into the deck, and a repetition counter is also incorporated into the treadmill.

The treadmill may include a motor in mechanical communication with at least one of the first pulley and the second pulley, a cover superjacent the motor, and the scale mechanism is incorporated into the cover over the motor.

The repetition counter may include a piezoelectric material.

The piezoelectric material may be incorporated into the cover.

The treadmill may include a free weight rack connected to the deck.

The treadmill may include a processor and memory and a display in communication with the processor where the processor is in communication with the scale mechanism and the repetition counter. The memory may include programmed instructions that, when executed, cause the processor to display a weight of a user.

The programmed instructions, when executed, may cause the processor to determine whether the user is holding a weight.

Determining whether the user is holding the weight may include measuring an increase with the scale mechanism.

The programmed instructions, when executed, may cause the processor to determine whether the user is executing an anaerobic exercise with a weight.

The programmed instructions, when executed, may cause the processor to count anaerobic exercise repetitions performed by the user with the repetition counter.

The programmed instructions, when executed, may cause the display to present a count of the anaerobic exercise repetitions.

The programmed instructions, when executed, may cause the processor to instruct the user to select a weight.

The programmed instructions, when executed, may cause the processor to instruct the user to perform an exercise with the weight.

The programmed instructions, when executed, may cause the processor to instruct the user to perform a pre-determined repetition count with the weight.

The programmed instructions, when executed, may cause the processor to verify that user selected weight by measuring the increase with the scale mechanism.

The programmed instructions, when executed, may cause the processor to verify that user performed the pre-determined repetitions with the repetition counter.

In one embodiment, a treadmill includes a deck, a first pulley disposed in a first portion of the deck, a second pulley disposed in a second portion of the deck, a tread belt surrounding the first pulley and the second pulley, a motor in mechanical communication with at least one of the first pulley and the second pulley, a cover superjacent the motor, a scale mechanism incorporated into the cover over the motor, a repetition counter having a piezoelectric material that is incorporated into the cover, and a free weight rack connected to the deck.

The treadmill may further include a processor and memory, a display in communication with the processor where the processor is also in communication with the scale mechanism and the repetition counter and where the memory includes programmed instructions that, when executed, cause the processor to display a weight of a user.

The programmed instructions, when executed, may cause the processor to instruct the user to select a weight and verify that user selected weight by measuring the increase with the scale mechanism.

In one embodiment, a treadmill includes a deck, a first pulley disposed in a first portion of the deck, a second pulley disposed in a second portion of the deck, a tread belt surrounding the first pulley and the second pulley, a motor in mechanical communication with at least one of the first pulley and the second pulley, a cover superjacent the motor, a scale mechanism incorporated into the cover over the motor, a repetition counter having a piezoelectric material that is incorporated into the cover, a free weight rack connected to the deck, a processor and memory, and a display in communication with the processor. The processor is in communication with the scale mechanism and the repetition counter and the memory includes programmed instructions that, when executed, cause the processor to instruct the user to select a weight, instruct the user to perform an exercise with the weight, instruct the user to perform a pre-determined repetition count with the weight, verify that user selected weight by measuring the increase with the scale mechanism, and verify that user performed the pre-determined repetitions with the repetition counter.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

Figure 1:
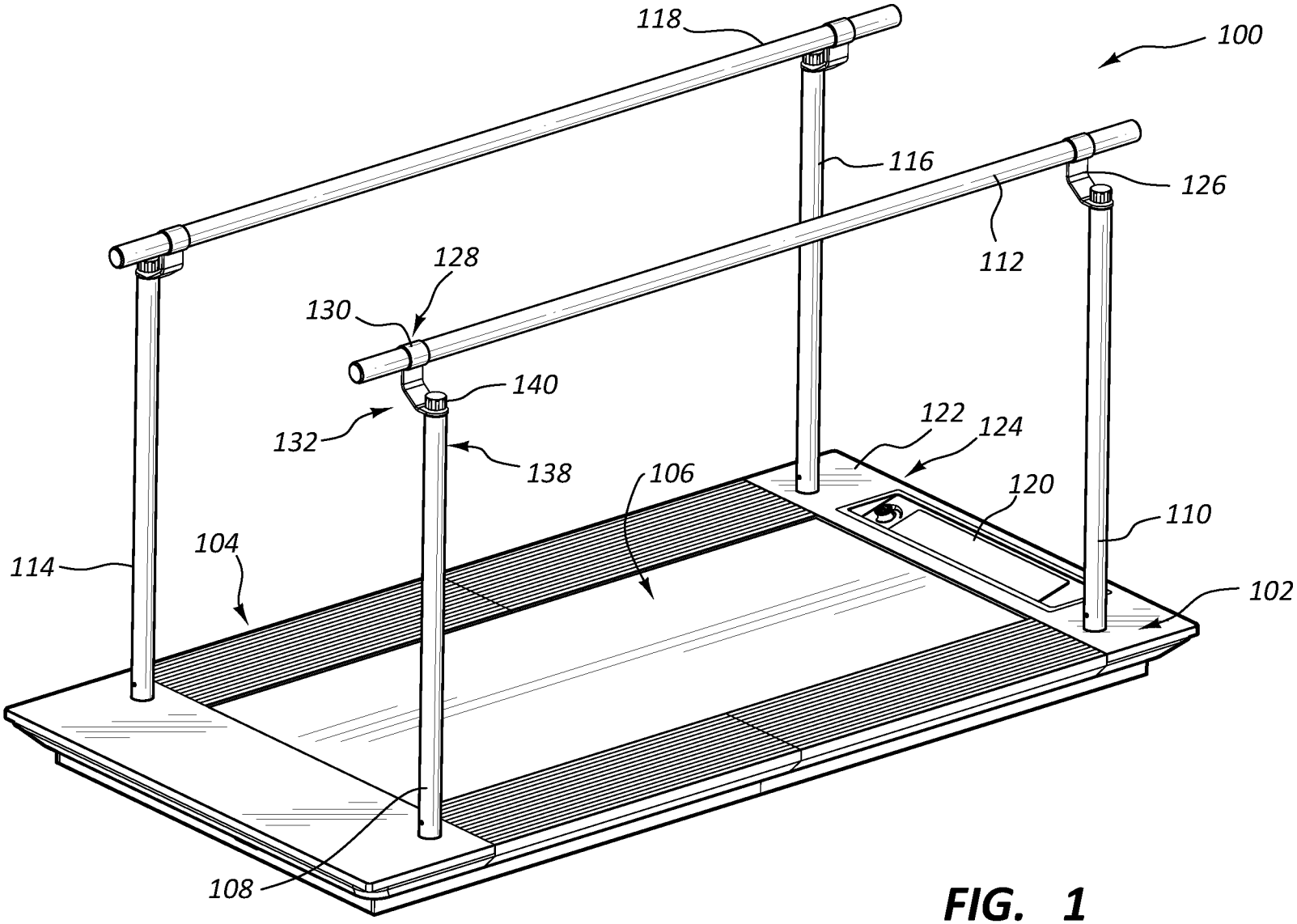
FIG. 1 illustrates a perspective view of an example of a treadmill in accordance with the present disclosure.

Particularly, with reference to the figures, FIG. 1 illustrates a perspective view of an example of a treadmill 100. In this example, the treadmill 100 includes a platform 102 with a first panel and a second panel that are spaced apart at a distance from one another. The space between the first panel and the second panel defines a gap 104. A running deck 106 is contained within the platform 102 and exposed within the gap 104. A first pulley (not shown) is connected to the running deck, and a second pulley (not shown) is connected to the running deck 106 opposite the first pulley. In the example of FIG. 1, the first and second pulleys are obscured from view underneath portions of a top surface of the platform 102. A tread belt surrounds the first pulley and the second pulley, and is accessible through the gap 104.

The platform 102 may have a length along its longest dimension and a width that is transverse the length. The platform's edges along both the width and the length have a wide section on which the user can stand.

The platform also includes a first post 108 that is removably connected to the platform 102, and a second post 110 that is removably connected to the platform 102. A first rail 112 transversely connects the first post 108 to the second post 110. In this example, the platform 102 also includes a third post 114 that is removably connected to the platform 102, and a forth post 116 is also removably connected to the platform 102. Additionally, a second rail 118 connects the third post 114 to the fourth post 116. While this example has been described with four posts 108, 110, 114, 116 and two rails 112, 118, the treadmill may include any appropriate number of posts and rails. In the illustrated example, each of the posts 108, 110, 114, 116 is located in a corner of the platform 102.

The posts 108, 110, 114, 116 and rails 112, 118 can be used to support the user when performing exercises like conventional treadmill exercises (e.g. walking, running, cycling, etc), performing dancing activities, or performing other types of activities. In those situations where the user is executing dance routines and/or moves, the wide portion of the platform 102 subjacent the rails 112, 118 may be wide enough for both the user's feet without the user having a portion of his or her foot hanging of off the wide portion. Although, in some situations, the user can perform the dances routines and/or moves on the tread belt or any other appropriate location on the treadmill.

The platform 102 also includes a display screen 120 integrated into the platform's top surface 122. This display screen 120 may be used to display information associated with the workout, with the user, with local news, with other types of information, or combinations thereof. In this example, the platform 102 also incorporates at least one input mechanism 124. The input mechanism may be used to change an operational parameter of the treadmill, change the display screen's view, send a message, perform another task, or combinations thereof.

The platform 102 may be wider than conventional treadmill decks. For example, the platform 102 may be at least 2.5 feet wide. Further, the platform 102 may also have a lower profile than conventional treadmill decks. For example, the platform may have a profile of less than six inches. In this example, when the treadmill is placed on a hard support surface, the platform's top surface is spatially located less than six inches away from the top surface of the platform.

The first post 108 may be connected to the first rail 112 with an offset connector 126. A first end 128 of the offset connector 126 may include an eye 130 defined by the first end 128. The eye 130 may be sized to receive a cross section of the first rail 112. In this example, the first rail 112 may be slid into the eye 130. In some examples, the friction between an inside surface of the eye 130 and the outside surface of the first rail 112 may be sufficient to minimize movement between the first rail 112 and the offset connector 126. In other examples, the first rail 112 may snap into place as the first rail 112 is slid through the eye 130 when the first rail 112 reaches a desired location. Any appropriate mechanism for securing the first rail 112 in the eye 130 may be used in accordance with the present disclosure.

A second end 132 of the offset connector 126 defines an eye 130 that is sized to be positioned over a receptacle defined in a top end 138 of the first post 108. In the illustrated example, a screw 140 is fitted through the eye 130 of the offset connector 126 and into the top end 138 of the first post 108. The screw 140 may be drawn tightly into the top end's receptacle by twisting the screw 140 in a circular motion. The friction between the screw's outside surface and the receptacle's inside surface may be sufficient to hold the weight of the offset connector 126 and the first rail 112. One advantage of the offset connector 126 is to provide space superjacent the screw 140 so that the screw 140 is accessible to the user and the screw 140 can be hand tightened.

Figure 2:
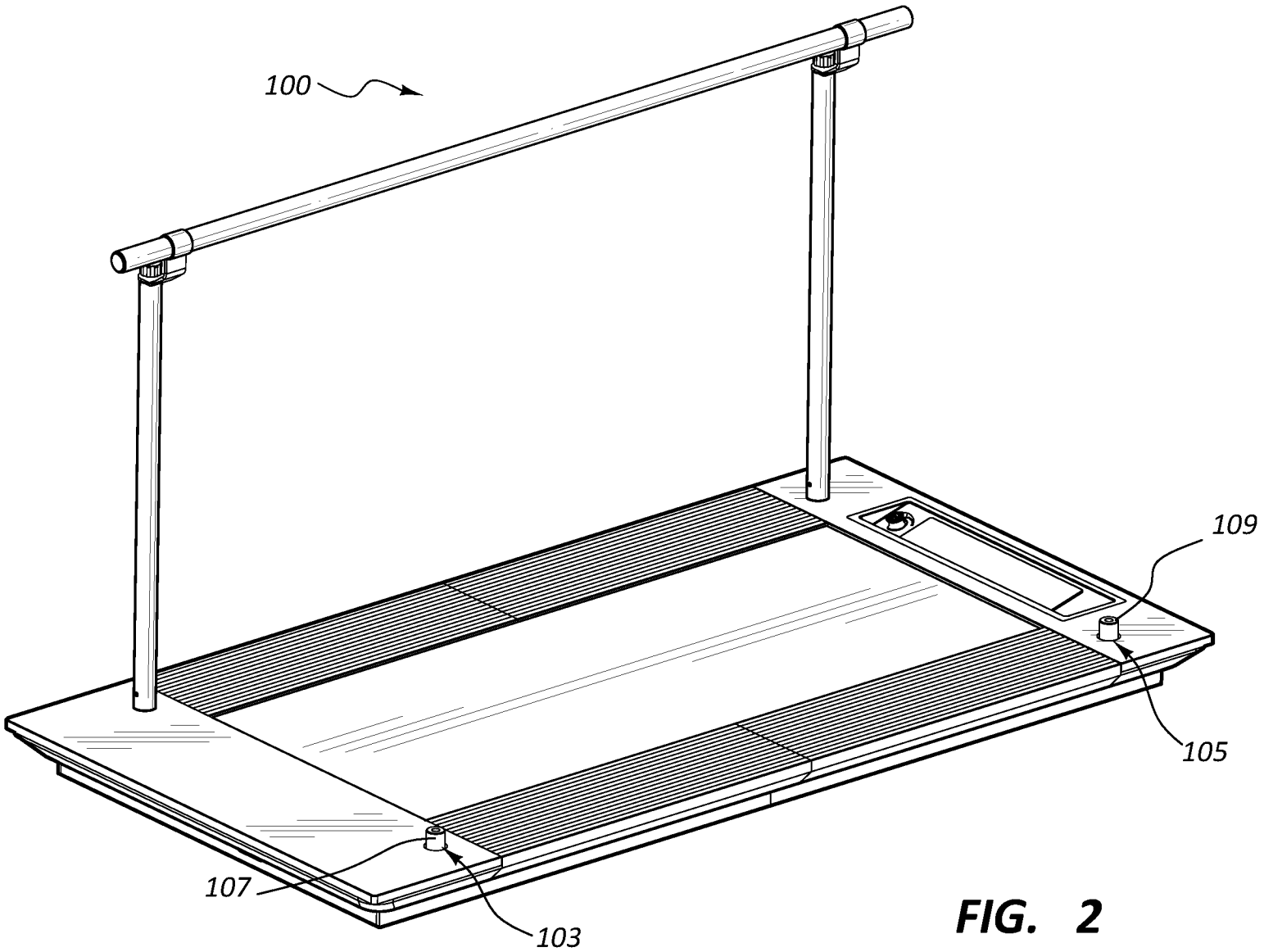
FIG. 2 illustrates a perspective diagram of an example of a treadmill in accordance with the present disclosure.

In the example of FIG. 2, the platform 100 is depicted with the first and second posts removed. In this example, the removal of the first and second posts exposes a first recess 103 in which the first post resided and a second recess 105 in which the second post resided. A first pop-up cover 107 is urged upward when the first post is removed and occupies a space defined by the first recess. Likewise, a second pop-up cover 109 is urged upward when the second post is removed and occupies a space defined by the second recess.

In some instances, the pop-up cover hides an electrical contact that is positioned in a side of either of the first recess or the second recess when the pop-up cover is urged upwards. In some instances, as an end of the first and/or second post is inserted back into the respective recess, the pop-up cover is displaced by the load applied from the insertion of the post. An electrically conductive portion of the end of the post may make direct or indirect contact with the electrical contact in the recess to establish an electrical connection. In these instances, electrical loads associated with the posts and/or rails may receive electrical power when the posts are inserted. For example, a control input may be incorporated into the rails and/or posts that generate an electrical load to operate.

Figure 3:
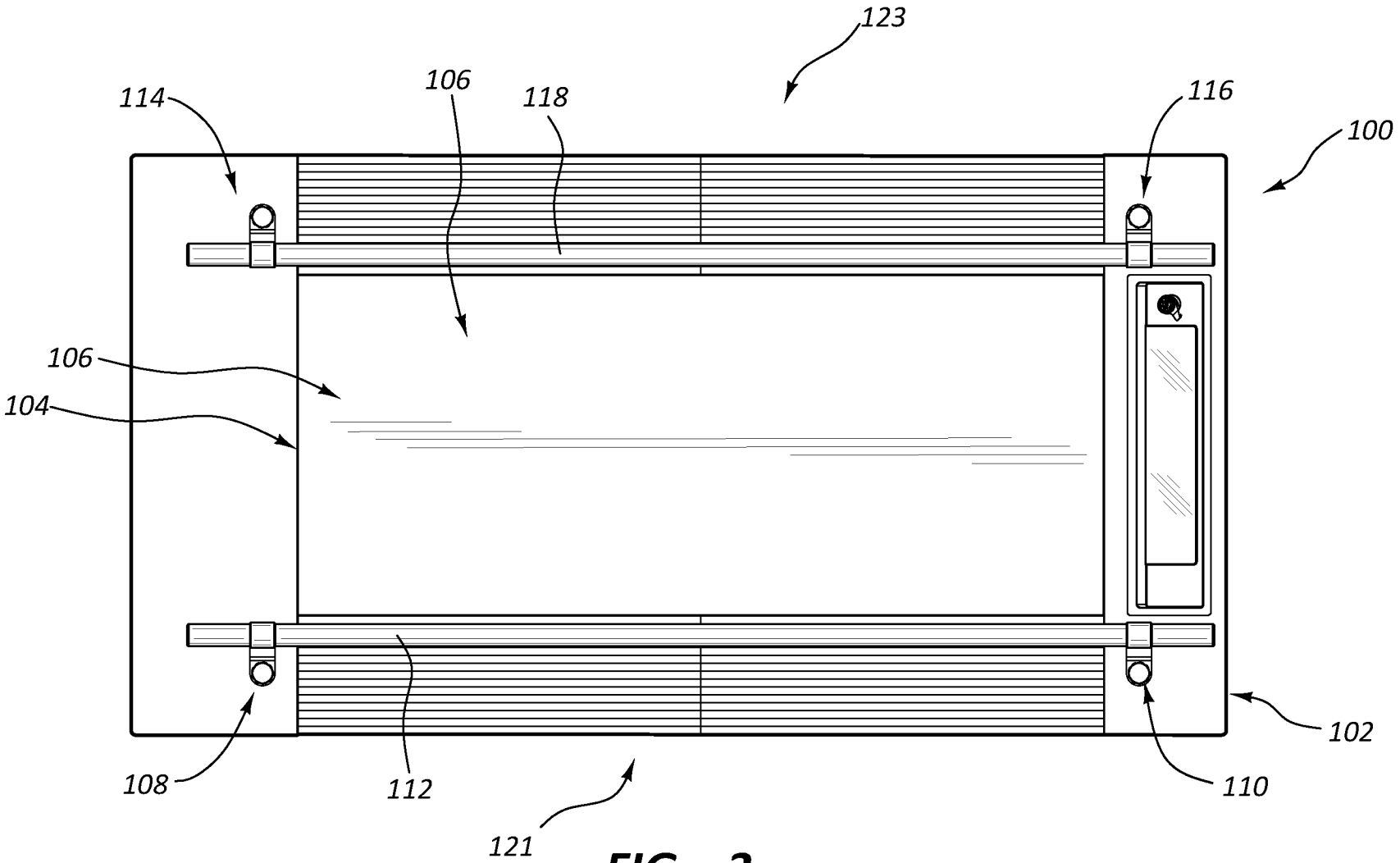
FIG. 3 illustrates a top view of an example of a treadmill in accordance with the present disclosure.

FIG. 3 illustrates a top view of an example of a treadmill 100. In this example, the treadmill 100 includes a platform 102. A first rail 112 and a second rail 118 are connected to the platform 102 with multiple posts 108, 110, 114, 116. In this example, the orientation of the first and second rails 112, 118 is aligned with a length of the treadmill 100.

A running deck 106 is exposed in a gap 104 defined in the platform 102. In this example, the first and second rails 112, 118 define a tread belt region. The platform 102 further includes a first side section 121 and a second side section 123. Each of the first and second side sections 121, 123 include a foot gripping that is on a side of the rails 112, 118 that is outside of the tread belt region.

Figure 4:
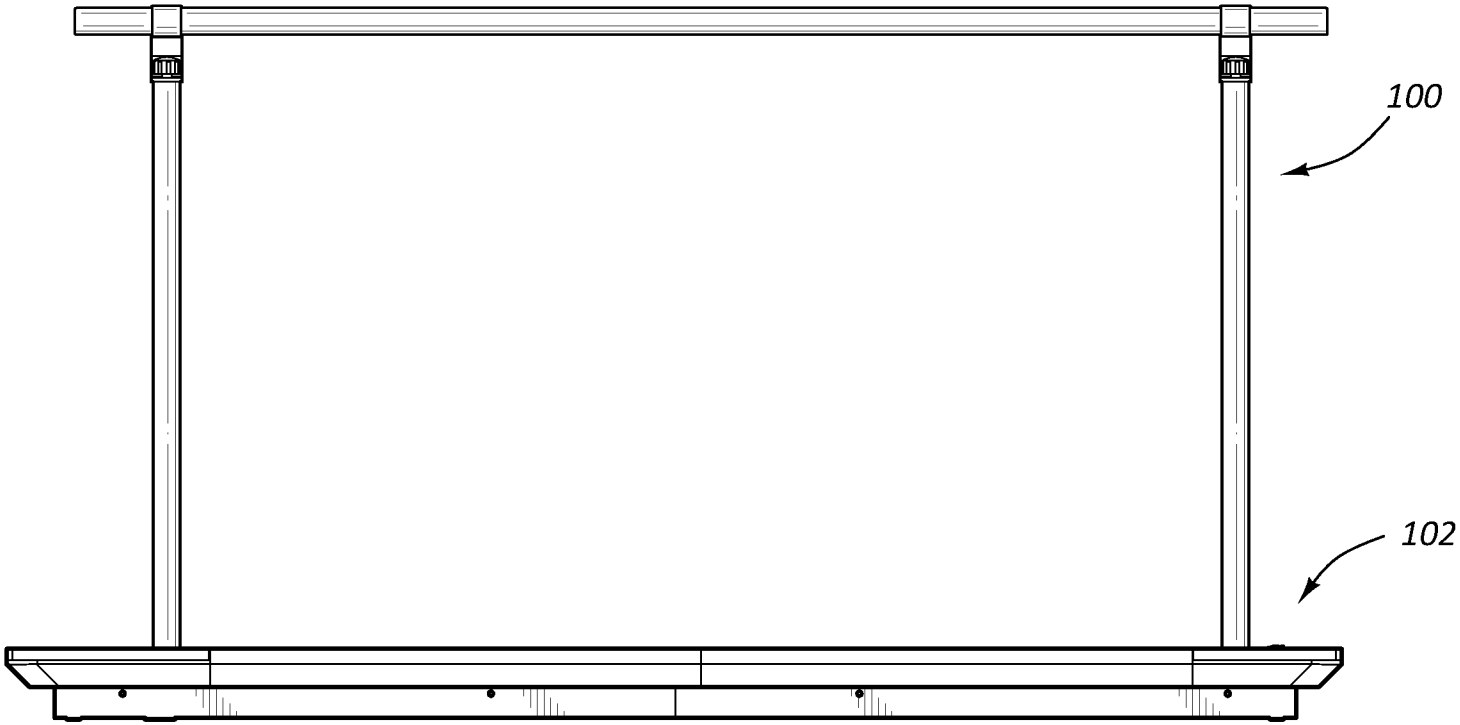
FIG. 4 illustrates a side view of an example of a treadmill in accordance with the present disclosure.

FIG. 4 illustrates a side view of a treadmill 100. In this example, the cross sectional height of the platform 102 is depicted. Components of the treadmill 100 are located within the cross sectional height of the treadmill, such as the motor, the pulleys, the tread belt, and so forth.

Figure 5:
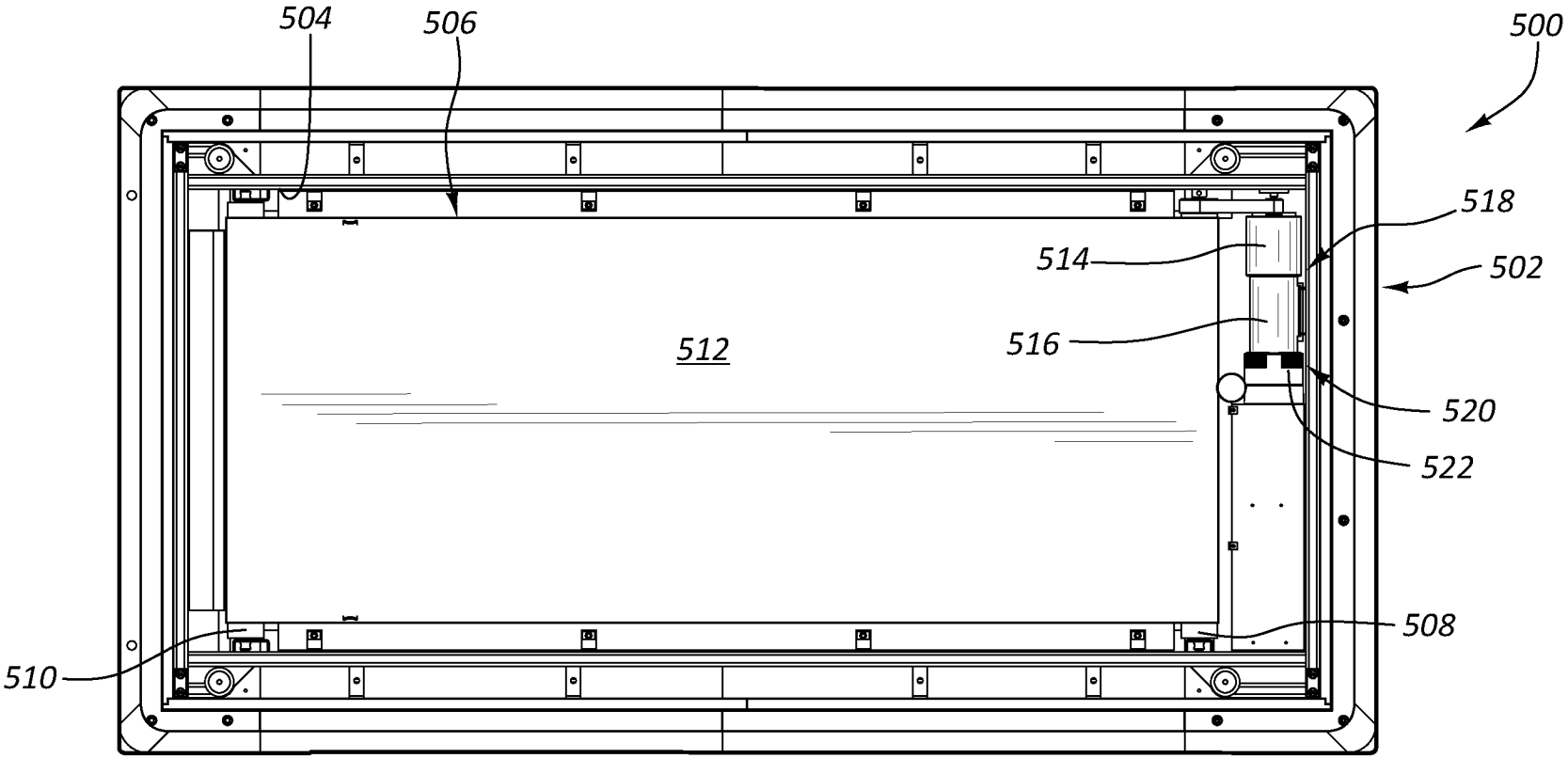
FIG. 5 illustrates a bottom view of an example of a treadmill in accordance with the present disclosure.
Figure 6:
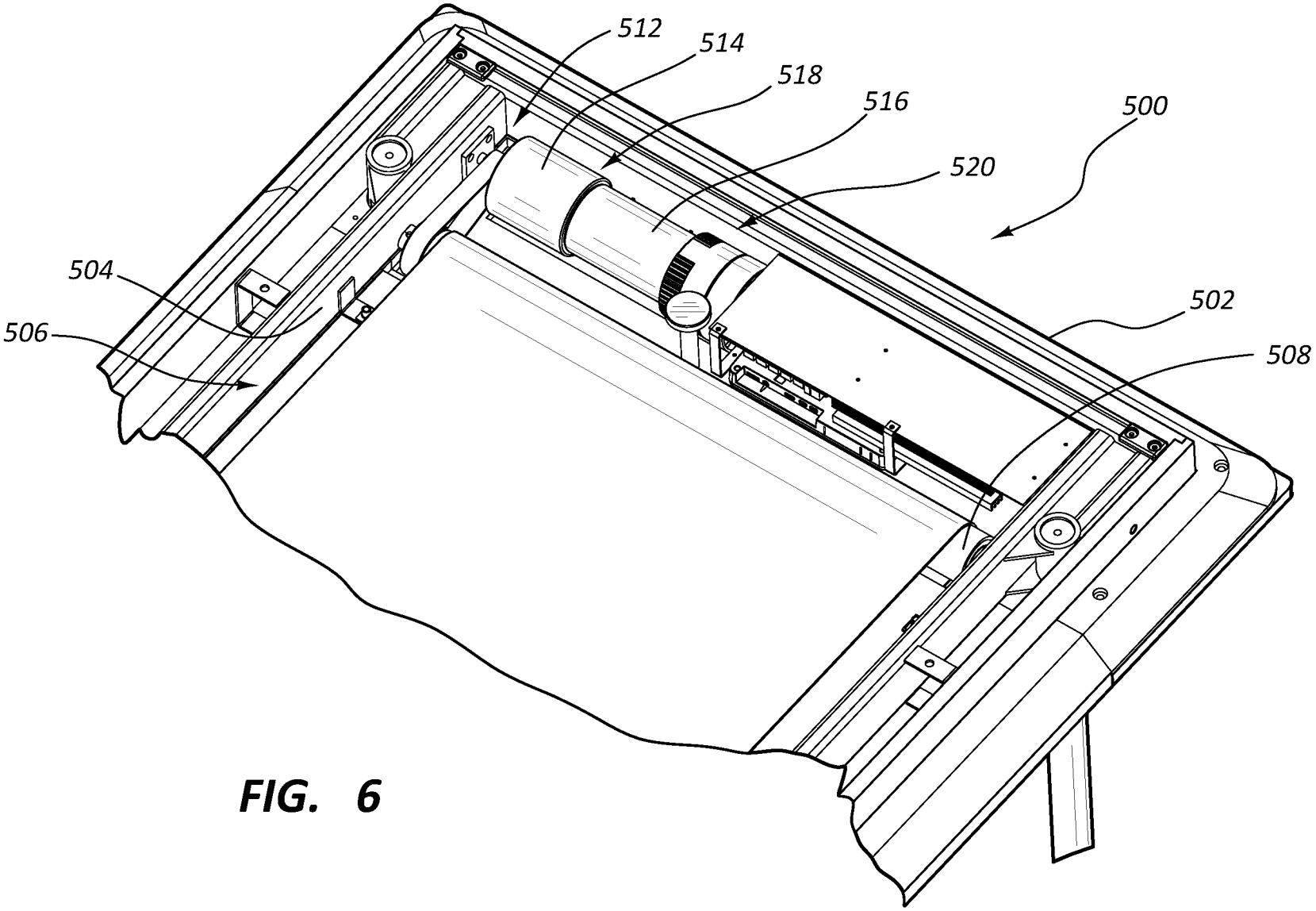
FIG. 6 illustrates a perspective view of an example of a flywheel in accordance with the present disclosure.

FIGS. 5 and 6 depict an example of an underside of a treadmill 500 with the treadmill's components exposed. In this example, the treadmill 500 includes a platform 502 that includes an inner surface 504. The inner surface 504 defines a gap 506 in the platform 502. A first pulley 508 and a second pulley 510 are connected to the inner surface 504 and a tread belt 512 surrounds the first and second pulleys 508, 510 within the gap 506. The first pulley 508 is rotated by a motor 514 that is connected to a flywheel 516. In this example, the motor 514 is connected to the first pulley 508 through a transmission belt that rotates the first pulley 508 as the motor's shaft rotates. The motor 514 is also connected to a first side 518 of the flywheel 516, and a second side 520 of the flywheel 516 is connected to a support 522 which is fixed to the platform 502. Thus, the flywheel is supported on its first side 518 and second side 520.

Figure 7:
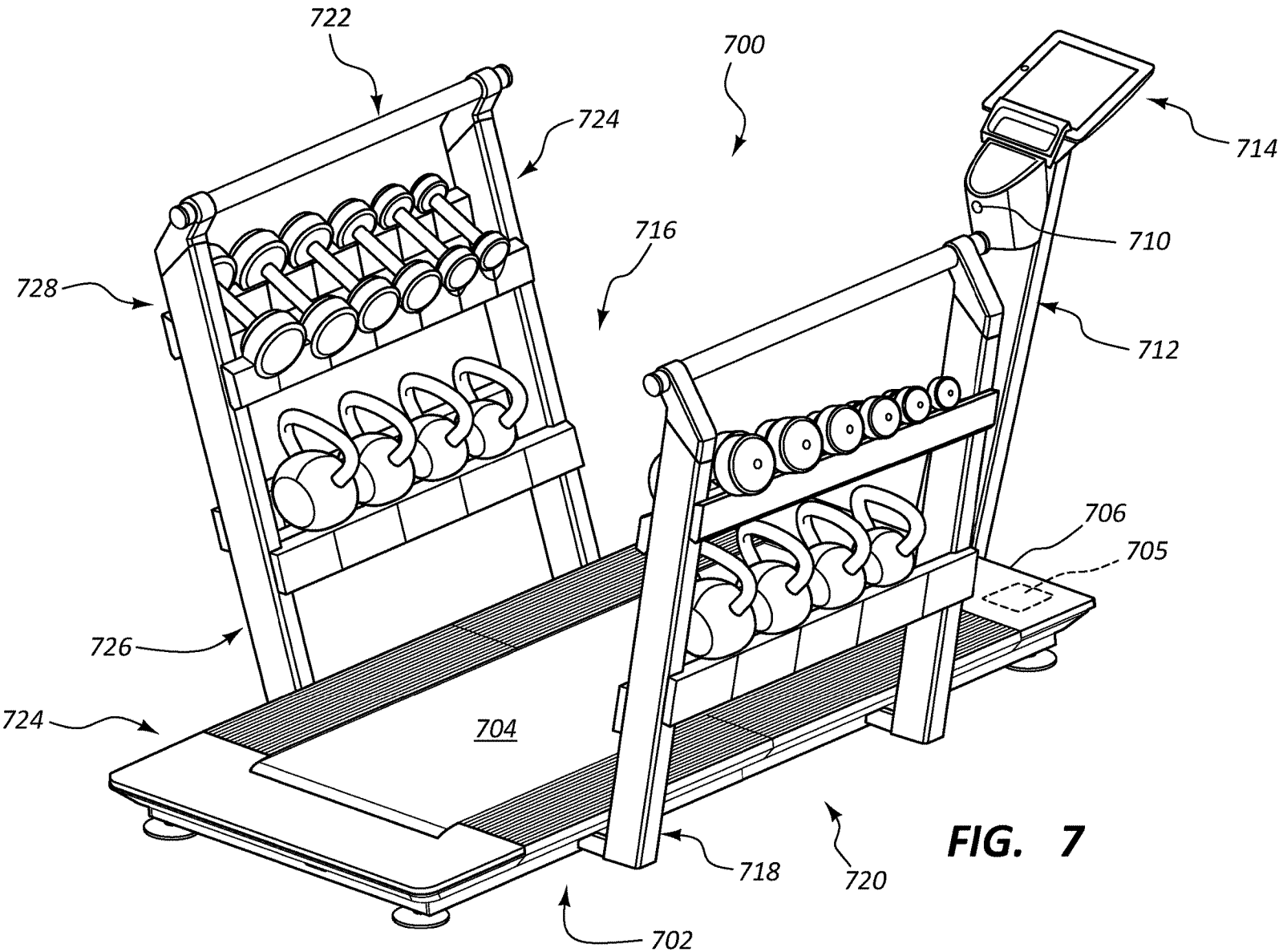
FIG. 7 illustrates a perspective view of an example of a treadmill in accordance with the present disclosure.

FIG. 7 depicts an example of a treadmill 700 having a deck 702 with a first pulley disposed in a first portion of the deck 702 and a second pulley incorporated into a second portion of the deck 702. A tread belt 704 surrounds the first pulley and the second pulley. A motor 705 is in mechanical communication with either the first pulley or the second pulley. A cover 706 is superjacent the motor 705. A scale mechanism is incorporated into the deck 702, and a repetition counter 710 is also incorporated into the treadmill.

The treadmill 700 also includes an upright portion 712 that supports a console 714. In this example, the repetition counter 710 is incorporated into the upright portion 712. In this example, the scale mechanism is obscured from view, but is incorporated into the cover 706 near the base of the upright portion 712.

Also incorporated into the treadmill 700 is a free weight rack 716. In this example, a first portion 718 of the free weight rack 716 is connected to a first side 720 of the deck 702, and a second portion 722 of the free weight rack 716 is connected to a second side 724 of the deck 702. The free weight rack 716 may include multiple tiers. In this example, each of the portions of the free weight rack 716 include a first tier 726 and a second tier 728. In some cases, each of the tiers include a cross member that includes features that prevent that free weights from slipping off of the rack. For example, the feature may include a lip, a recess, another type of feature, or combinations thereof.

Figure 8:
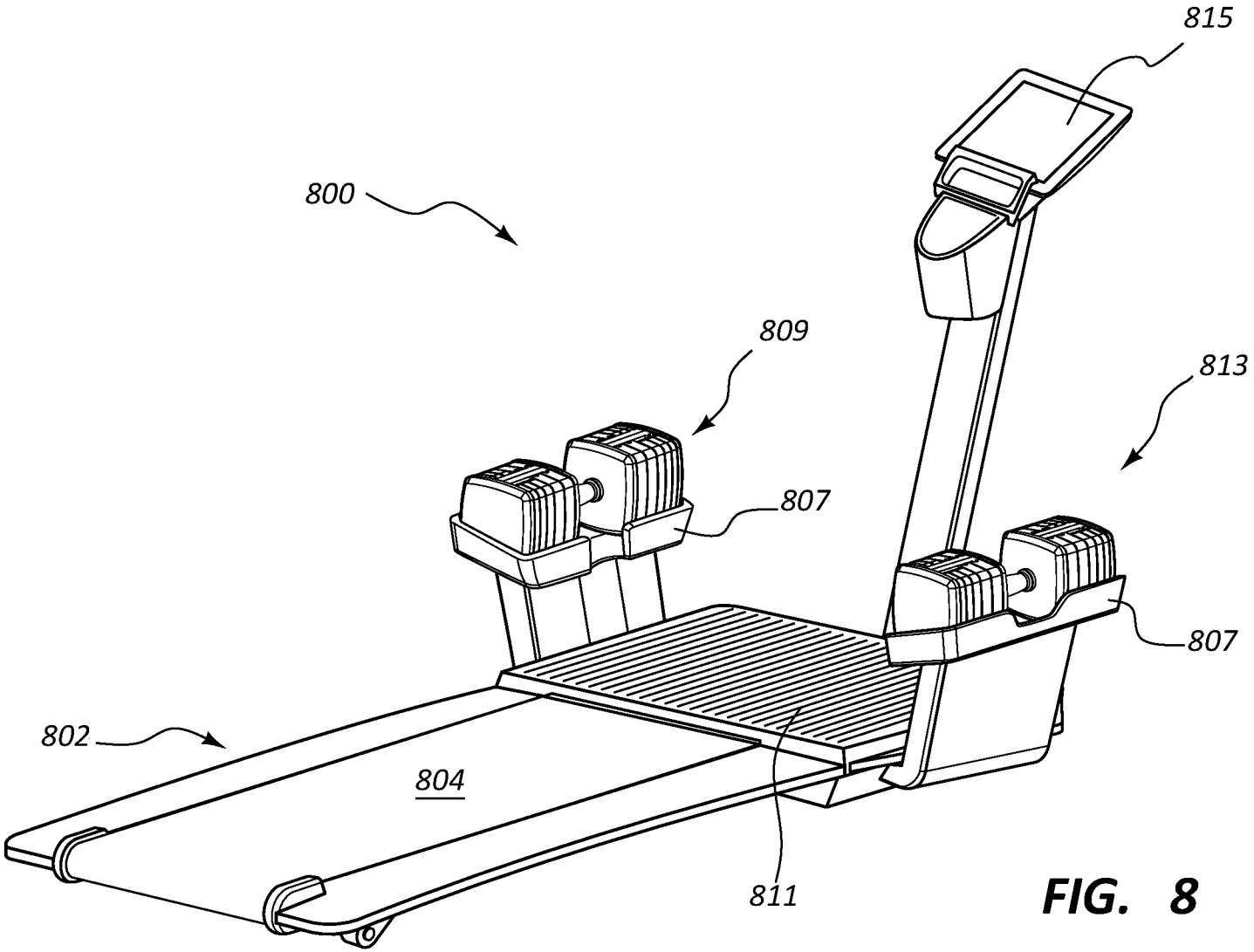
FIG. 8 illustrates a perspective view of an example of a treadmill in accordance with the present disclosure.

FIG. 8 depicts an example of a treadmill 800. In this example, the treadmill 800 includes a deck 802, and a tread belt 804 that surrounds a first pulley and second pulley incorporated into the deck 802. A free weight rack 807 is also incorporated into the treadmill 800. In this example, the free weight rack 807 includes just a single tier and supports an adjustable dumbbell 809.

A weight scale 811 is incorporated into the deck 802 at a front end 813 of the treadmill 800. In this example, the weight scale 811 is positioned over the motor that drives the first pulley and therefore drives the tread belt 804. As a user stands on the weight scale 811, the weight of the user can be presented in the console 815, in a display incorporated into the weight scale 811, in a mobile device, or in another computing device in communication with the weight scale, or combinations thereof. Additionally, when the user lifts the free weights off of the rack 807, the weight scale measures the combined weight of the user and the free weights. In some cases, the fluctuation of the weight scale's measurements that occur as the user performs an anaerobic exercise with the free weights is used by the repetition counter to determine how many lifts the user has performed.

Figure 9:
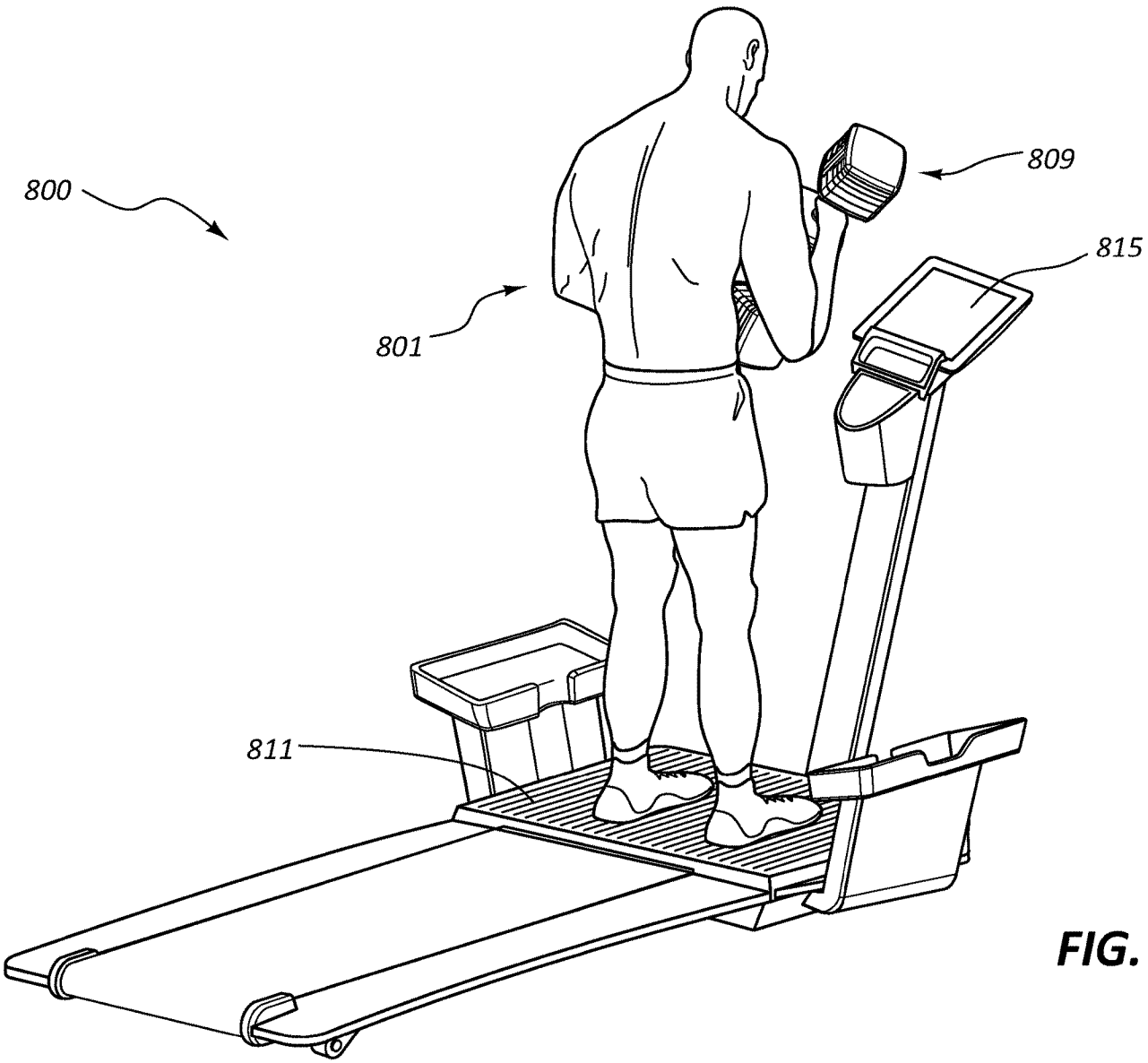
FIG. 9 illustrates a perspective view of an example of a treadmill in accordance with the present disclosure.

FIG. 9 depicts an example of a user 801 performing an anaerobic workout with the free weights (e.g., dumbbell 809) on the weight scale 811. In this situation, the fluctuation of the weight scale's measurements while the user performs lifts with the free weights is used by the repetition counter to determine how many lifts the user has performed. In this example, the amount of weight lifted by the user 801 is depicted in the console 815.

Figure 10:
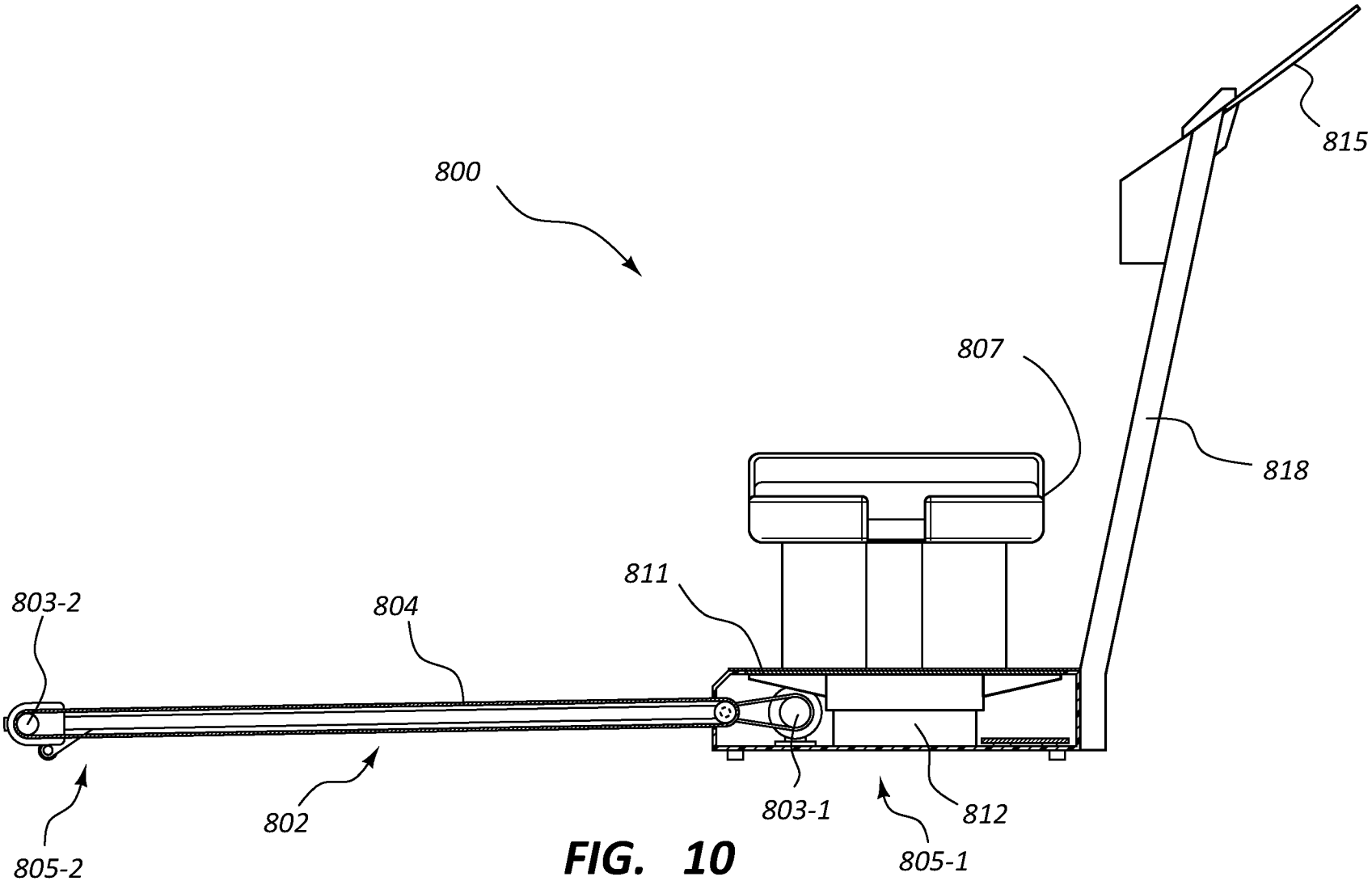
FIG. 10 illustrates a cross sectional view of an example of a treadmill in accordance with the present disclosure.

FIG. 10 depicts a cross sectional view of a treadmill 800. In this example, the treadmill 800 includes a deck 802 with a first pulley 803-1 in a first portion 805-1 of the deck 802 and a second pulley 803-2 in a second portion 805-2 of the deck. A tread belt 804 surrounds the first pulley 803-1 and the second pulley 803-2. A motor 812 drives the first pulley 803-1 to move the tread belt 804. A weight scale 811 is positioned over the motor 812. A rack 807 is attached to the deck 802 adjacent to the weight scale 811. An upright portion 818 of the treadmill 800 is attached to the deck 802, and a console 815 is attached to the upright portion 818.

Figure 11:
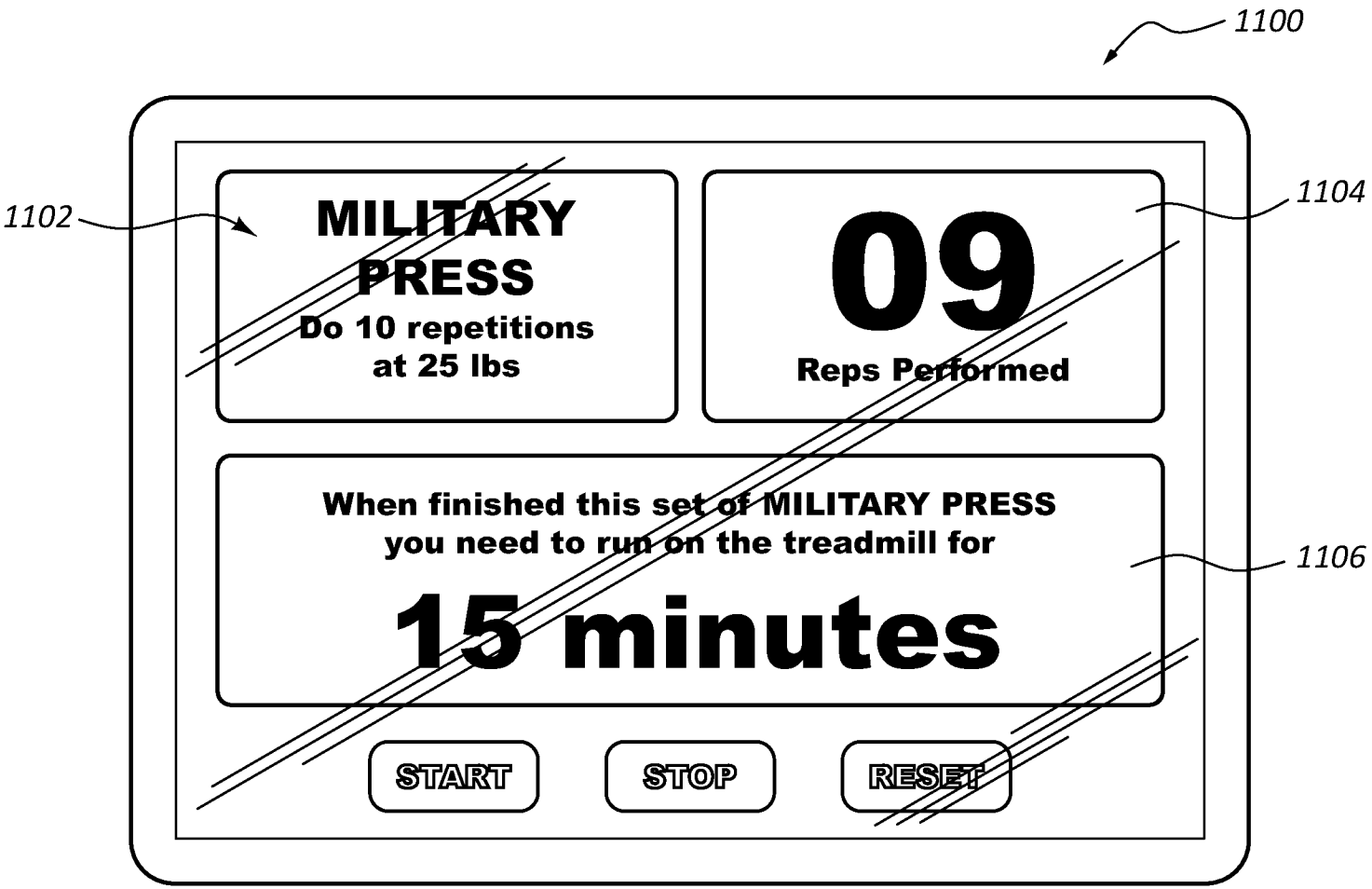
FIG. 11 illustrates a view of an example of display incorporated into an exercise device in accordance with the present disclosure.

FIG. 11 depicts an example of a display 1100 incorporated into a console of an exercise device. The exercise device may be like the exercise device depicted in the other figures that incorporate a weight scale. In this example, the display includes instructions 1102 to perform a certain type of lift, including the weight amount to be lifted and the number of repetitions. The display 1100 also includes a repetition counter 1104, which presents the number of repetitions that the user has already performed. The display 1100 also includes instructions 1106 for what the user is to do after the anaerobic exercise is completed. In this case, the instructions includes running on the treadmill for 15 minutes.

Figure 12:
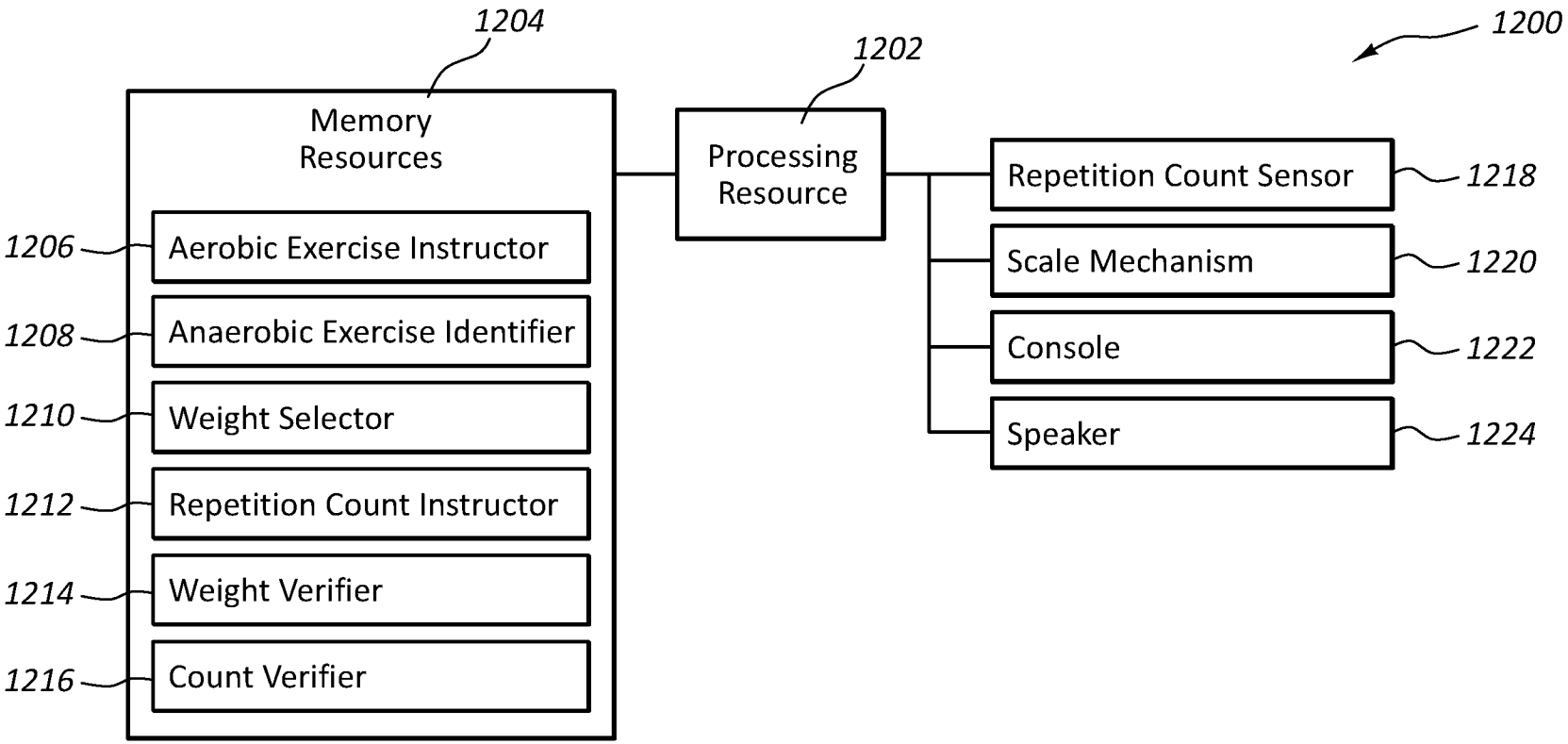
FIG. 12 illustrates a perspective view of an instruction system incorporated into an exercise device in accordance with the present disclosure.

FIG. 12 depicts an example of an instruction system 1200. In this example, the instruction system 1200 includes processing resources 1202 and memory resources 1204. The memory resources 1204 may cause the processing resources 1202 to carry out functions programmed in the memory resources 1204. In this example, the memory resources 1204 include an aerobic exercise instructor 1206, an anaerobic exercise instructor 1208, a weight selector 1210, a repetition count instructor 1212, a weight verifier 1214, and a count verifier 1216. Further, the processing resources 1202 may be in communication with a repetition count sensor 1218, a scale mechanism 1220, a console 1222, a speaker 1224, or combinations thereof.

General Description

In general, the invention disclosed herein may provide an user with a treadmill that has several advantages over conventional treadmills. The treadmill may include a running deck that has first pulley and a second pulley. A tread belt may surround the first and second pulley. A motor can be attached to either the first or the second pulley so that as the motor rotates its shaft, the connected pulley also rotates which drives movement of the tread belt. In those examples where the treadmill includes just a single motor, the movement of the tread belt drives movement of the other pulley that is not connected to the motor.

The platform may have a length along its longest dimension and a width that is transverse the length. The platform's edges along both the width and the length have a wide section on which the user can stand. These wide sections may include foot grips. The wide sections may be incorporated in the front of the platform, the rear of the platform, and both sides of the platform. These wide sections are constructed to have a strength that is sufficient to hold the user's weight, even when the user is performing dynamic exercises/movements on the wide sections.

Multiple posts may be removably connected to the platform. For example, a first and second post may be removably connected to a single side of the platform. In some examples, the posts are inserted into a recess defined in the platform's top surface. A stab connection between the base end of the post and the recess allows for quick and easy assembly. In some cases, the stab connection may include an alignment features incorporated into the base end of the post, such as a protrusion or trough that interlocks with a corresponding alignment feature in the recess. The alignment features may force the posts to be inserted in just a single orientation which causes the connectors attached to the top end of the posts to be oriented in a desired orientation. For example, the top ends of the first and second posts may include eyes or another type of opening that can receive a rail. In this example, the alignment features may align the eyes of the first and second posts so that the rail can be inserted through both the eyes. Thus, the first and second posts can collectively support a rail on one side of the treadmill. This rail may be inserted through the eyes of the posts' connectors for quick and easy attachment. In some cases, the location features may be incorporated into the rail which forces the rail to be inserted only so far into the post's eyes so that during assembly, the rails come to a stop in the desired locations.

Similarly, a third and a fourth post may be removably connected to the treadmill's platform on the other side of the gap. The third and the fourth posts may also connect a second rail on the other side of the gap. The first and second rails may be positioned adjacent to the gap and within a convenient arm's reach for a user who is walking or otherwise performing a type of exercise on the tread belt.

The base end of the posts may be held in place in the recess through a compression fit. In other examples, the base end of the posts are bolted to the platform. In yet other examples, the base end of the posts includes thread forms that are complementary to thread forms formed in the recesses and the posts' base end and the recess are threadly connected.

In some cases, the treadmill may be used to do dance moves, dance routines, barre exercises, other types of movements, or combinations thereof. In some cases, the rails may be vertically adjustable so that users of different heights may perform barre exercises, other types of movements, or combinations thereof. The portion of the platform underneath and adjacent to the rails may include a foot grip to assist the user when performing these movements.

In those situations where the treadmill is being used to perform dancing movements, one of the rails and its associated posts may be removed from the treadmill. The user may prefer to have the rails and posts in place while the user is performing an aerobic exercise on the treadmill. But, in some examples, all of the rails and posts are removed when the user executes an aerobic workout on the running deck.

The first post may be connected to the first rail with an offset connector. A first end of the offset connector may include an eye defined by the first end. The eye may be sized to receive a cross section of the first rail. In this example, the first rail may be slid through the eye. In some examples, the friction between an inside surface of the eye and the outside surface of the first rail may be sufficient to minimize movement between the first rail and the offset connector.

A second end of the offset connector defines a hole that is sized to be positioned over a receptacle defined in a top end of the first post. In this example, a screw is fitted through the hole of the offset connector and into the top end of the first post. The screw may be drawn tightly into the top end's receptacle by twisting the screw in a circular motion. The friction between the screw's outside surface and the receptacle's inside surface may be sufficient to hold the weight of the offset connector and the first rail. One advantage of the offset connector is to provide space superjacent the screw so that the screw is accessible to the user and the screw can be hand tightened.

While this example has been described with a specific structure for connecting the rails to the posts, any appropriate mechanism for connecting the rails to the post may be used in accordance with the principles described herein. For example, the rails may be integrally formed with the posts so that the posts and the rails are installed into the platform as a single unit. In other examples, the rails may snap into the posts. In yet an additional example, the rail may be held in place with magnets, adhesives, latches, straps, other mechanisms, or combinations thereof.

Also, even though the examples above have described the connection between the base end of the posts and the platform as a stab connection, any appropriate type of connection may be used in accordance with the present disclosure. For example, the posts may be screwed into place, wedged into place, bolted into place, or otherwise connected to the platform.

In some embodiments, when the posts are removed from the platform, recesses from which the posts were removed are exposed. In some cases, pop-up covers may be urged upward when the posts are removed. These pop-up covers may occupy a space defined by the recesses. The pop-up covers may be spring loaded so that the move up in the absence of a load (e.g. when the posts are removed from the recess) and move downward out of the way when a sufficient load is applied (e.g. when the post is inserted into the recess). The pop-up cover can prevent objects from getting placed in the recess that could interfere with inserting the posts. In other examples, the pop-up covers may be pneumatically, electrically, or hydraulically controlled. Further, the pop-up covers may be controlled with another type of mechanical mechanism other than a spring.

In some instances, the pop-up cover hides an electrical contact that is positioned in a side of either of the first recess or the second recess when the pop-up cover is urged upwards. In some instances, as an end of the first and/or second post is inserted back into the respective recess, the pop-up cover is displaced by the load applied from the insertion of the post. An electrically conductive portion of the end of the post may make direct or indirect contact with the electrical contact in the recess to establish an electrical connection. In these instances, electrical loads associated with the posts and/or rails may receive electrical power when the posts are inserted. For example, a control input may be incorporated into the rails and/or posts that generate an electrical load to operate.

The platform may be wider than conventional treadmill decks. For example, the platform may be at least 2.5 feet wide. In some instances, the platform may be up to six feet wide. When the platform is over 2.5 feet wide, shocks that are conventionally used in treadmills to cushion the user's impacts may not be used while still providing a sufficient amount of cushion for the user. This wider dimension allows for the platform to deflect as the user's feet impact the running deck. Thus, the impacts can be absorbed over a greater portion of the platform Further, the platform may also have a lower profile than conventional treadmill decks. For example, the platform may have a profile of less than six inches. In some examples, the platform has a profile that is less than five inches. In yet other examples, the profile is less than four inches. In even yet additional examples, the profile is less than three inches. Unlike conventional treadmills that include legs that space the underside of the treadmill off of the ground, in this example the underside of the platform rests directly on the support surface to keep the top surface of the treadmill closer to the support surface.

A low profile treadmill may assist those doing dance routines or other types of exercises that may involve getting on and off of the treadmill. Further, a low profile treadmill that is just a few inches off of the support surface may reduce the difficulty that elderly users or less agile users have getting on and off of the treadmill.

To assist with getting on and off of the treadmill, the portions of the platform around the gap may include foot grips. In some examples, the foot grips are just located on the sides of the platform that are aligned with the platform's length. In other examples, the foot grips are included in those parts of the platform that cover the front pulley and/or the back pulley.

In some examples, the platform may include sensors that identify where the user is standing. These sensors may indicate whether the user has stepped off of the tread belt onto the platform. In this example, the treadmill may reduce or eliminate the speed of the tread belt when the user is no longer standing on the tread belt. This sensor may be a load cell incorporated into any portion of the platform. In other examples, the sensor is a strain gauge, a magnetic sensor, a pressure chamber, another type of sensor, or combinations thereof that may be incorporated into the platform to detect when the user is on the platform. In some examples, the load drawn from the motor may indicate when no one is standing, walking, running, or otherwise on the tread belt. In this situation, the treadmill may power down the tread belt in response to determining that the tread belt is not being used. In yet other examples, other types of weight detecting sensors may be incorporated into the tread belt assembly to determine when the user is on the tread belt. In even further examples, an optical sensor, such as a camera, an infrared sensor, a distance sensor, or another type of sensor may be used to determine whether the user is on the tread belt or not. In other examples when the sensors are pressure plates, the plates may be just incorporated into an edge of the platform.

To enable a low profile platform as described above, the pulleys, tread belt, motor, and flywheel are thinner than the platform. To provide sufficient horse power to drive the movement of the pulleys and tread belt with components that thin, multiple motors may be used. In other examples, just a single motor is used to drive the movement of the pulleys and tread belt.

Further, the flywheel incorporated into the thin platform has a diameter that is shorter than conventional flywheels. In flywheels, the rotary energy that is stored during the rotation of the flywheel is in the flywheel's outer circumference, which motivates one of ordinary skill in the art to increase the flywheel's circumference to store more energy while reducing the flywheel's cross sectional thickness. Thus, the flywheel's outer diameter is greater than the flywheel's cross sectional thickness. In contrast, some of the example of the present invention include a flywheel with a cross sectional thickness that is greater than its outer diameter. With the cross sectional thickness being the longest dimension of the flywheel, the cross sectional thickness becomes the flywheel's length. In this example, the flywheel includes a rotational axis, a flywheel length aligned with the rotational axis, an outer diameter transverse the flywheel length where the flywheel length is greater than the outer diameter.

In some cases, the length of the flywheel is at least three inches. In another example, the length of the flywheel is at least four inches. In additional examples, the length of the flywheel is at least five inches. In yet another example, the length of the flywheel is at least six inches. In an even additional example, the length of the flywheel is at least seven inches.

The flywheel may be supported with a support connected to the platform on a first side of the flywheel and on a second side of the flywheel. In other examples, either of the flywheel's end may be supported by other components that are at least fixed with respect to the platform. A bearing assembly may be used on each end of the flywheel to support the flywheel from sagging.

The console may be incorporated into the treadmill's platform. In some cases, the platform includes a display screen integrated into the platform's top surface. This display screen may be used to display information associated with the workout, with the user, with local news, with other types of information, or combinations thereof. In some examples, the treadmill's operational parameters can be presented in the display screen. The display screen may be made of any appropriate type of material that can withstand a user standing on it. This material may include Kevlar® or another type of material.

In some examples, the console is in communication with other sensors incorporated into the treadmill. The console and these sensors may be hardwired or in wireless communication. In some examples, a hear rate monitor is incorporated into the rails. An electrically conductive medium carries the signal from a heart rate monitor pad incorporated into the rail to the connector that attaches the rail to the post. The connector may include an electrically conductive material that connects the electrically conductive media of the rail with an electrically conductive media in the post. The electrically conductive media of the post may make an electrical connection with an electrical contact in the recess where the post is connected to the platform. The platform may be wired to carry the signal to a processor for interpreting the signal to understand the user's heart rate. This heart rate may be displayed in the display screen.

In another example, the rail includes at least one input mechanism that can be used to change an operational parameter of the treadmill, change the display screen's view, send a message, perform another task, or combinations thereof. The rail may be electrically connected to the platform as explained above or alternatively, the rail may be in wireless communication with the platform, processor, and/or display screen.

Further, the platform may also incorporate at least one input mechanism. The input mechanism may be used to change an operational parameter of the treadmill, change the display screen's view, send a message, perform another task, or combinations thereof.

The treadmill may also be in communication with a remote device over a network, such as the internet. The user may access the records of his or her exercise history, previous workouts, exercise recommendation, personal information, or combinations thereof. The remote device may record the workout information and/or the physiological information associated with the workout. An example of a user program that may be compatible with the principles described herein can be found at www.ifit.com, which is administered through Icon Health and Fitness, Inc. located in Logan, Utah, U.S.A.

In some cases, a free weight rack may be incorporated into the treadmill. In this example, the free weight rack may have a first portion incorporated into a first side of the treadmill and a second portion incorporated into a second side of the treadmill. Each of the portions of the free weight rack may position the free weights within a convenient reach of each of the user's hands. Thus, the free weights may be accessible to the user when the user is on the exercise deck.

For purposes of this disclosure, the term "free weight" refers broadly to free weights that are intended to be used to execute lifts associated with strength training. In some cases, the free weights may be intended to be held in a single hand where free weights for a first hand are positioned in the first portion 718 of the free weight rack 716, and free weights intended for the second hand are positioned in the second portion 722 of the free weight rack 716. These free weights may include dumbbells, kettle balls, balls, adjustable dumbbells, weight plates, Bulgarian bags, other types of weighted bags, barbells, curl bars, other types of free weights, or combinations thereof.

In some cases, the user can work out on the portion of the exercise deck that includes the tread belt. In this example, the user may desire to mix up the anaerobic exercise and aerobic exercise portions of his or her workout. During the anaerobic portions of the workout, the tread belt may be stopped while the user performs the free weight exercises. When the anaerobic portion of the workout is completed, the user may resume the operation of the tread belt to perform an aerobic portion of the workout. In other examples, the user may want to use the free weights while the tread belt is in operation. For example, the user may want to carry dumbbells during a run.

In other examples, the treadmill incorporates a separate area on the exercise deck where the user can perform exercises with the free weights. In some cases, this free weight area may be in the front end of the treadmill proximate the treadmill's upright portion. A console supported by the upright portion can provide information about the user's workout such as the time, distance, and speed at which the user executed the aerobic portions and the anaerobic portions of the workout.

In some cases, the free weight area may include a weight scale. The weight scale may be large enough to allow the user to stand and/or exercise on the weight scale. This type of treadmill may allow the user to alternate between performing exercises on the tread belt and performing exercises on the weight scale. One advantage to working out on the weight scale is that as the user performs certain types of exercises, like thrusting free weights over his head, the load felt by the weight scale changes. Detecting this change can be used to determine when and if the user actually performed the overhead lift. For example, in situations where the dumbbells are thrust over the user's head, the scale may measure an increased amount of weight. The processing resources in communication with the weight scale may associate a time stamp with the measured increase. Thus, the processing resources can determine statistics about the user's workout (e.g. how long the user executed the workout, how long between each repetition, start times, end times, and so forth).

The weight scale can also determine how much weight the user is using during the workout. For example, the weight scale can determine the weight of the user when the user is standing on the scale without holding weights. When the user picks up free weights, the weight scale can subtract the user's body weight from the total weight being measured. The difference between the total weight and the user's body weight can be assumed to be the weight amount the user is holding.

Exercising on the scale can provide inputs for determining how many repetitions the user performed. For example, the weight scale may recognize weight fluctuation patterns that are characteristic of the user lifting or lowering free weights. As these patterns are recognized, the weight scale may cause a repetition counter to increment by one when a lift pattern is recognized.

The weight scale may include any appropriate type of measuring mechanism. In some examples, the weight scale includes a piezoelectric material that changes its electrical properties in response to a mechanical load. In other examples, the weight scale may include a magnetostrictive material that changes its magnetic properties in response the mechanical load. In yet other examples, the weight scale may also include a spring mechanism, a strain gauge, a hydraulic mechanism, a pneumatic mechanism, another type of measuring mechanism, or combinations thereof.

In some cases, the tread belt passes over the region of the treadmill deck that contains the weight scale. In this example, the treadmill can determine when the user is holding weight while standing on the tread belt like in situations where the user is carrying free weights during a walk or run. In response to determining that the user is carrying free weights during a walk or run, the treadmill can increase the calorie burn count.

In some situations, the treadmill guides the user with a programmed workout. In some cases, the programmed workout alters the tread belt's speed, the incline of the deck, and other factors affecting the aerobic portion of the workout. Additionally, the programmed workout may include anaerobic portions as well. In these instances, the programmed workout may instruct the user to perform certain types of lifts with the free weights. In some cases, the programmed workout may select the amount of weight that the user is to lift. In embodiments where the free weight rack includes an adjustable dumbbell, the treadmill may cause the adjustable dumbbell to select the amount of weight prescribed by the programmed workout. In other instances, the treadmill may allow the user to select the amount of weight to lift even if the programmed workout instructs the user to lift a predetermined amount.

The predetermined weight amount recommended in the programmed workout may be based on information about the user. This information may be derived from history compiled with fitness trackers, previous workouts on the treadmill, age information, height information, body composition information, gender information, other types of personal information, or combinations thereof. In some instances, the treadmill is in communication with a remote computing device that contains a user profile detailing fitness information about the user. The treadmill or a remote computing device may also take into consideration the user's fitness goals when selecting the type of lifts to perform, the amount of weight to perform with the lifts, and the number of repetitions.

The weight scale can be used to determine if the user selected the recommended weight amount. In those situations where the user selected a different weight amount than the recommended amount, the programmed workout can alter an aspect of the workout. For example, if the user selected a weight amount that is heavier than the recommended amount, the programmed workout can reduce the number of repetitions that the user is instructed to lift. Further, the calorie burn count can also be adjustable based on the weight amount that the user actually selects instead of the weight amount instructed by the programmed workout.

The weight scale can also be used to verify that the user performs the number of recommended lifts. In this example, the weight scale can cause a repetition counter to increment by one when the weight scale detects a weight fluctuation pattern characteristic of performing a lift. In some examples, a separate repetition counter is used to determine the number of repetitions performed by the user. For example, an optical camera can be incorporated into the treadmill's upright structure. The optical camera can record and analyze information to determine the number of lifts performed by the user and, in some instances, whether the user performed the type of lift instructed by the programmed workout.

In some cases, the programmed workout's instructions can be presented to the user through a display in the console. The programmed workout can present the number of lifts to perform, the type of lifts to perform, the next type of exercise to perform, and so forth. In some case, the display screen can instruct the user on how to perform the lift. For instance, the programmed workout may instruct the user to perform negatives by lifting up quickly and lowering the weight slowly, or the programmed workout may instruct the user to perform the same type of lift by lifting up and lowering the weight at the same rate. In other examples, a speaker may be used to audibly instruct the user about the programmed workout.

Information relating to both the anaerobic and aerobic portions of the workout can be present to the user. For instance, the repetition count may be presented in the display, the calories burned during the workout may be presented in the display, the user's heart rate or other physiological parameters be presented in the display, and so forth.

In some case, the treadmill is in communication with a remote device, and the information recorded about the workout is sent to the remote device. In one instance, the information is sent to the user's mobile device and the user follows the workout with his or her mobile device.

The instruction system for instruction the user about the workout may include a combination of hardware and programmed instructions for executing the functions of the instruction system. The instruction system may include processing resources that are in communication with memory resources. Processing resources include at least one processor and other resources used to process the programmed instructions. As described herein, the memory resources may represent generally any memory capable of storing data such as programmed instructions or data structures used by the instruction system.

The processing resources may include I/O resources that are capable of being in communication with a remote device that stores user information, workout history, external resources, databases, or combinations thereof. The remote device may be a mobile device, a cloud based device, a computing device, another type of device, or combinations thereof. In some examples, the instruction system communicates with the remote device through a mobile device which relays communications between the instruction system and the remote device. In other examples, the mobile device has access to information about the user. The remote device may collect information about the user throughout the day, such as tracking calories, exercise, activity level, sleep, other types of information, or combination thereof.

The remote device may execute a program that can provide useful information to the instruction system. An example of a program that may be compatible with the principles described herein includes the iFit program which is available through www.ifit.com identified above. An example of a program that may be compatible with the principles described in this disclosure is described in U.S. Pat. No. 7,980,996 issued to Paul Hickman. U.S. Pat. No. 7,980,996 is herein incorporated by reference for all that it discloses. In some examples, user information accessible through the remote device includes the user's age, gender, body composition, height, weight, health conditions, other types of information, or combinations thereof.

The processing resources, memory resources, and remote devices may communicate over any appropriate network and/or protocol through the input/output resources. In some examples, the input/output resources includes a transmitter, a receiver, a transceiver, or another communication device for wired and/or wireless communications. For example, these devices may be capable of communicating using the ZigBee protocol, Z-Wave protocol, BlueTooth protocol, Wi-Fi protocol, Global System for Mobile Communications (GSM) standard, another standard, or combinations thereof. In other examples, the user can directly input some information into the instruction system through a digital input/ output mechanism, a mechanical input/output mechanism, another type of mechanism, or combinations thereof.

The memory resources may include a computer readable storage medium that contains computer readable program code to cause tasks to be executed by the processing resources. The computer readable storage medium may be a tangible and/or non-transitory storage medium. The computer readable storage medium may be any appropriate storage medium that is not a transmission storage medium. A non-exhaustive list of computer readable storage medium types includes non-volatile memory, volatile memory, random access memory, write only memory, flash memory, electrically erasable program read only memory, magnetic based memory, other types of memory, or combinations thereof.

The memory resources may include an aerobic exercise instructor that represents programmed instructions that, when executed, cause the processing resources to control the aerobic portion of the user's workout. The aerobic exercise may include, but is not limited to, walking, running, shuffling, skipping, biking, jumping, or otherwise moving while the tread belt is in operation. The aerobic exercise instructor may control the speed of the tread belt based on the user's heart rate or other physiological readings, the user's goals, programmed workouts, inputs from the user, or combinations thereof.

The memory resources may also include an anaerobic exercise instructor that represents programmed instructions that, when executed, cause the processing resources to control the anaerobic portions of the user's workout. The anaerobic exercise instructor may instruct the user to perform lifts, perform a number of repetitions, perform a type of lift, perform other aspects of the anaerobic portion of the workout, perform other aspects of the workout, or combinations thereof.

The memory resources may also include a weight selector that represents programmed instructions that, when executed, cause the processing resources to select the amount of weight to lift. In one embodiment, the free weights include an adjustable dumbbell, and a selector is incorporated into the rack. The selector adjusts the dumbbell so that the desired amount of weight is automatically attached to the dumbbell's handle, and the user does not have to make the adjustment manually.

The repetition count instructor represents programmed instructions that, when executed, cause the processing resources to instruct the user to perform a number of lifts. The lift number may be presented to the user through a display, through a speaker, another mechanism, or combinations thereof.

The weight verifier represents programmed instructions that, when executed, cause the processing resources to verify that the user is lifting the weight. In some cases, the weight verifier also verifies that the user is lifting the amount of weight instructed by the instruction system.

The counter verifier represents programmed instructions that, when executed, cause the processing resources to verify that the user is performing the instructed number of lifts. This count verification may be based on images captured with an optical sensor, the fluctuations measured at the weight scale, another type of sensor, or combinations thereof. The count verification may be presented in a console or display integrated into the treadmill, a mobile device in communication with the treadmill, a remote device in communication with the treadmill, or combinations thereof.

Further, the memory resources may be part of an installation package. In response to installing the installation package, the programmed instructions of the memory resources may be downloaded from the installation package's source, such as a portable medium, a server, a remote network location, another location, or combinations thereof. Portable memory media that are compatible with the principles described herein include DVDs, CDs, flash memory, portable disks, magnetic disks, optical disks, other forms of portable memory, or combinations thereof. In other examples, the program instructions are already installed. Here, the memory resources can include integrated memory such as a hard drive, a solid state hard drive, or the like.

In some examples, the processing resources and the memory resources are located within the treadmill, the adjustable dumbbell, the mobile device, an external device, another type of device, or combinations thereof. The memory resources may be part of any of these device's main memory, caches, registers, non-volatile memory, or elsewhere in their memory hierarchy. Alternatively, the memory resources may be in communication with the processing resources over a network. Further, data structures, such as libraries or databases containing user and/or workout information, may be accessed from a remote location over a network connection while the programmed instructions are located locally.

What is claimed is:

1. A treadmill, comprising:

a platform having a profile height of less than four inches the platform including:

a first side panel; and a second side panel spaced apart at a distance from the first side panel;

a gap defined between the first side panel and the second side panel;

a running deck contained within the platform and exposed within the gap;

a first pulley connected to the running deck;

a second pulley opposite the first pulley and connected to the running deck;

a tread belt surrounding the first pulley and the second pulley;

a first post removably connected to the platform;

a second post removably connected to the platform; and a first rail transversely connected to the first post and the second post.

2. The treadmill of claim 1, wherein an underside of the platform does not include legs.

3. The treadmill of claim 1, wherein the running deck includes a deck length between the first pulley and the second pulley and a deck width transversely oriented with respect to the deck length;

wherein the deck width is at least 2.5 feet wide.

4. The treadmill of claim 1, wherein an underside of the platform rests directly on a support surface to keep a top surface of the treadmill close to the support surface.

5. The treadmill of claim 1, wherein the platform further defines at least one recess; and at least one of the first post and the second post is respectively connected to the platform within the at least one recess.

6. The treadmill of claim 5, wherein the at least one recess includes an electrical contact that respectively forms an electrical connection with the at least one of the first post and the second post when an end of the at least one of the first post and the second post is respectively inserted into the at least one recess.

7. The treadmill of claim 5, wherein the at least one recess includes a pop-up cover that is respectively urged upward when the at least one of the first post and the second post is respectively removed from the at least one recess.

8. The treadmill of claim 1, further including:
a flywheel connected to at least one of the first pulley and the second pulley;
the flywheel includes:
a rotational axis;
a flywheel length aligned with the rotational axis; and
an outer diameter transverse to the flywheel length;
wherein the flywheel length is greater than the outer diameter.

9. The treadmill of claim 8, wherein the flywheel length is at least 4.0 inches.

10. The treadmill of claim 8, wherein the flywheel length is at least 6.0 inches.

11. The treadmill of claim 8, wherein the flywheel is supported on a first flywheel end and a second flywheel end.

12. The treadmill of claim 1, further including a display screen incorporated into the platform.

13. The treadmill of claim 1, further including:
a third post removably connected to the platform;
a fourth post removably connected to the platform; and
a second rail transversely connected to the third post and the fourth post.

14. The treadmill of claim 13, wherein the second rail is aligned with the first rail and along a deck length of the running deck.

15. A treadmill, comprising:
a platform including:
a first side panel; and
a second side panel spaced apart at a distance from the first side panel;
a gap defined between the first side panel and the second side panel;
a running deck contained within the platform and exposed within the gap;
a first pulley connected to the running deck;
a second pulley opposite the first pulley and connected to the running deck;
a tread belt surrounding the first pulley and the second pulley;
a first post removably connected to the platform;
a second post removably connected to the platform;
a first rail transversely connected to the first post and the second post;
the platform further defines at least one recess;
at least one of the first post and the second post is respectively connected to the platform within the at least one recess; and
the at least one recess includes an electrical contact respectively disposed within the at least one recess that respectively forms an electrical connection with the at least one of the first post and the second post when an end of the at least one of the first post and the second post is respectively inserted into the at least one recess.

16. The treadmill of claim 15, wherein the at least one recess includes a pop-up cover that is respectively urged upward when the at least one of the first post and the second post is respectively removed from the at least one recess.

17. The treadmill of claim 15, further including:
a flywheel connected to at least one of the first pulley and the second pulley;
the flywheel includes;
a rotational axis;
a flywheel length aligned with the rotational axis; and
an outer diameter transverse to the flywheel length;
wherein the flywheel length is greater than the outer diameter.

18. The treadmill of claim 15, wherein the running deck includes a deck length between the first pulley and the second pulley and a deck width transversely oriented with respect to the deck length;
wherein the deck width is at least 2.5 feet wide.

19. The treadmill of claim 15, further including a display screen incorporated into the platform.

20. A treadmill, comprising:
a platform including:
a first side panel; and
a second side panel spaced apart at a distance from the first side panel;
a gap defined between the first side panel and the second side panel;
a running deck contained within the platform and exposed within the gap;
a first pulley connected to the running deck;
a second pulley opposite the first Dully and connected to the running deck;
a tread belt surrounding the first pulley and the second pulley;
a first post removably connected to the platform;
a second post removably connected to the platform;
a first rail transversely connected to the first post and the second post;
the platform further defines at least one recess;
at least one of the first post and the second post is respectively connected to the platform within the at least one recess; and
the at least one recess includes an electrical contact respectively disposed within the at least one recess that respectively forms an electrical connection with the at least one of the first post and the second post when an end of the at least one of the first post and the second post is respectively inserted into the at least one recess;
the at least one recess includes a pop-up cover that is respectively urged upward when the at least one of the first post and the second post is respectively removed from the at least one recess;
a flywheel connected to at least one of the first pulley and the second pulley;
the flywheel includes:
a rotational axis;
a flywheel length aligned with the rotational axis; and
an outer diameter transverse to the flywheel length;
the flywheel is supported on a first flywheel end and a second flywheel end;
wherein the flywheel length is greater than the outer diameter;
the running deck includes a deck length between the first pulley and the second pulley and a deck width transversely oriented with respect to the deck length where the deck width is at least 2.5 feet wide; and
a display screen incorporated into the platform.

* * * * *